US008917154B2

(12) United States Patent
Fullerton et al.

(10) Patent No.: US 8,917,154 B2
(45) Date of Patent: Dec. 23, 2014

(54) SYSTEM FOR CONCENTRATING MAGNETIC FLUX

(71) Applicant: Correlated Magnetics Research, LLC, Huntsville, AL (US)

(72) Inventors: Larry W. Fullerton, New Hope, AL (US); Mark D. Roberts, Huntsville, AL (US); Wesley R. Swift, Jr., Huntsville, AL (US); Hamilton G. Moore, Decatur, AL (US)

(73) Assignee: Correlated Magnetics Research, LLC., Huntsville, AL (US)

( * ) Notice: Subject to any disclaimer, the term of this patent is extended or adjusted under 35 U.S.C. 154(b) by 0 days.

(21) Appl. No.: 14/258,723

(22) Filed: Apr. 22, 2014

(65) Prior Publication Data

US 2014/0320248 A1 Oct. 30, 2014

Related U.S. Application Data

(63) Continuation-in-part of application No. 14/103,699, filed on Dec. 11, 2013.

(60) Provisional application No. 61/854,333, filed on Apr. 22, 2013, provisional application No. 61/735,403, filed on Dec. 10, 2012, provisional application No. 61/852,431, filed on Mar. 15, 2013.

(51) Int. Cl.
*H01F 3/00* (2006.01)
*H01F 7/02* (2006.01)

(52) U.S. Cl.
CPC ..... *H01F 7/0278* (2013.01)
USPC ..... 335/296; 335/297; 335/306

(58) Field of Classification Search
USPC ..... 335/296–298, 306
See application file for complete search history.

(56) References Cited

U.S. PATENT DOCUMENTS

| | | | |
|---|---|---|---|
| 93,931 | A | 8/1869 | Wescott |
| 361,248 | A | 4/1887 | Winton |
| 381,968 | A | 5/1888 | Tesla |

(Continued)

FOREIGN PATENT DOCUMENTS

| | | | |
|---|---|---|---|
| CN | 1615573 | A | 5/2005 |
| DE | 2938782 | A1 | 4/1981 |

(Continued)

OTHER PUBLICATIONS

Atallah, K., Calverley, S.D., D. Howe, 2004, "Design, analysis and realisation of a high-performance magnetic gear", IEE Proc.-Electr. Power Appl., vol. 151, No. 2, Mar. 2004.

(Continued)

*Primary Examiner* — Ramon Barrera
(74) *Attorney, Agent, or Firm* — Vector IP Law Group; Robert S. Babayi

(57) ABSTRACT

An improved system for concentrating magnetic flux of a multi-pole magnetic structure at the surface of a ferromagnetic target uses pole pieces having a magnet-to-pole piece interface with a first area and a pole piece-to-target interface with a second area substantially smaller than the first area, where the target can be a ferromagnetic material or a complementary pole pieces. The multi-pole magnetic structure can be a coded magnetic structure or an alternating polarity structure comprising two polarity directions, or can be a hybrid structure comprising more than two polarity directions. A magnetic structure can be made up of discrete magnets or can be a printed magnetic structure.

20 Claims, 43 Drawing Sheets

(56) References Cited

U.S. PATENT DOCUMENTS

| | | | |
|---|---|---|---|
| 493,858 | A | 3/1893 | Edison |
| 675,323 | A | 5/1901 | Clark |
| 687,292 | A | 11/1901 | Armstrong |
| 996,933 | A | 7/1911 | Lindquist |
| 1,081,462 | A | 12/1913 | Patton |
| 1,171,351 | A | 2/1916 | Neuland |
| 1,236,234 | A | 8/1917 | Troje |
| 1,252,289 | A | 1/1918 | Murray, Jr. |
| 1,301,135 | A | 4/1919 | Karasick |
| 1,312,546 | A | 8/1919 | Karasick |
| 1,323,546 | A | 8/1919 | Karasick |
| 1,554,236 | A | 1/1920 | Simmons |
| 1,343,751 | A | 6/1920 | Simmons |
| 1,624,741 | A | 12/1926 | Leppke et al. |
| 1,784,256 | A | 12/1930 | Stout |
| 1,895,129 | A | 1/1933 | Jones |
| 2,046,161 | A | 7/1936 | Klaiber |
| 2,147,462 | A | 12/1936 | Butler |
| 2,186,074 | A | 1/1940 | Koller |
| 2,240,035 | A | 4/1941 | Catherall |
| 2,243,555 | A | 5/1941 | Faus |
| 2,269,149 | A | 1/1942 | Edgar |
| 2,327,748 | A | 8/1943 | Smith |
| 2,337,248 | A | 12/1943 | Koller |
| 2,337,249 | A | 12/1943 | Koller |
| 2,389,298 | A | 11/1945 | Ellis |
| 2,401,887 | A | 6/1946 | Sheppard |
| 2,414,653 | A | 1/1947 | Lokholder |
| 2,438,231 | A | 3/1948 | Schultz |
| 2,471,634 | A | 5/1949 | Vennice |
| 2,475,456 | A | 7/1949 | Norlander |
| 2,508,305 | A | 5/1950 | Teetor |
| 2,513,226 | A | 6/1950 | Wylie |
| 2,514,927 | A | 7/1950 | Bernhard |
| 2,520,828 | A | 8/1950 | Bertschi |
| 2,565,624 | A | 8/1951 | Phelon |
| 2,570,625 | A | 10/1951 | Zimmerman et al. |
| 2,690,349 | A | 9/1954 | Teetor |
| 2,694,164 | A | 11/1954 | Geppelt |
| 2,694,613 | A | 11/1954 | Williams |
| 2,701,158 | A | 2/1955 | Schmitt |
| 2,722,617 | A | 11/1955 | Cluwen et al. |
| 2,770,759 | A | 11/1956 | Ahlgren |
| 2,837,366 | A | 6/1958 | Loeb |
| 2,853,331 | A | 9/1958 | Teetor |
| 2,888,291 | A | 5/1959 | Scott et al. |
| 2,896,991 | A | 7/1959 | Martin, Jr. |
| 2,932,545 | A | 4/1960 | Foley |
| 2,935,352 | A | 5/1960 | Heppner |
| 2,935,353 | A | 5/1960 | Loeb |
| 2,936,437 | A | 5/1960 | Fraser et al |
| 2,962,318 | A | 11/1960 | Teetor |
| 3,055,999 | A | 9/1962 | Lucas |
| 3,089,986 | A | 5/1963 | Gauthier |
| 3,102,314 | A | 9/1963 | Alderfer |
| 3,151,902 | A | 10/1964 | Ahlgren |
| 3,204,995 | A | 9/1965 | Teetor |
| 3,208,296 | A | 9/1965 | Baermann |
| 3,238,399 | A | 3/1966 | Johanees et al. |
| 3,273,104 | A | 9/1966 | Krol |
| 3,288,511 | A | 11/1966 | Tavano |
| 3,301,091 | A | 1/1967 | Reese |
| 3,351,368 | A | 11/1967 | Sweet |
| 3,382,386 | A | 5/1968 | Schlaeppi |
| 3,408,104 | A | 10/1968 | Raynes |
| 3,414,309 | A | 12/1968 | Tresemer |
| 3,425,729 | A | 2/1969 | Bisbing |
| 3,468,576 | A | 9/1969 | Beyer et al. |
| 3,474,366 | A | 10/1969 | Barney |
| 3,500,090 | A | 3/1970 | Baermann |
| 3,521,216 | A | 7/1970 | Tolegian |
| 3,645,650 | A | 2/1972 | Laing |
| 3,668,670 | A | 6/1972 | Andersen |
| 3,684,992 | A | 8/1972 | Huguet et al. |
| 3,690,393 | A | 9/1972 | Guy |
| 3,696,258 | A | 10/1972 | Anderson et al. |
| 3,790,197 | A | 2/1974 | Parker |
| 3,791,309 | A | 2/1974 | Baermann |
| 3,802,034 | A | 4/1974 | Bookless |
| 3,803,433 | A | 4/1974 | Ingenito |
| 3,808,577 | A | 4/1974 | Mathauser |
| 3,836,801 | A | 9/1974 | Yamashita et al. |
| 3,845,430 | A | 10/1974 | Petkewicz et al. |
| 3,893,059 | A | 7/1975 | Nowak |
| 3,976,316 | A | 8/1976 | Laby |
| 4,079,558 | A | 3/1978 | Gorham |
| 4,117,431 | A | 9/1978 | Eicher |
| 4,129,846 | A | 12/1978 | Yablochnikov |
| 4,209,905 | A | 7/1980 | Gillings |
| 4,222,489 | A | 9/1980 | Hutter |
| 4,296,394 | A | 10/1981 | Ragheb |
| 4,340,833 | A | 7/1982 | Sudo et al. |
| 4,352,960 | A | 10/1982 | Dormer et al. |
| 4,355,236 | A | 10/1982 | Holsinger |
| 4,399,595 | A | 8/1983 | Yoon et al. |
| 4,416,127 | A | 11/1983 | Gomez-Olea Naveda |
| 4,451,811 | A | 5/1984 | Hoffman |
| 4,453,294 | A | 6/1984 | Morita |
| 4,517,483 | A | 5/1985 | Hucker et al. |
| 4,535,278 | A | 8/1985 | Asakawa |
| 4,547,756 | A | 10/1985 | Miller et al. |
| 4,629,131 | A | 12/1986 | Podell |
| 4,645,283 | A | 2/1987 | MacDonald et al. |
| 4,680,494 | A | 7/1987 | Grosjean |
| 4,764,743 | A | 8/1988 | Leupold et al. |
| 4,808,955 | A | 2/1989 | Godkin et al. |
| 4,837,539 | A | 6/1989 | Baker |
| 4,849,749 | A | 7/1989 | Fukamachi et al. |
| 4,862,128 | A | 8/1989 | Leupold |
| H693 | H | 10/1989 | Leupold |
| 4,893,103 | A | 1/1990 | Leupold |
| 4,912,727 | A | 3/1990 | Schubert |
| 4,941,236 | A | 7/1990 | Sherman et al. |
| 4,956,625 | A | 9/1990 | Cardone et al. |
| 4,980,593 | A | 12/1990 | Edmundson |
| 4,993,950 | A | 2/1991 | Mensor, Jr. |
| 4,994,778 | A | 2/1991 | Leupold |
| 4,996,457 | A | 2/1991 | Hawsey et al. |
| 5,013,949 | A | 5/1991 | Mabe, Jr. |
| 5,020,625 | A | 6/1991 | Yamauchi et al. |
| 5,050,276 | A | 9/1991 | Pemberton |
| 5,062,855 | A | 11/1991 | Rincoe |
| 5,123,843 | A | 6/1992 | Van der Zel et al. |
| 5,179,307 | A | 1/1993 | Porter |
| 5,190,325 | A | 3/1993 | Doss-Desouza |
| 5,213,307 | A | 5/1993 | Perrillat-Amede |
| 5,302,929 | A | 4/1994 | Kovacs |
| 5,309,680 | A | 5/1994 | Kiel |
| 5,345,207 | A | 9/1994 | Gebele |
| 5,349,258 | A | 9/1994 | Leupold et al. |
| 5,367,891 | A | 11/1994 | Furuyama |
| 5,383,049 | A | 1/1995 | Carr |
| 5,394,132 | A | 2/1995 | Poil |
| 5,399,933 | A | 3/1995 | Tsai |
| 5,425,763 | A | 6/1995 | Stemmann |
| 5,440,997 | A | 8/1995 | Crowley |
| 5,461,386 | A | 10/1995 | Knebelkamp |
| 5,485,435 | A | 1/1996 | Matsuda et al. |
| 5,492,572 | A | 2/1996 | Schroeder et al. |
| 5,495,221 | A | 2/1996 | Post |
| 5,512,732 | A | 4/1996 | Yagnik et al. |
| 5,570,084 | A | 10/1996 | Ritter et al. |
| 5,582,522 | A | 12/1996 | Johnson |
| 5,604,960 | A | 2/1997 | Good |
| 5,631,093 | A | 5/1997 | Perry et al. |
| 5,631,618 | A | 5/1997 | Trumper et al. |
| 5,633,555 | A | 5/1997 | Ackermann et al. |
| 5,635,889 | A | 6/1997 | Stelter |
| 5,637,972 | A | 6/1997 | Randall et al. |
| 5,730,155 | A | 3/1998 | Allen |
| 5,742,036 | A | 4/1998 | Schramm, Jr. et al. |
| 5,759,054 | A | 6/1998 | Spadafore |
| 5,788,493 | A | 8/1998 | Tanaka et al. |
| 5,838,304 | A | 11/1998 | Hall |

(56) References Cited

U.S. PATENT DOCUMENTS 5,852,393 A 12/1998 Reznik et al.
5,935,155 A 8/1999 Humayun et al.
5,956,778 A 9/1999 Godoy
5,983,406 A 11/1999 Meyerrose
6,000,484 A 12/1999 Zoretich et al.
6,039,759 A 3/2000 Carpentier et al.
6,047,456 A 4/2000 Yao et al.
6,072,251 A 6/2000 Markle
6,074,420 A 6/2000 Eaton
6,104,108 A 8/2000 Hazelton et al.
6,115,849 A 9/2000 Meyerrose
6,118,271 A 9/2000 Ely et al.
6,120,283 A 9/2000 Cousins
6,125,955 A 10/2000 Zoretich et al.
6,142,779 A 11/2000 Siegel et al.
6,170,131 B1 1/2001 Shin
6,187,041 B1 2/2001 Garonzik
6,188,147 B1 2/2001 Hazelton et al.
6,205,012 B1 3/2001 Lear
6,210,033 B1 4/2001 Karkos, Jr. et al.
6,224,374 B1 5/2001 Mayo
6,234,833 B1 5/2001 Tsai et al.
6,241,069 B1 6/2001 Mazur et al.
6,273,918 B1 8/2001 Yuhasz et al.
6,275,778 B1 8/2001 Shimada et al.
6,285,097 B1 9/2001 Hazelton et al.
6,387,096 B1 5/2002 Hyde, Jr.
6,422,533 B1 7/2002 Harms
6,457,179 B1 10/2002 Prendergast
6,467,326 B1 10/2002 Garrigus
6,535,092 B1 3/2003 Hurley et al.
6,540,515 B1 4/2003 Tanaka
6,599,321 B2 7/2003 Hyde, Jr.
6,607,304 B1 8/2003 Lake et al.
6,652,278 B2 11/2003 Honkura et al.
6,653,919 B2 11/2003 Shih-Chung et al.
6,720,698 B2 4/2004 Galbraith
6,747,537 B1 6/2004 Mosteller
6,841,910 B2 1/2005 Gery
6,842,332 B1 1/2005 Rubenson et al.
6,847,134 B2 1/2005 Frissen et al.
6,850,139 B1 2/2005 Dettmann et al.
6,862,748 B2 3/2005 Prendergast
6,864,773 B2 3/2005 Perrin
6,913,471 B2 7/2005 Smith
6,927,657 B1 8/2005 Wu
6,936,937 B2 8/2005 Tu et al.
6,954,968 B1 10/2005 Sitbon
6,971,147 B2 12/2005 Halstead
7,009,874 B2 3/2006 Deak
7,016,492 B2 3/2006 Pan et al.
7,031,160 B2 4/2006 Tillotson
7,033,400 B2 4/2006 Currier
7,038,565 B1 5/2006 Chell
7,065,860 B2 6/2006 Aoki et al.
7,066,739 B2 6/2006 McLeish
7,066,778 B2 6/2006 Kretzschmar
7,101,374 B2 9/2006 Hyde, Jr.
7,135,792 B2 11/2006 Devaney et al.
7,137,727 B2 11/2006 Joseph et al.
7,186,265 B2 3/2007 Sharkawy et al.
7,224,252 B2 5/2007 Meadow, Jr. et al.
7,264,479 B1 9/2007 Lee
7,276,025 B2 10/2007 Roberts et al.
7,339,790 B2 3/2008 Baker et al.
7,358,724 B2 4/2008 Taylor et al.
7,362,018 B1 4/2008 Kulogo et al.
7,381,181 B2 6/2008 Lau et al.
7,402,175 B2 7/2008 Azar
7,438,726 B2 10/2008 Erb
7,444,683 B2 11/2008 Prendergast et al.
7,453,341 B1 11/2008 Hildenbrand
7,498,914 B2 3/2009 Miyashita et al.
7,583,500 B2 9/2009 Ligtenberg et al.
7,715,890 B2 5/2010 Kim et al.
7,775,567 B2 8/2010 Ligtenberg et al.
7,796,002 B2 9/2010 Hashimoto et al.
7,799,281 B2 9/2010 Cook et al.
7,808,349 B2 10/2010 Fullerton et al.
7,812,697 B2 10/2010 Fullerton et al.
7,817,004 B2 10/2010 Fullerton et al.
7,832,897 B2 11/2010 Ku
7,837,032 B2 11/2010 Smeltzer
7,839,246 B2 11/2010 Fullerton et al.
7,843,297 B2 11/2010 Fullerton et al.
7,868,721 B2 1/2011 Fullerton et al.
7,874,856 B1 1/2011 Schriefer et al.
7,889,037 B2 2/2011 Cho
7,903,397 B2 3/2011 McCoy
7,905,626 B2 3/2011 Shantha et al.
8,002,585 B2 8/2011 Zhou
8,009,001 B1 8/2011 Cleveland
8,099,964 B2 1/2012 Saito et al.
8,264,314 B2 9/2012 Sankar
8,354,767 B2 1/2013 Pennander et al.
2002/0125977 A1 9/2002 VanZoest
2003/0136837 A1 7/2003 Amon et al.
2003/0170976 A1 9/2003 Molla et al.
2003/0179880 A1 9/2003 Pan et al.
2003/0187510 A1 10/2003 Hyde
2004/0003487 A1 1/2004 Reiter
2004/0155748 A1 8/2004 Steingroever
2004/0244636 A1 12/2004 Meadow et al.
2004/0251759 A1 12/2004 Hirzel
2005/0102802 A1 5/2005 Sitbon et al.
2005/0196484 A1 9/2005 Khoshnevis
2005/0231046 A1 10/2005 Aoshima
2005/0240263 A1 10/2005 Fogarty et al.
2005/0263549 A1 12/2005 Scheiner
2005/0283839 A1 12/2005 Cowburn
2006/0066428 A1 3/2006 McCarthy et al.
2006/0189259 A1 8/2006 Park et al.
2006/0198047 A1 9/2006 Xue et al.
2006/0198998 A1 9/2006 Raksha et al.
2006/0214756 A1 9/2006 Elliott et al.
2006/0290451 A1 12/2006 Prendergast et al.
2006/0293762 A1 12/2006 Schulman et al.
2007/0072476 A1 3/2007 Milan
2007/0075594 A1 4/2007 Sadler
2007/0103266 A1 5/2007 Wang et al.
2007/0138806 A1 6/2007 Ligtenberg et al.
2007/0255400 A1 11/2007 Parravicini et al.
2007/0267929 A1 11/2007 Pulnikov et al.
2008/0119250 A1 5/2008 Cho et al.
2008/0139261 A1 6/2008 Cho et al.
2008/0174392 A1 7/2008 Cho
2008/0181804 A1 7/2008 Tanigawa et al.
2008/0186683 A1 8/2008 Ligtenberg et al.
2008/0218299 A1 9/2008 Arnold
2008/0224806 A1 9/2008 Ogden et al.
2008/0272868 A1 11/2008 Prendergast et al.
2008/0282517 A1 11/2008 Claro
2009/0021333 A1 1/2009 Fiedler
2009/0209173 A1 8/2009 Arledge et al.
2009/0250576 A1 10/2009 Fullerton et al.
2009/0251256 A1 10/2009 Fullerton et al.
2009/0254196 A1 10/2009 Cox et al.
2009/0278642 A1 11/2009 Fullerton et al.
2009/0289090 A1 11/2009 Fullerton et al.
2009/0289749 A1 11/2009 Fullerton et al.
2009/0292371 A1 11/2009 Fullerton et al.
2010/0033280 A1 2/2010 Bird et al.
2010/0126857 A1 5/2010 Polwart et al.
2010/0167576 A1 7/2010 Zhou
2011/0026203 A1 2/2011 Ligtenberg et al.
2011/0085157 A1 4/2011 Bloss et al.
2011/0101088 A1 5/2011 Marguerettaz et al.
2011/0210636 A1 9/2011 Kuhlmann-Wilsdorf
2011/0234344 A1 9/2011 Fullerton et al.
2011/0248806 A1 10/2011 Michael
2011/0279206 A1 11/2011 Fullerton et al.
2012/0064309 A1 3/2012 Kwon et al.
2012/0235519 A1 9/2012 Dyer et al.

(56) References Cited

U.S. PATENT DOCUMENTS

FOREIGN PATENT DOCUMENTS

| | | | |
|---|---|---|---|
| EP | 0 345 554 | A1 | 12/1989 |
| EP | 0 545 737 | A1 | 6/1993 |
| FR | 823395 | A | 1/1938 |
| GB | 1 495 677 | A | 12/1977 |
| JP | S57-55908 | U | 4/1982 |
| JP | S57-189423 | U | 12/1982 |
| JP | 60-091011 | U | 6/1985 |
| JP | 60-221238 | A | 11/1985 |
| JP | 64-30444 | A | 2/1989 |
| JP | 2001-328483 | A | 11/2001 |
| JP | 2008035676 | A | 2/2008 |
| JP | 2008165974 | A | 7/2008 |
| JP | 05-038123 | B2 | 10/2012 |
| WO | WO-02/31945 | A2 | 4/2002 |
| WO | WO-2007/081830 | A2 | 7/2007 |
| WO | WO-2009/124030 | A1 | 10/2009 |
| WO | WO-2010/141324 | A1 | 12/2010 |

OTHER PUBLICATIONS

Atallah, K., Howe, D. 2001, "A Novel High-Performance Magnetic Gear", IEEE Transactions on Magnetics, vol. 37, No. 4, Jul. 2001, p. 2844-46.

Bassani, R., 2007, "Dynamic Stability of Passive Magnetic Bearings", Nonlinear Dynamics, V. 50, p. 161-68.

BNS 33 Range, Magnetic safety sensors, Rectangular design, http://www.farnell.com/datasheets/36449.pdf, 3 pages, date unknown.

Boston Gear 221S-4, One-stage Helical Gearbox, http://www.bostongear.com/pdf/product_sections/200_series_helical.pdf, referenced Jun. 2010.

Charpentier et al., 2001, "Mechanical Behavior of Axially Magnetized Permanent-Magnet Gears", IEEE Transactions on Magnetics, vol. 37, No. 3, May 2001, p. 1110-17.

Chau et al., 2008, "Transient Analysis of Coaxial Magnetic Gears Using Finite Element Comodeling", Journal of Applied Physics, vol. 103.

Choi et al., 2010, "Optimization of Magnetization Directions in a 3-D Magnetic Structure", IEEE Transactions on Magnetics, vol. 46, No. 6, Jun. 2010, p. 1603-06.

Correlated Magnetics Research, 2009, Online Video, "Innovative Magnetics Research in Huntsville", http://www.youtube.com/watch?v=m4m81JjZCJo.

Correlated Magnetics Research, 2009, Online Video, "Non-Contact Attachment Utilizing Permanent Magnets", http://www.youtube.com/watch?v=3xUm25CNNgQ.

Correlated Magnetics Research, 2010, Company Website, http://www.correlatedmagnetics.com.

Furlani 1996, "Analysis and optimization of synchronous magnetic couplings", J. Appl. Phys., vol. 79, No. 8, p. 4692.

Furlani 2001, "Permanent Magnet and Electromechanical Devices", Academic Press, San Diego.

Furlani, E.P., 2000, "Analytical analysis of magnetically coupled multipole cylinders", J. Phys. D: Appl. Phys., vol. 33, No. 1, p. 28-33.

General Electric DP 2.7 Wind Turbine Gearbox, http://www.gedrivetrain.com/insideDP27.cfm, referenced Jun. 2010.

Ha et al., 2002, "Design and Characteristic Analysis of Non-Contact Magnet Gear for Conveyor by Using Permanent Magnet", Conf. Record of the 2002 IEEE Industry Applications Conference, p. 1922-27.

Huang et al., 2008, "Development of a Magnetic Planetary Gearbox", IEEE Transactions on Magnetics, vol. 44, No. 3, p. 403-12.

International Search Report and Written Opinion dated Jun. 1, 2009, directed to counterpart application No. PCT/US2009/002027. (10 pages).

International Search Report and Written Opinion of the International Searching Authority issued in Application No. PCT/US12/61938 dated Feb. 26, 2013.

International Search Report and Written Opinion of the International Searching Authority issued in Application No. PCT/US2013/028095 dated May 13, 2013.

International Search Report and Written Opinion of the International Searching Authority issued in Application No. PCT/US2013/047986 dated Nov. 21, 2013.

International Search Report and Written Opinion, dated Apr. 8, 2011 issued in related International Application No. PCT/US2010/049410.

International Search Report and Written Opinion, dated Aug. 18, 2010, issued in related International Application No. PCT/US2010/036443.

International Search Report and Written Opinion, dated Jul. 13, 2010, issued in related International Application No. PCT/US2010/021612.

International Search Report and Written Opinion, dated May 14, 2009, issued in related International Application No. PCT/US2009/038925.

Jian et al., "Comparison of Coaxial Magnetic Gears With Different Topologies", IEEE Transactions on Magnetics, vol. 45, No. 10, Oct. 2009, p. 4526-29.

Jian, L., Chau, K.T., 2010, "A Coaxial Magnetic Gear With Halbach Permanent-Magnet Arrays", IEEE Transactions on Energy Conversion, vol. 25, No. 2, Jun. 2010, p. 319-28.

Jørgensen et al., "The Cycloid Permanent Magnetic Gear", IEEE Transactions on Industry Applications, vol. 44, No. 6, Nov./Dec. 2008, p. 1659-1665.

Jørgensen et al., 2005, "Two dimensional model of a permanent magnet spur gear", Conf. Record of the 2005 IEEE Industry Applications Conference, p. 261-65.

Kim, "A future cost trends of magnetizer systems in Korea", Industrial Electronics, Control, and Instrumentation, 1996, vol. 2, Aug. 5, 1996, pp. 991-996.

Krasil'nikov et al., 2008, "Calculation of the Shear Force of Highly Coercive Permanent Magnets in Magnetic Systems With Consideration of Affiliation to a Certain Group Based on Residual Induction", Chemical and Petroleum Engineering, vol. 44, Nos. 7-8, p. 362-65.

Krasil'nikov et al., 2009, "Torque Determination for a Cylindrical Magnetic Clutch", Russian Engineering Research, vol. 29, No. 6, pp. 544-547.

Liu et al., 2009, "Design and Analysis of Interior-magnet Outer-rotor Concentric Magnetic Gears", Journal of Applied Physics, vol. 105.

Lorimer, W., Hartman, A., 1997, "Magnetization Pattern for Increased Coupling in Magnetic Clutches", IEEE Transactions on Magnetics, vol. 33, No. 5, Sep. 1997.

Mezani, S., Atallah, K., Howe, D. , 2006, "A high-performance axial-field magnetic gear", Journal of Applied Physics vol. 99.

Mi, "Magnetreater/Charger Model 580" Magnetic Instruments Inc. Product specification, May 4, 2009, http://web.archive.org/web/20090504064511/http://www.maginst.com/specifications/580_magnetreater.htm, 2 pages.

Neugart PLE-160, One-Stage Planetary Gearbox, http://www.neugartusa.com/ple_160_gb.pdf, referenced Jun. 2010.

Series BNS, Compatible Series AES Safety Controllers, http://www.schmersalusa.com/safety_controllers/drawings/aes.pdf, pp. 159-175, date unknown.

Series BNS-B20, Coded-Magnet Sensorr Safety Door Handle, http://www.schmersalusa.com/catalog_pdfs/BNS_B20.pdf, 2pages, date unknown.

Series BNS333, Coded-Magnet Sensors with Integral Safety Control Module, http://www.schmersalusa.com/machine_guarding/coded_magnet/drawings/bns333.pdf, 2 pages, date unknown.

Tsurumoto 1992, "Basic Analysis on Transmitted Force of Magnetic Gear Using Permanent Magnet", IEEE Translation Journal on Magnetics in Japan, Vo 7, No. 6, Jun. 1992, p. 447-52.

United States Office Action issued in U.S. Appl. No. 13/104,393 dated Apr. 4, 2013.

United States Office Action issued in U.S. Appl. No. 13/236,413 dated Jun. 6, 2013.

United States Office Action issued in U.S. Appl. No. 13/246,584 dated May 16, 2013.

United States Office Action issued in U.S. Appl. No. 13/246,584 dated Oct. 15, 2013.

(56) References Cited

OTHER PUBLICATIONS

United States Office Action issued in U.S. Appl. No. 13/374,074 dated Feb. 21, 2013.
United States Office Action issued in U.S. Appl. No. 13/430,219 dated Aug. 13, 2013.
United States Office Action issued in U.S. Appl. No. 13/470,994 dated Aug. 8, 2013.
United States Office Action issued in U.S. Appl. No. 13/470,994 dated Jan. 7, 2013.
United States Office Action issued in U.S. Appl. No. 13/470,994 dated Nov. 8, 2013.
United States Office Action issued in U.S. Appl. No. 13/529,520 dated Sep. 28,2012.
United States Office Action issued in U.S. Appl. No. 13/530,893 dated Mar. 22, 2013.
United States Office Action issued in U.S. Appl. No. 13/530,893 dated Oct. 29, 2013.
United States Office Action issued in U.S. Appl. No. 13/718,839 dated Dec. 16, 2013.
United States Office Action issued in U.S. Appl. No. 13/855,519 dated Jul. 17, 2013.
United States Office Action issued in U.S. Appl. No. 13/928,126 dated Oct. 11, 2013.
United States Office Action, dated Aug. 26, 2011, issued in counterpart U.S. Appl. No. 12/206,270.
United States Office Action, dated Feb. 2, 2011, issued in counterpart U.S. Appl. No. 12/476,952.
United States Office Action, dated Mar. 12, 2012, issued in counterpart U.S. Appl. No. 12/206,270.
United States Office Action, dated Mar. 9, 2012, issued in counterpart U.S. Appl. No. 13/371,280.
United States Office Action, dated Oct. 12, 2011, issued in counterpart U.S. Appl. No. 12/476,952.
Wikipedia, "Barker Code", Web article, last modified Aug. 2, 2008, 2 pages.
Wikipedia, "Bitter Electromagnet", Web article, last modified Aug. 2011, 1 page.
Wikipedia, "Costas Array", Web article, last modified Oct. 7, 2008, 4 pages.
Wikipedia, "Gold Code", Web article, last modified Jul. 27, 2008, 1 page.
Wikipedia, "Golomb Ruler", Web article, last modified Nov. 4, 2008, 3 pages.
Wikipedia, "Kasami Code", Web article, last modified Jun. 11, 2008, 1 page.
Wikipedia, "Linear feedback shift register", Web article, last modified Nov. 11, 2008, 6 pages.
Wikipedia, "Walsh Code", Web article, last modified Sep. 17, 2008, 2 pages.
V. Rudnev, An Objective Assesment of Magnetic Flux Concentrators, HET Trating Progress, Nov./Dec. 2004, p. 19-23.

(Top View)

(Top View)

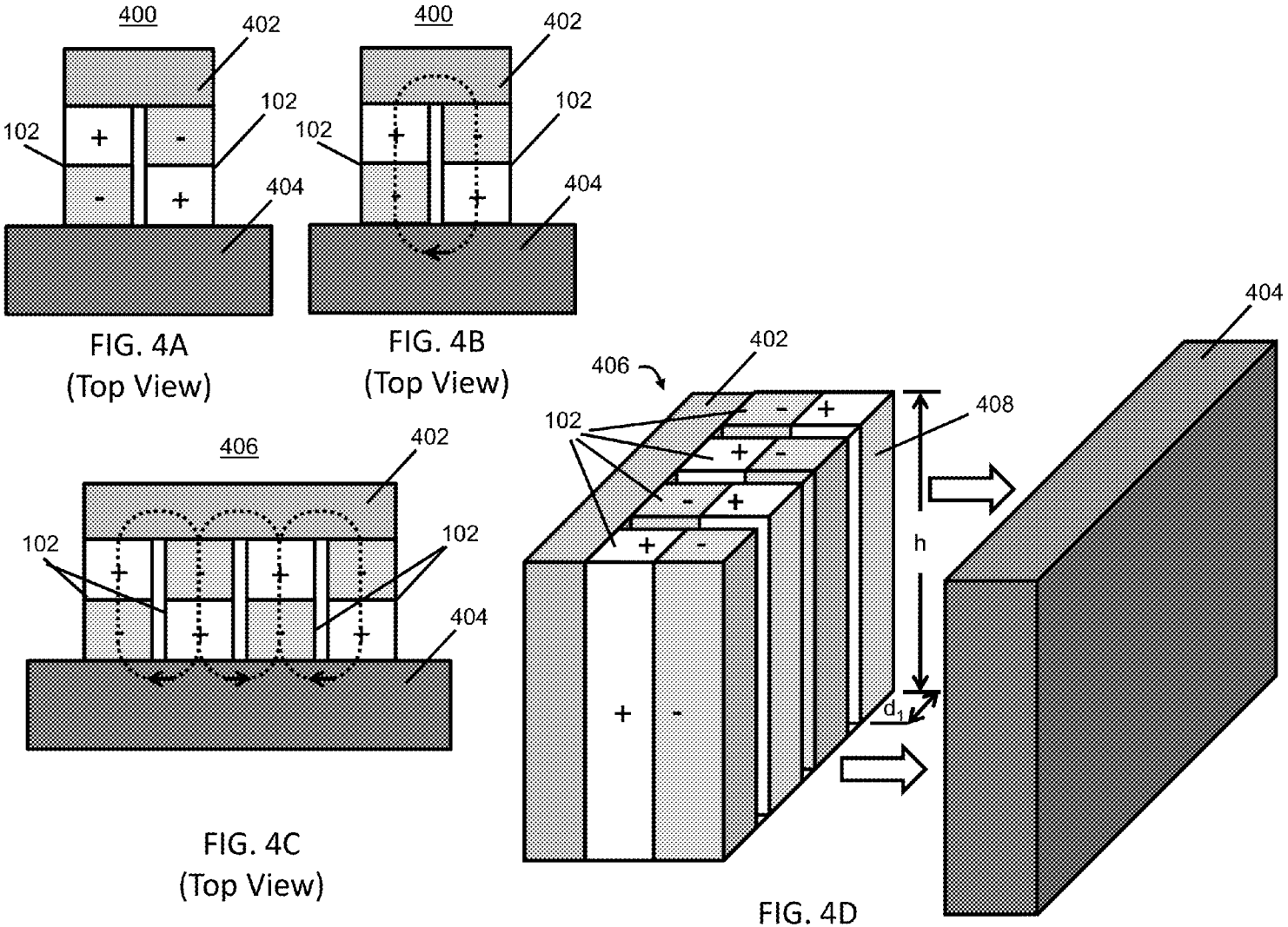
400
402
102
404
+
-
400
402
102
404
+
+
406
402
102
404
+
+
+

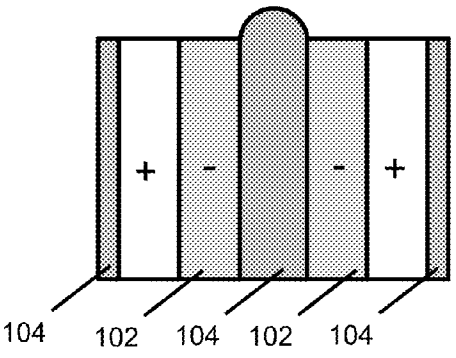
FIG. 9A
(SIDE VIEW)
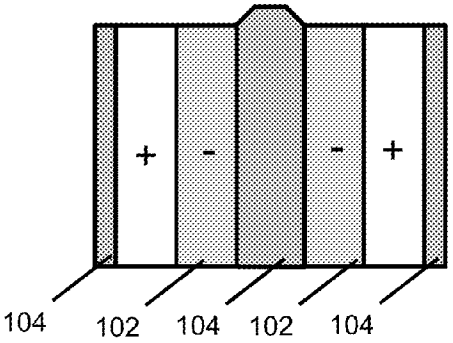
FIG. 9B
(SIDE VIEW)
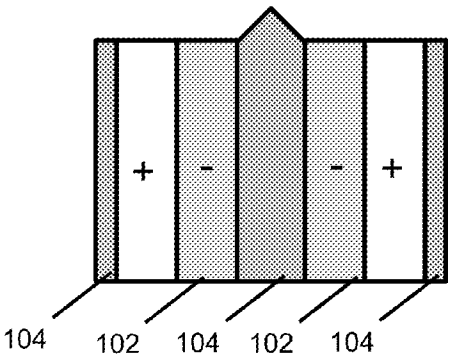
FIG. 9C
(SIDE VIEW)
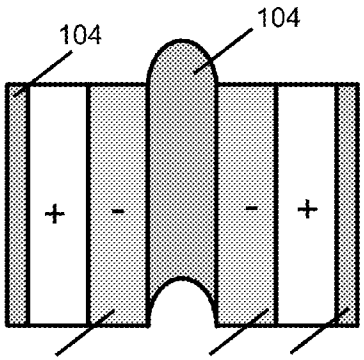
FIG. 9D
(SIDE VIEW)
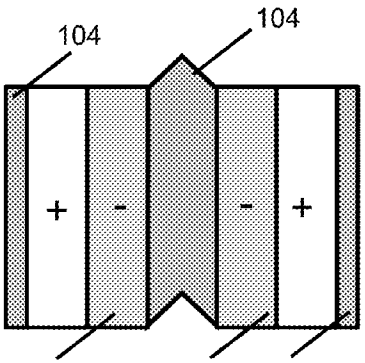
FIG. 9E
(SIDE VIEW)
FIG. 9F
(SIDE VIEW)
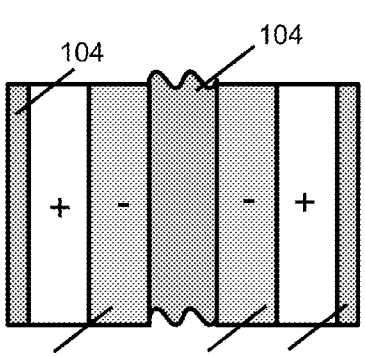
FIG. 9G
(SIDE VIEW)

Complementary Barker-4 coded flux concentrators. When either is turned upside down and placed on top of the other concentrator, the two concentrators will achieve a peak attract force when coded pole pieces align.

Two-dimensional coding possible if gaps between one-dimensional structures. Here we have Barker 4 code by Barker 4 code.

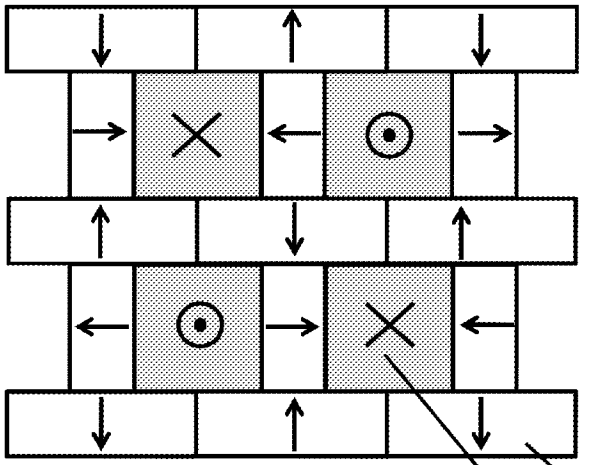
FIG. 19J (Half off)
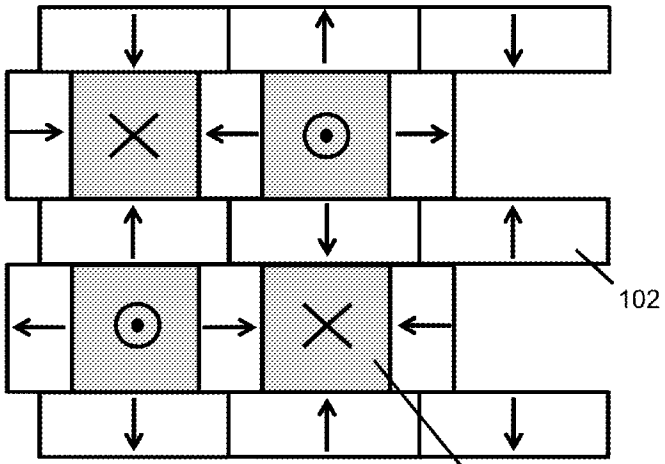
FIG. 19I (On)
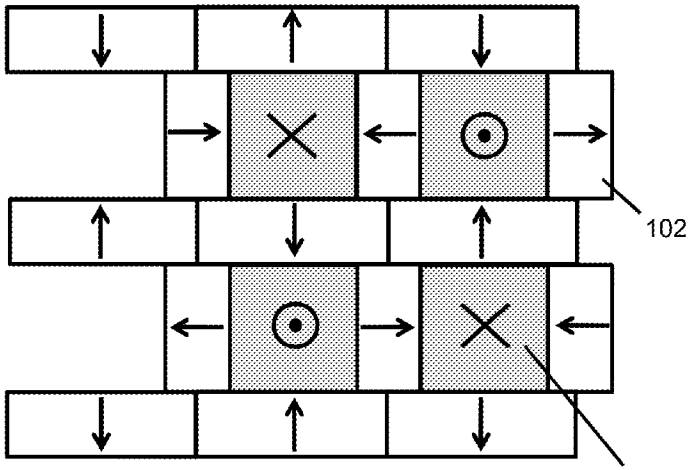
FIG. 19K (Off)

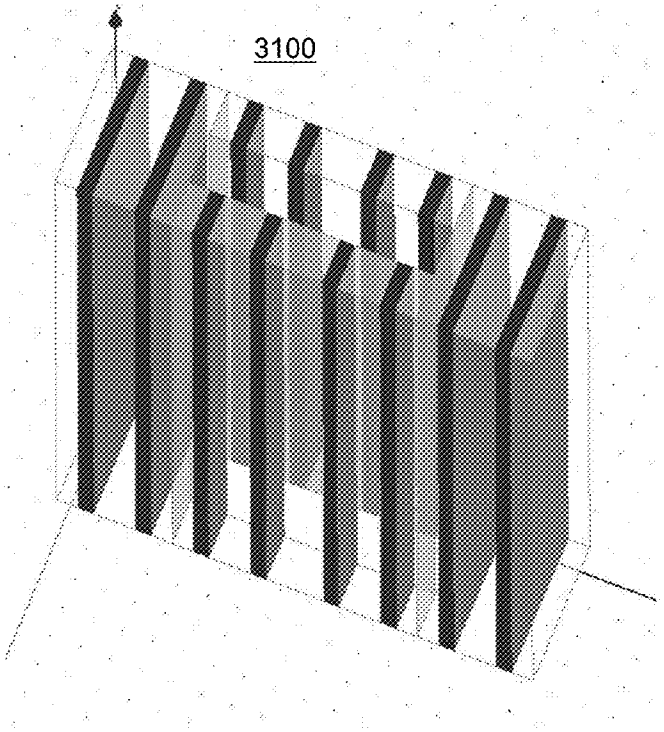
FIG. 31C
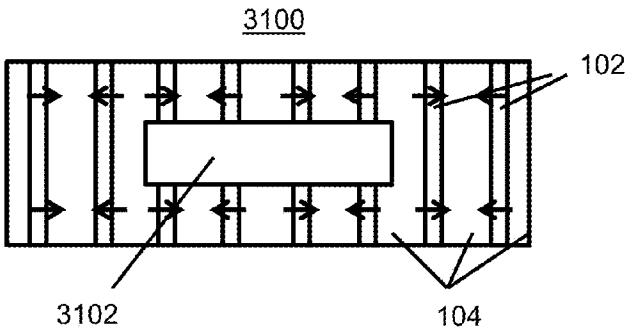
FIG. 31A (Top View)
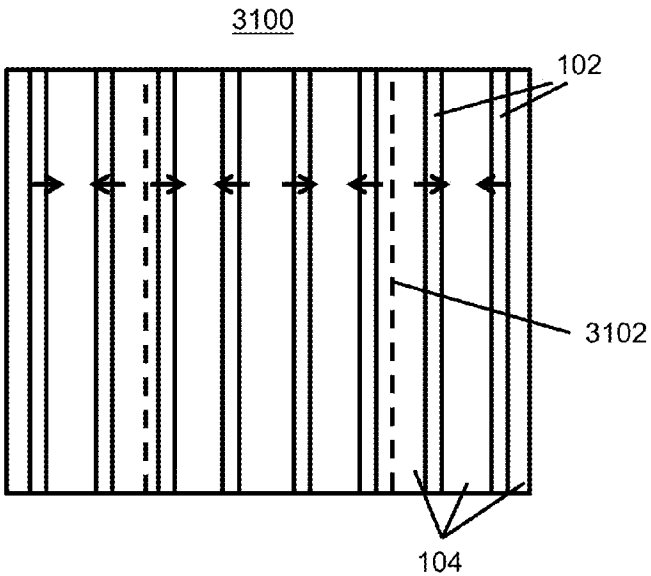
FIG. 31B (Side View)

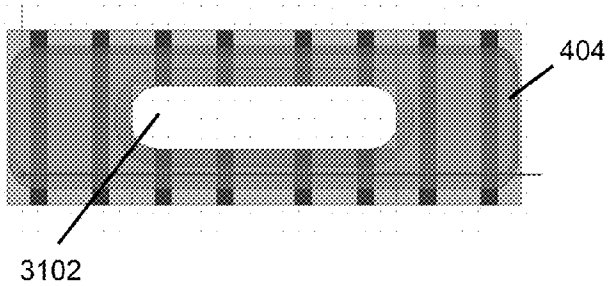
FIG. 31D (Top View)
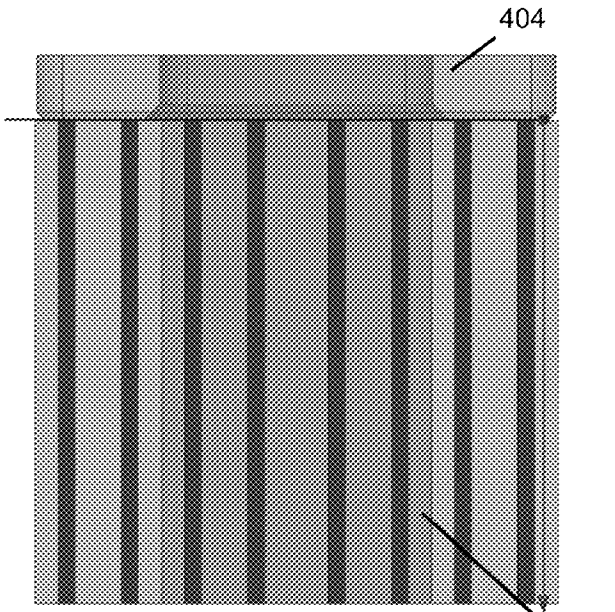
FIG. 31E (Side View)
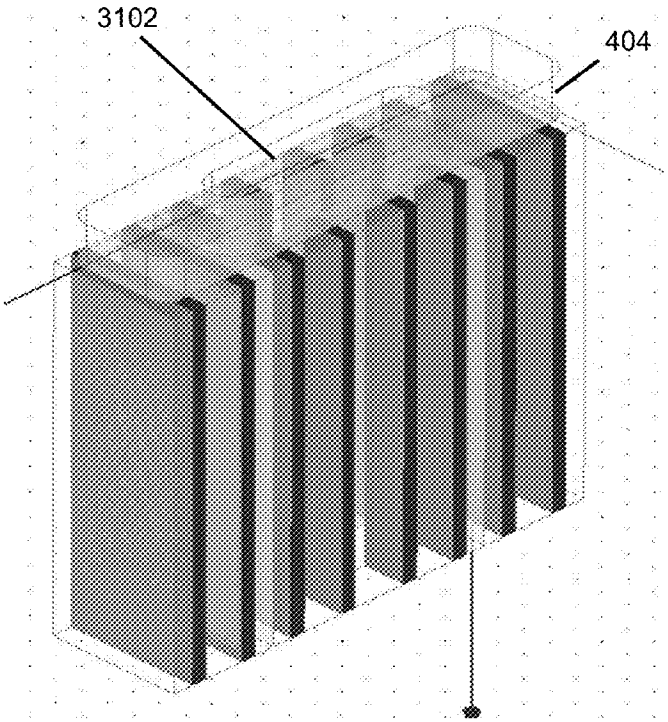
FIG. 31F

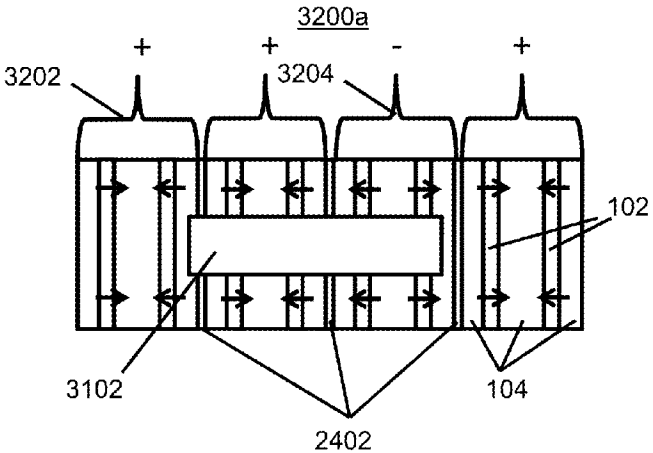
FIG. 32A (Top View)
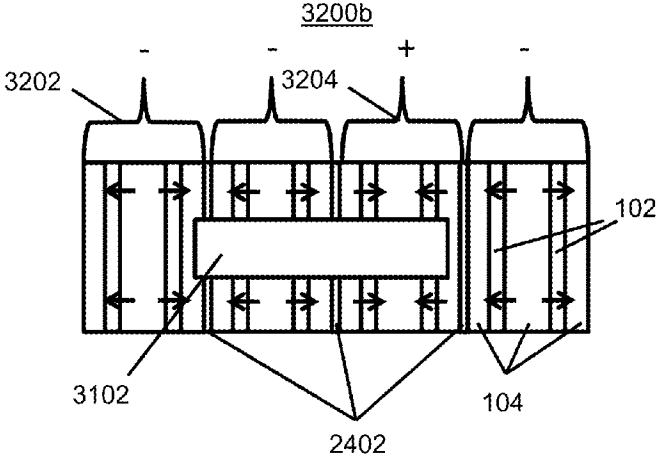
FIG. 32B (Top View)
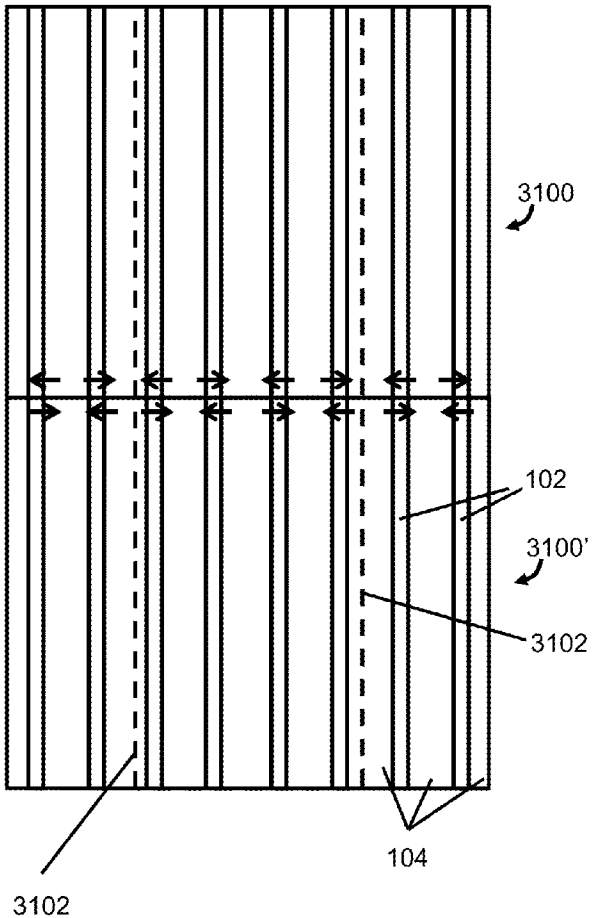
FIG. 31G (Side View)

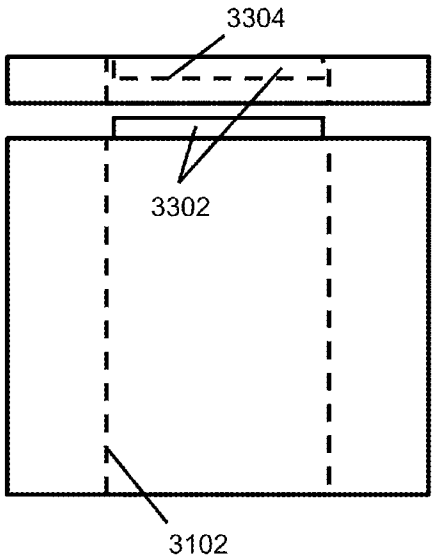
FIG. 33A (Side View)
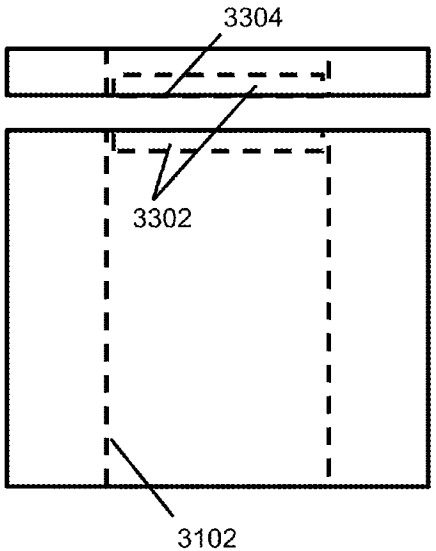
FIG. 33B (Side View)
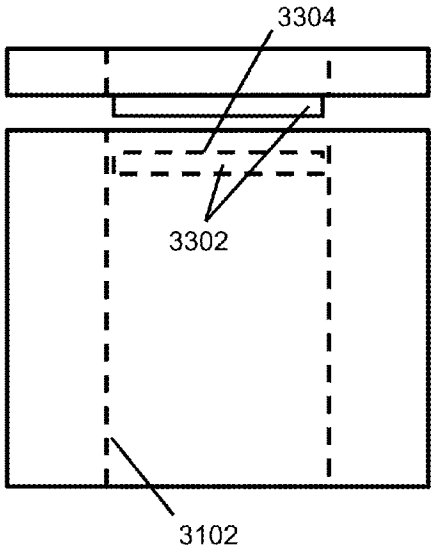
FIG. 33C (Side View)
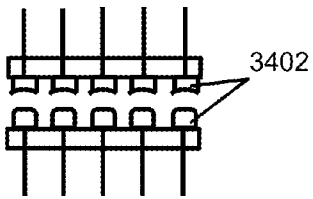
FIG. 34A
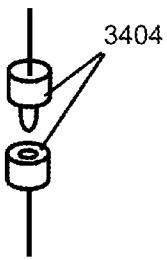
FIG. 34B

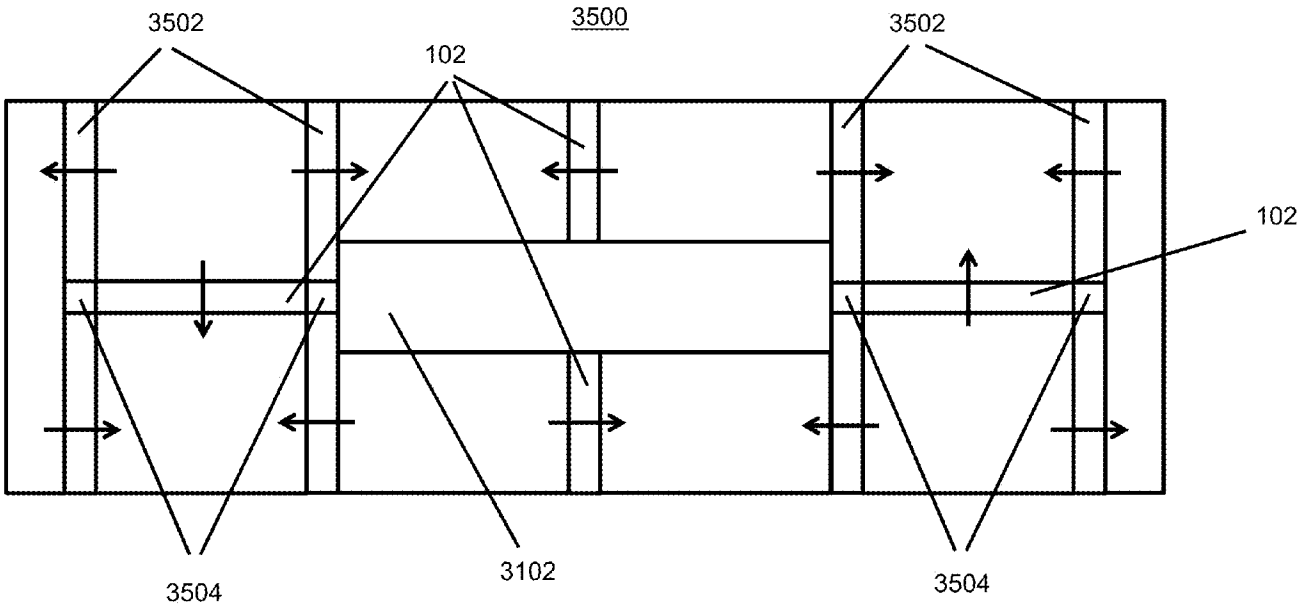
FIG. 35A
(Top View)
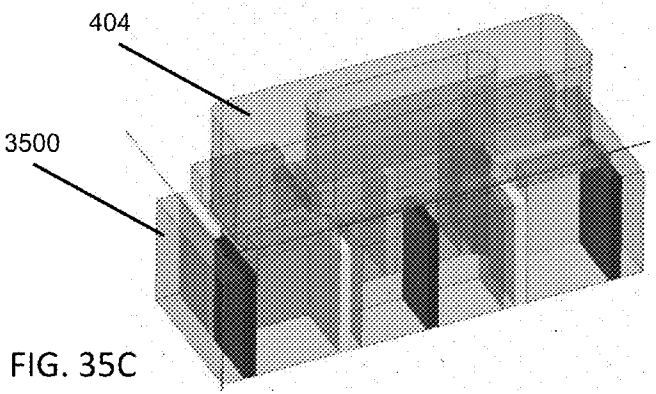
FIG. 35C
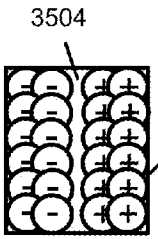
FIG. 35B (Side View)

SYSTEM FOR CONCENTRATING MAGNETIC FLUX

RELATED APPLICATIONS

This non-provisional application claims the benefit under 35 USC 119(e) of provisional application 61/854,333, titled "System for Concentrating Flux of a Multi-pole Magnetic Structure", filed Apr. 22, 2013, by Fullerton et al. This non-provisional application is a continuation-in-part of non-provisional application Ser. No. 14/103,699, titled "System for Concentrating Flux of a Multi-pole Magnetic Structure", filed Dec. 11, 2013, by Fullerton et al., which claims the benefit under 35 USC 119(e) of provisional application 61/735,403, titled "System for Concentrating Magnetic Flux of a Multi-pole Magnetic Structure", filed Dec. 12, 2012 by Fullerton et al. and this application claims the benefit under 35 USC 119(e) of provisional application 61/852,431, titled "System for Concentrating Magnetic Flux of a Multi-pole Magnetic Structure", filed Mar. 15, 2013 by Fullerton et al.

FIELD OF THE INVENTION

The present invention relates generally to a system for concentrating magnetic flux of a multi-pole magnetic structure. More particularly, the present invention relates to a system for concentrating magnetic flux of a multi-pole magnetic structure using pole pieces having a magnet-to-pole piece interface with a first area and a pole piece-to-target interface with a second area substantially smaller than the first area, where the target can be a ferromagnetic material or complementary pole pieces.

SUMMARY OF THE INVENTION

One embodiment of the invention includes a lateral magnet assembly including a multi-pole magnetic structure made up of one or more pieces of a magnetizable material having a plurality of polarity regions for providing a magnetic flux, the magnetizable material having a first saturation flux density, the plurality of polarity regions being magnetized in a plurality of magnetization directions, and a plurality of pole pieces of a ferromagnetic material for integrating the magnetic flux across the plurality of polarity regions and directing the magnetic flux at right angles to one of a target or a complementary lateral magnet assembly, the ferromagnetic material having a second saturation flux density, each pole piece of the plurality of pole pieces having a magnet-to-pole piece interface with a corresponding polarity region and a pole piece-to-target interface with the one of the target or the complementary lateral magnet assembly, and having an amount of the ferromagnetic material sufficient to achieve the second saturation flux density at the pole piece-to-target interface when in a closed magnetic circuit, the magnet-to-pole piece interface having a first area, the pole piece-to-target interface having a second area, the magnetic flux being routed into the pole piece via the magnet-to-pole interface and out of the pole piece via the pole piece-to-target interface, the routing of said magnetic flux through said pole piece resulting in an amount of concentration of the magnetic flux at the pole piece-to-target interface corresponding to the ratio of the first area divided by the second area, the amount of concentration of the magnetic flux corresponding to a maximum force density.

The polarity regions can be separate magnets.

The polarity regions can have a substantially uniformly alternating polarity pattern.

The polarity regions can have a polarity pattern in accordance with a code having a code length greater than 2.

The code can be a Barker code.

The polarity regions can be magnetic regions printed on a single piece of magnetizable material.

The printed magnetic regions can be separated by non-magnetized regions.

The printed magnetic regions can be stripes, where the stripes can be groups of printed maxels.

The lateral magnet assembly may include a shunt plate for producing a magnetic flux circuit between at least two polarity regions of said plurality of polarity regions.

Each of the plurality of polarity regions can have one of a first magnetization direction or a second magnetization direction that is opposite to the first magnetization direction.

Each of the plurality of polarity regions can have one of a first magnetization direction, a second magnetization direction that is opposite to the first magnetization direction, a third magnetization direction that is perpendicular to the first magnetization direction, or a fourth magnetization direction that is opposite to the third magnetization direction.

A thickness of the one or more pieces of magnetizable material can be sufficient to just provide the magnetic flux having the first flux density at the magnet-to-pole interface as required to achieve the maximum force density at the pole piece-to-target interface.

The length of at least one pole piece of the plurality of pole pieces can be substantially equal to a length of at least one polarity region of the plurality of polarity regions.

The length of at least one pole piece of the plurality of pole pieces can be a different length of at least one polarity region of the plurality of polarity regions.

At least one pole piece of the plurality of pole pieces and the target can have a male-female type interface.

The lateral magnet assembly and the one of the target or the complementary lateral magnet assembly can form a connector that can be one of an electrical connector assembly, an optical connector assembly, or a hydraulics connector assembly.

The lateral magnet assembly can be a cyclic lateral magnet assembly.

The lateral magnet assembly can include an axle.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

FIG. 4A depicts an exemplary magnetic structure comprising two spaced magnets having an opposite (or alternating)

polarity relationship attached by a shunt plate and attached to a target such as a piece of iron.

FIG. 4B depicts an exemplary magnetic flux circuit created by the shunt plate and the target.

FIG. 4C depicts an exemplary magnetic structure comprising four magnets having an alternating polarity relationship having a shunt plate and attached to a target.

FIG. 4D depicts an oblique projection of the magnetic structure of FIG. 4C approaching the target.

Figure 5B:
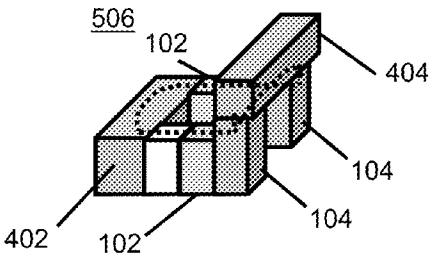
Figure 5C:
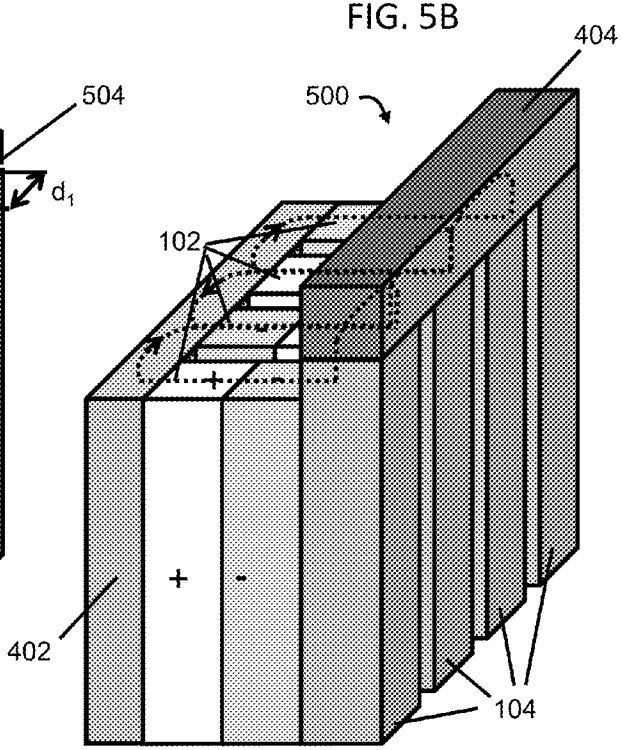
Figure 5A:
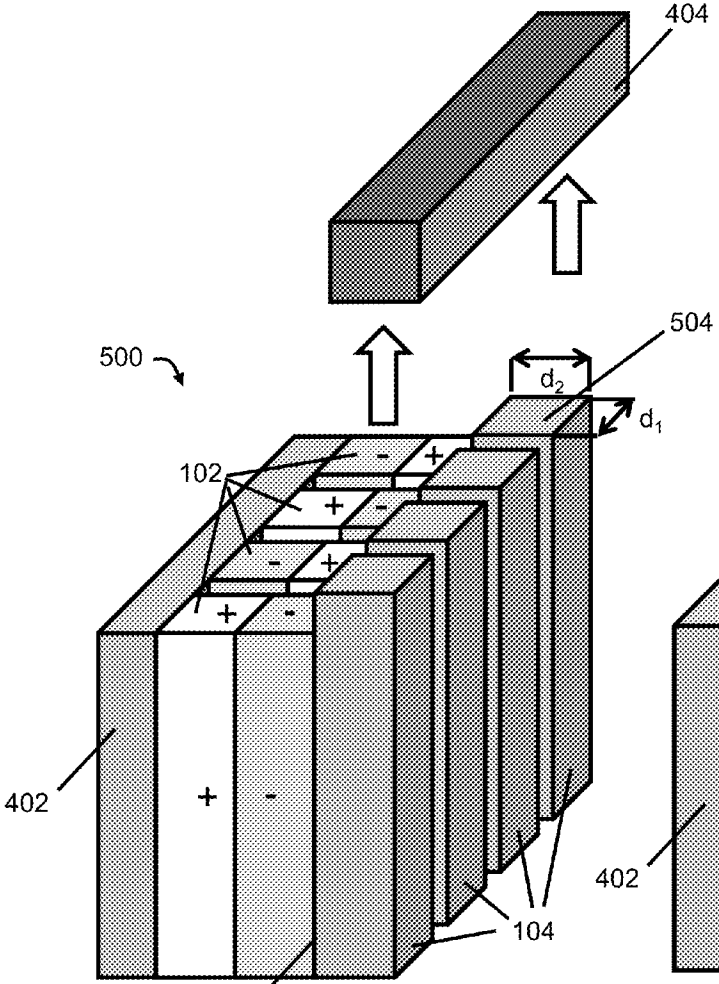

FIG. 5A depicts an exemplary flux concentrator device in accordance with one embodiment of the present invention.

FIG. 5B depicts an exemplary magnetic flux circuit produced using a shunt plate and one side of the magnets and a target that spans two pole pieces on the opposite side of the magnets.

FIG. 5C depicts three exemplary magnetic flux circuits produced by the exemplary flux concentrator device of FIG. 5A and a target.

Figures 6A, 6B, 6C, 6D:
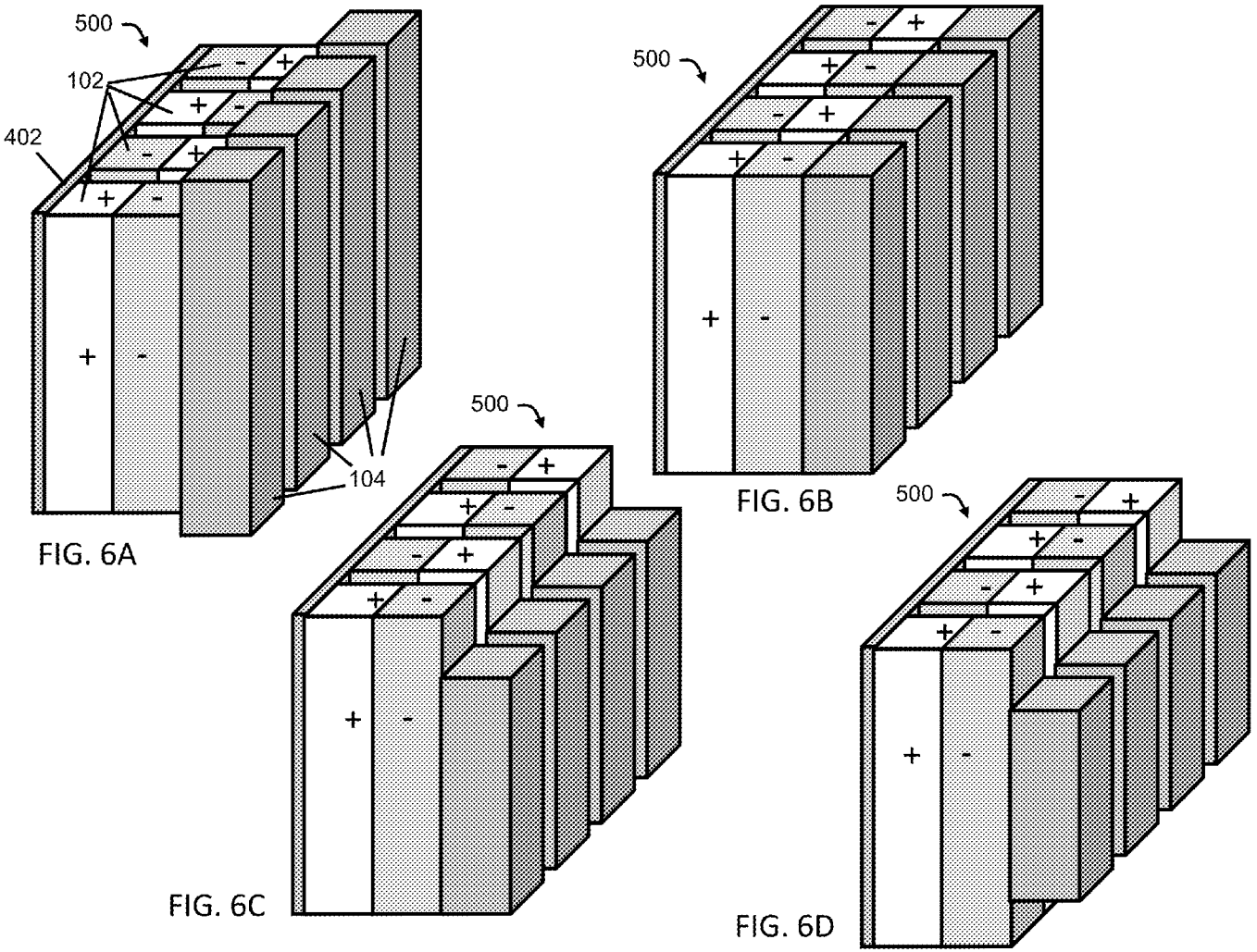

FIG. 6A shows an exemplary flux concentrator device similar to the device of FIG. 5A except the pole pieces extend both above and below the magnetic structure.

FIG. 6B shows an exemplary flux concentrator device similar to the device of FIG. 5A except the pole pieces are the full length of the magnets making of the magnetic structure and do not extend above or below the magnetic structure.

FIG. 6C shows an exemplary flux concentrator device similar to the device of FIG. 5A except the pole pieces are shorter than the magnets of the magnetic structure where the pole pieces are configured to accept targets at the top of the device.

FIG. 6D shows an exemplary flux concentrator device similar to the device of FIG. 5A except the pole pieces are shorter than the magnets of the magnetic structure where the pole pieces are configured to accept targets at the top and bottom of the device.

Figure 6E:
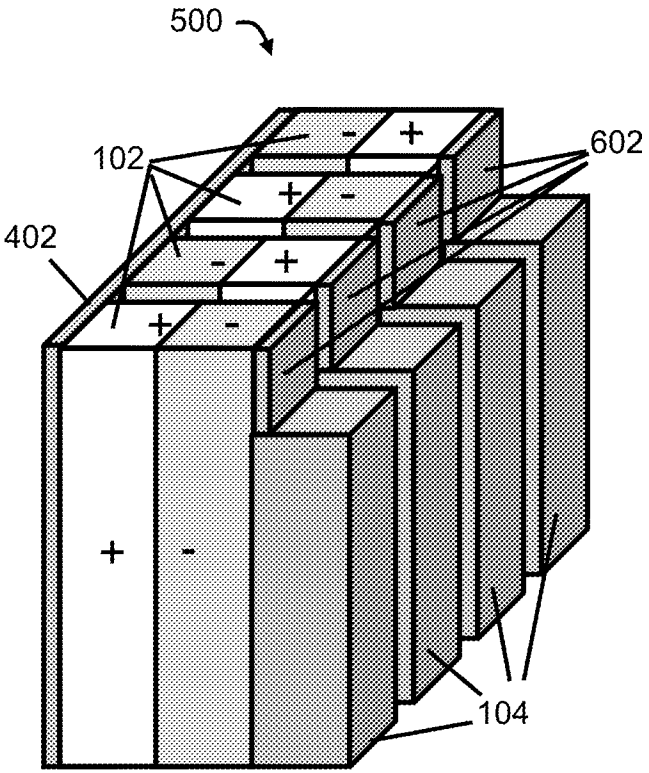

FIG. 6E depicts additional pole pieces having been added to the upper portions of the magnets in the device of FIG. 6C in order to provide protection to the surfaces of the magnets.

FIGS. 7A-7E depict various exemplary flux concentrator devices having pole pieces on both sides of the magnetic structures.

Figures 7A, 7B, 7C, 7D, 7E:
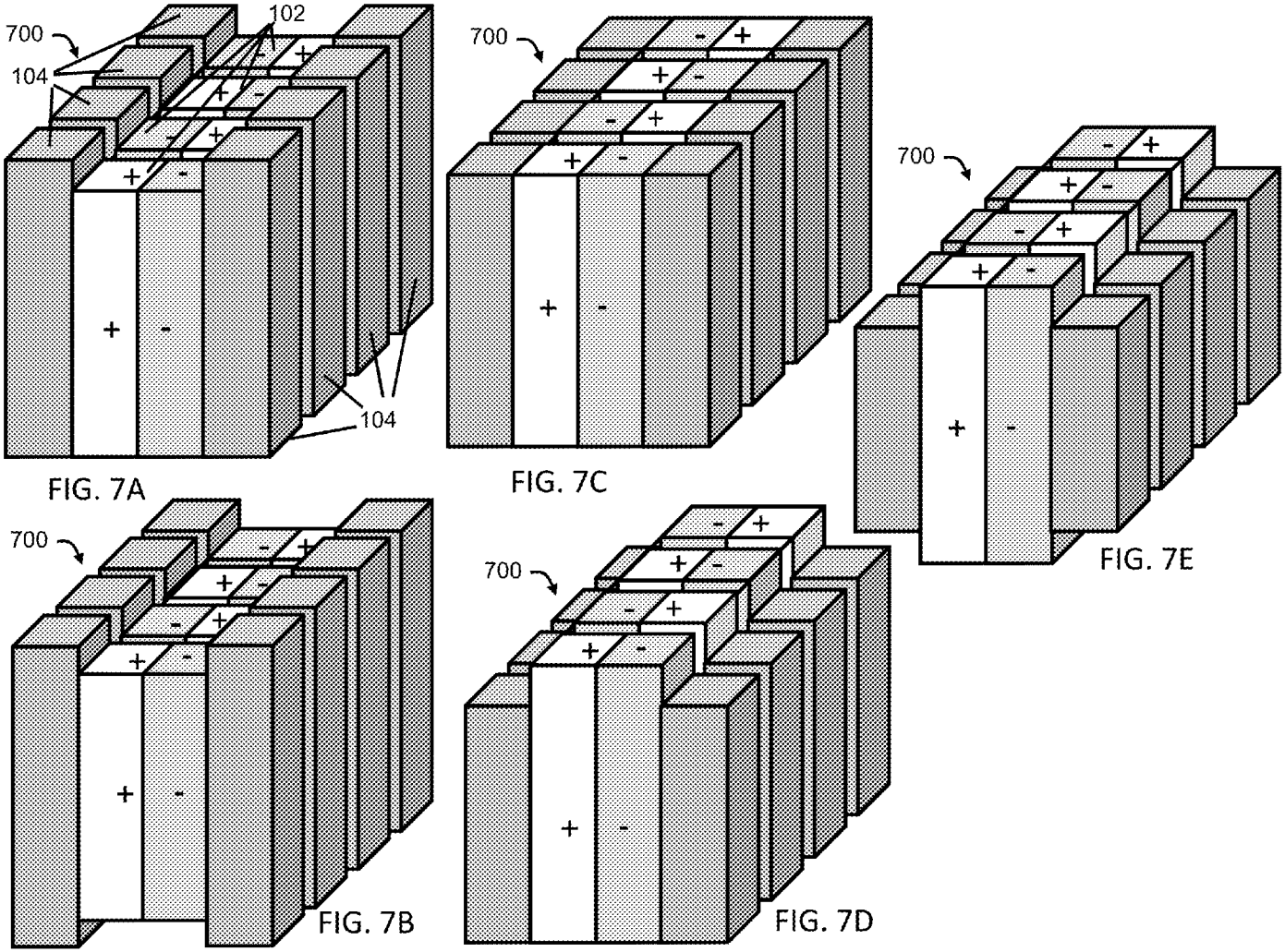
Figure 8A:
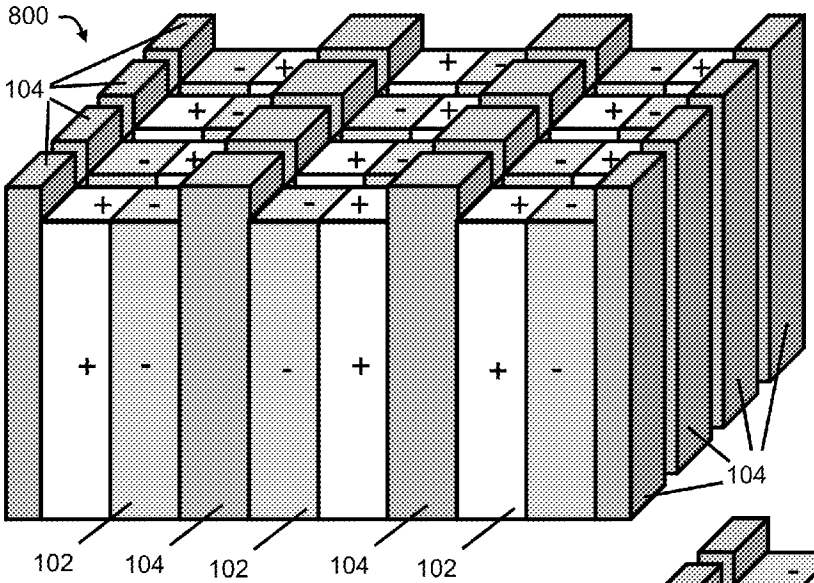

FIG. 8A depicts an exemplary flux concentrating device comprising three magnetic structures like those of FIG. 7A except the magnets in the middle structure are each rotated 180° compared to the magnets in the two outer most structures.

Figure 8B:
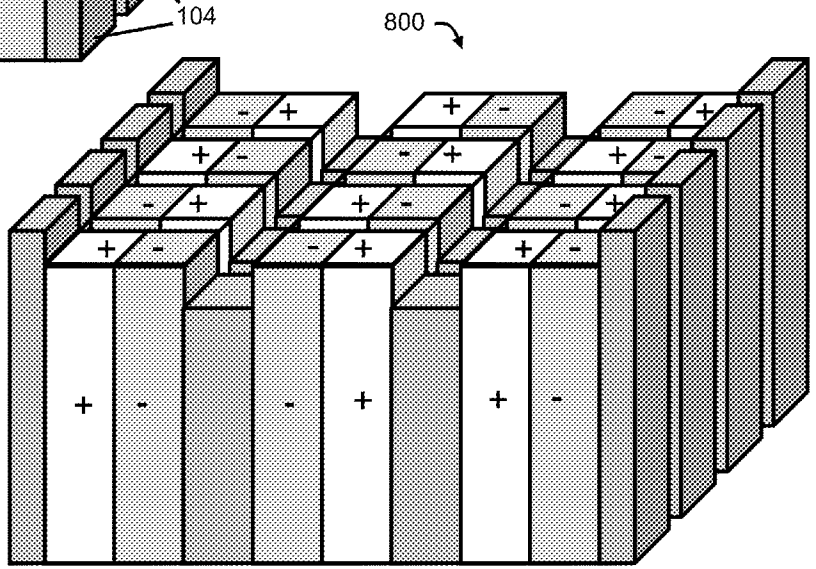

FIG. 8B depicts an exemplary flux concentrating device like that of FIG. 8A except the pole pieces in the inside of the device are configured to accept targets the recess into the device.

FIGS. 9A-9G depict various exemplary male-female type interfaces.

Figure 10A:
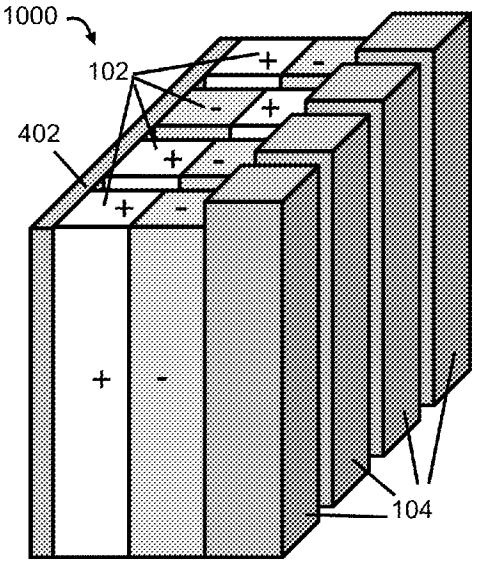

FIG. 10A depicts an exemplary flux concentrator device like that shown previously in FIG. 5A, where the magnetic structure has a polarity pattern in accordance with a Barker 4 code.

Figure 10B:
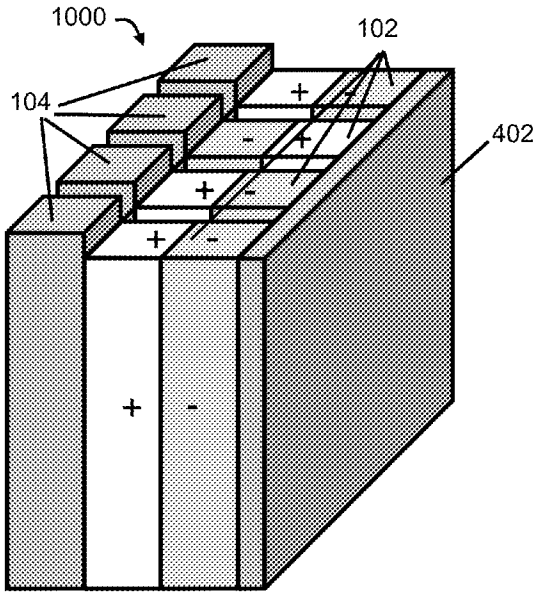

FIG. 10B depicts another exemplary flux concentrator device like that of FIG. 10A, where the magnetic structure has a polarity pattern that is complementary to the magnetic structure of FIG. 10A.

Figure 11A:
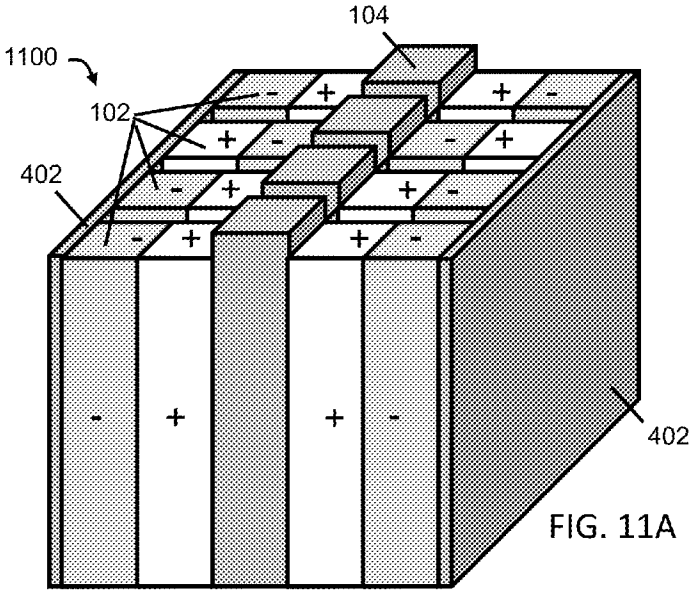
Figure 11B:
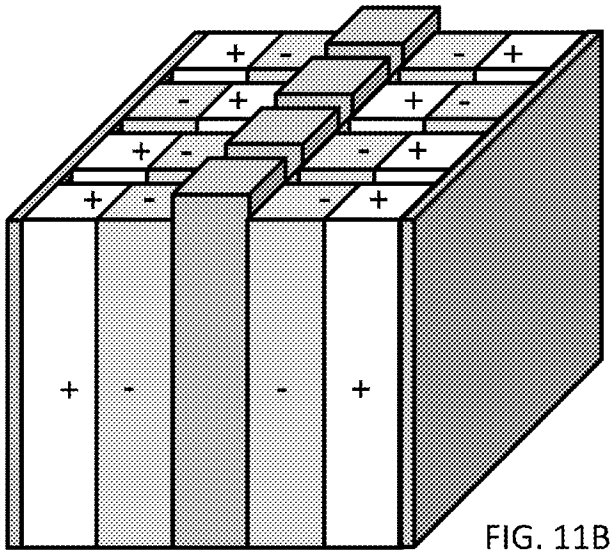

FIGS. 11A and 11B depict complementary Barker-4 coded flux concentrator devices that like those of FIGS. 10A and 10B.

Figure 12:
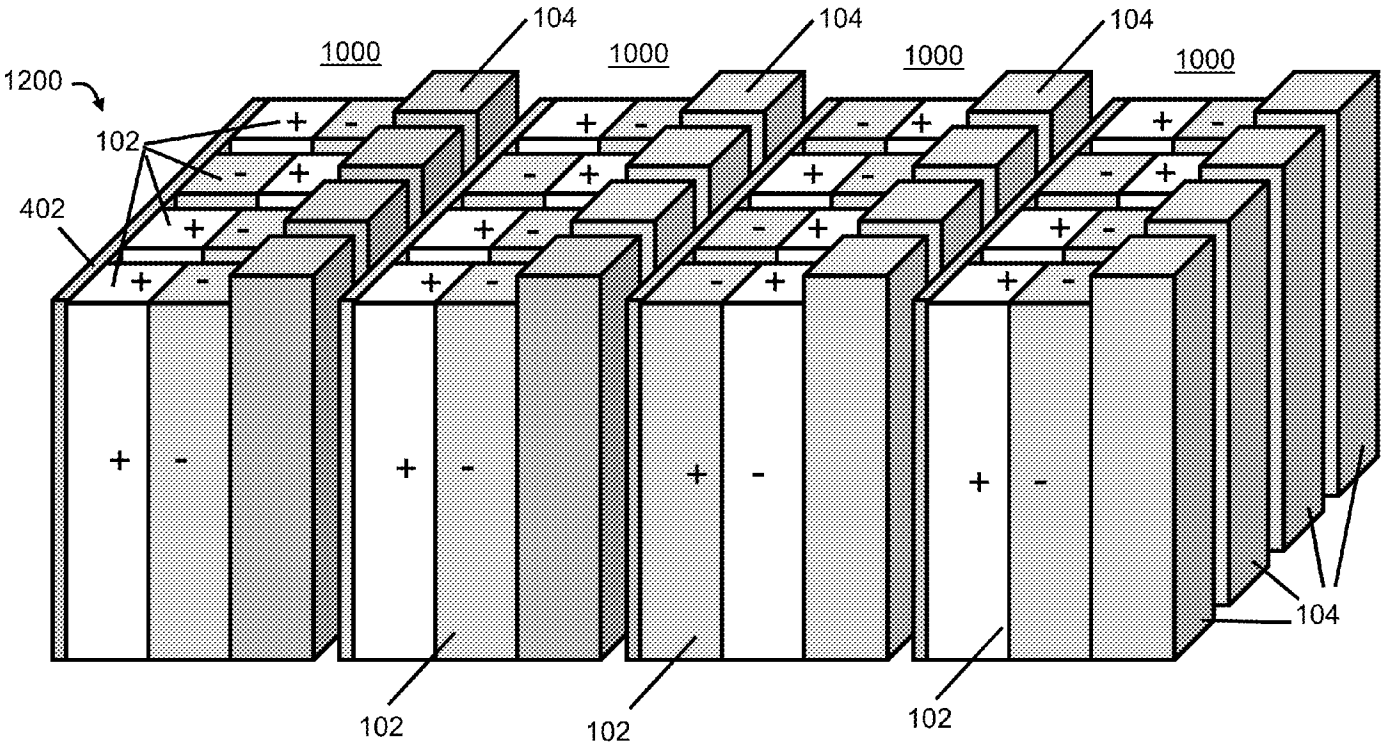

FIG. 12 depicts four Barker-4 coded flux concentrator devices oriented in an array.

Figure 13A:
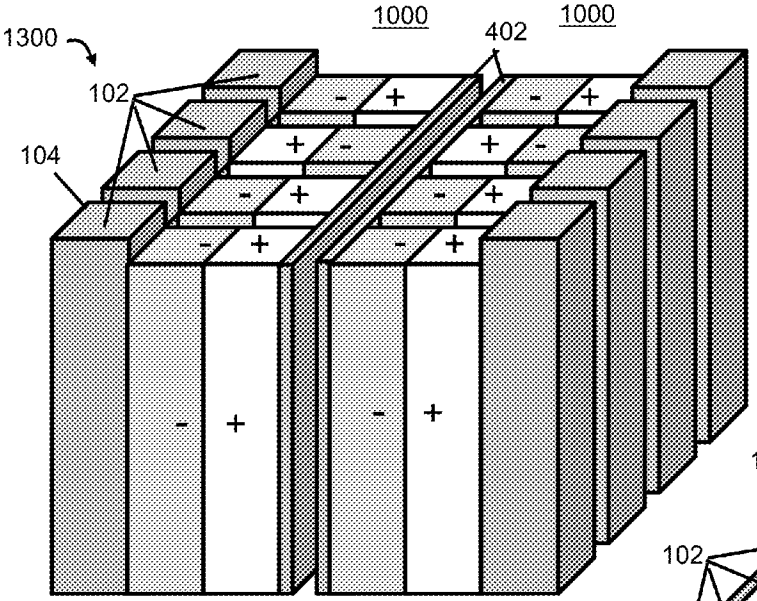
Figure 13B:
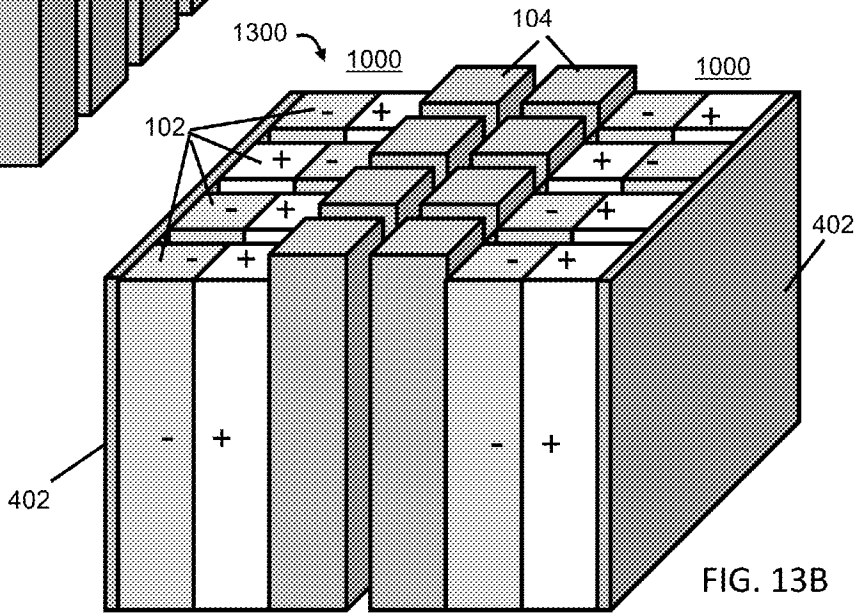

FIGS. 13A and 13B depict two variations of self-complementary Barker4-2 coded flux concentrator devices.

Figure 14:
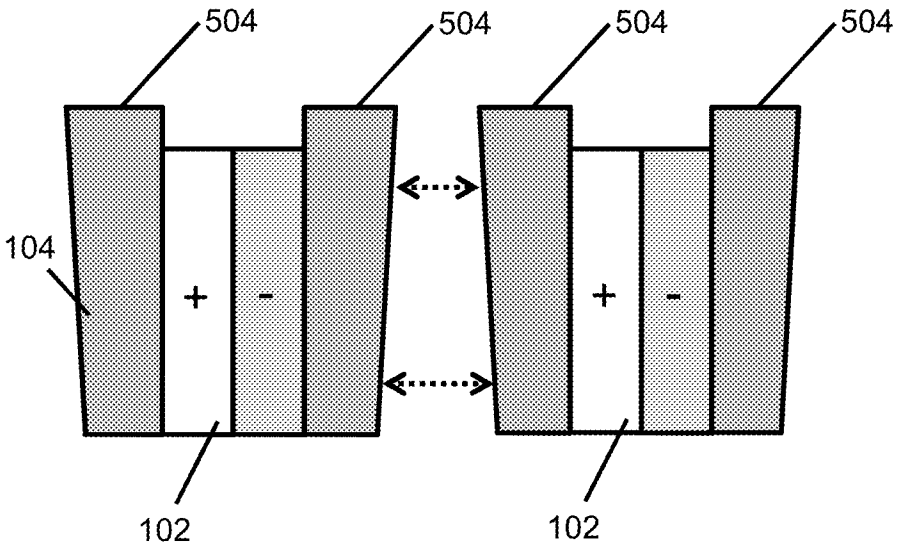

FIG. 14 depicts exemplary tapered pole pieces.

Figure 15A:
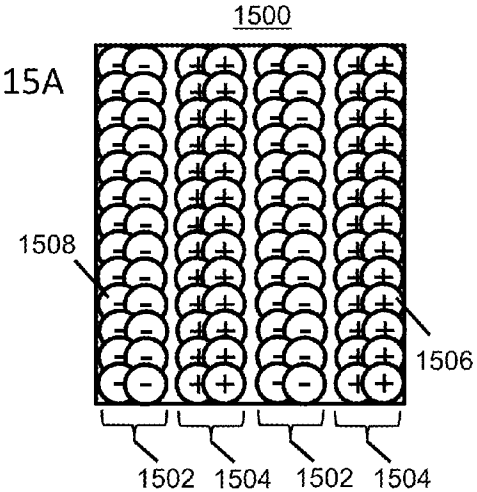
Figure 15B:
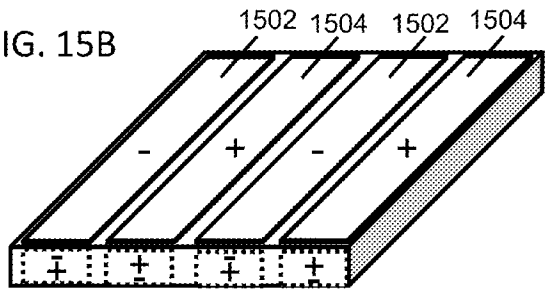

FIGS. 15A and 15B depict an exemplary printed magnetic structure comprising alternating polarity spaced maxel stripes.

Figure 15C:
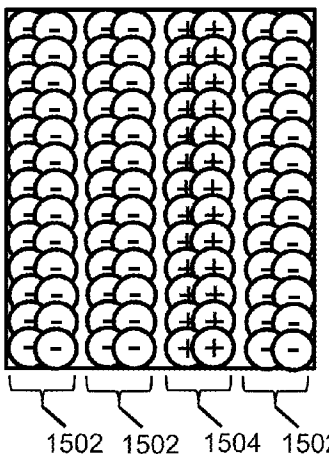
Figure 15D:
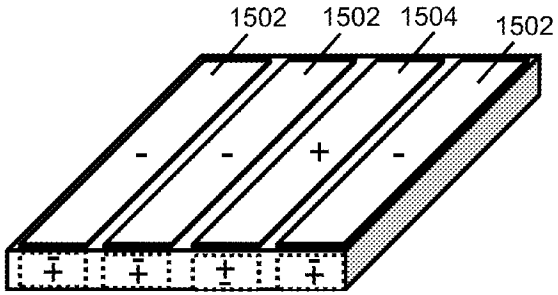

FIGS. 15C and 15D depict an exemplary printed magnetic structure comprising spaced maxel stripes having a polarity pattern in accordance with a Barker 4 pattern.

Figure 16B:
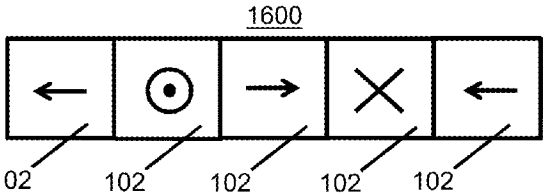
FIG. 16B (Prior Art)
Figure 16A:
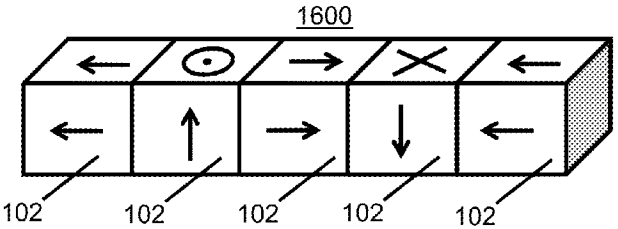
FIG. 16A (Prior Art)

FIG. 16A depicts an oblique view of an exemplary prior art Halbach array.

FIG. 16B depicts a top down view of the same exemplary Halbach array of FIG. 16A.

Figure 17B:
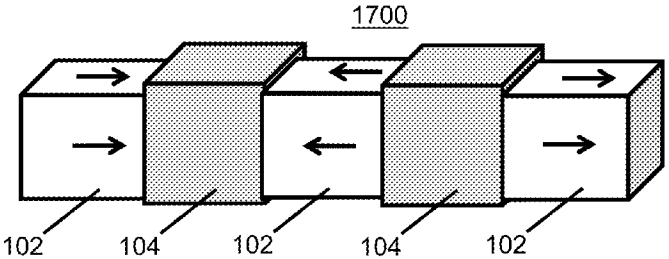
Figure 17A:
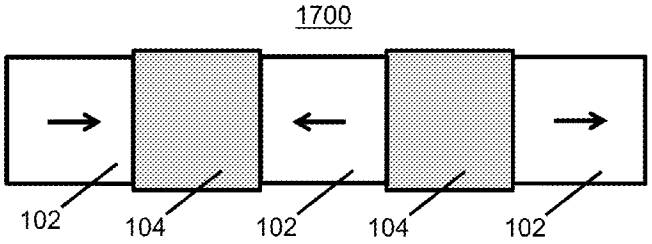

FIGS. 17A and 17B depict side and oblique views of an exemplary hybrid magnet-pole piece structure in accordance with one aspect of the invention.

Figure 17D:
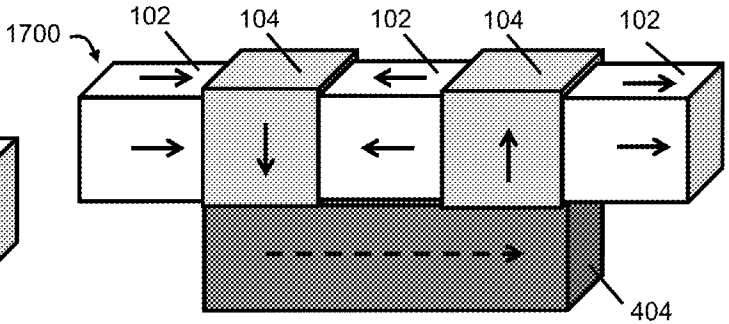
Figure 17C:
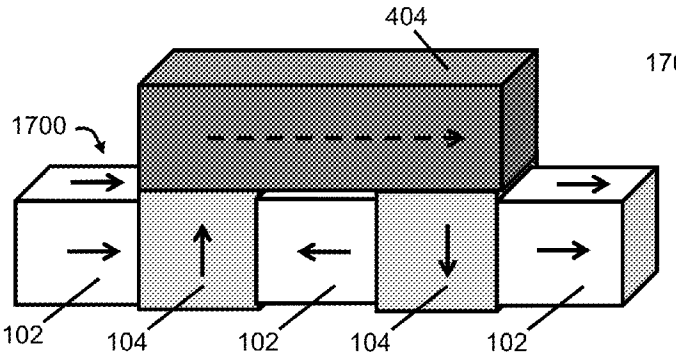

FIG. 17C depicts a target on top of the exemplary hybrid magnet-pole piece structure of FIGS. 17A and 17B where flux lines are shown moving in a clockwise direction.

FIG. 17D depicts a target on bottom of the exemplary hybrid magnet-pole piece structure of FIGS. 17A and 17B where flux lines are shown moving in a counter-clockwise direction.

Figure 17E:
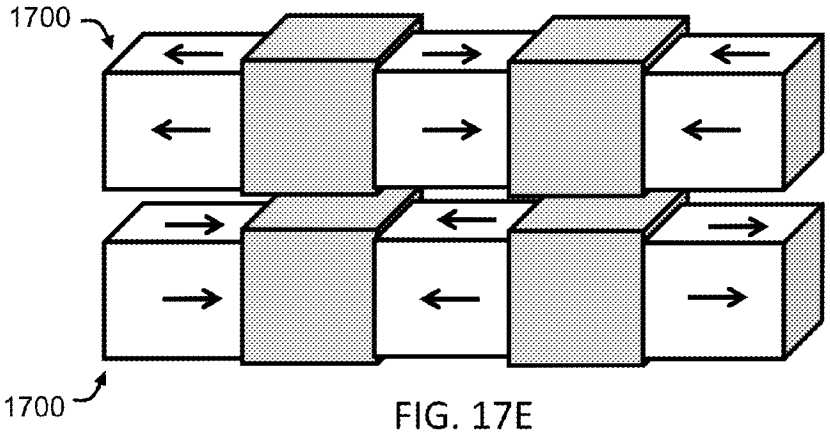

FIG. 17E depicts separated complementary three magnet-two pole piece arrays.

Figure 17F:
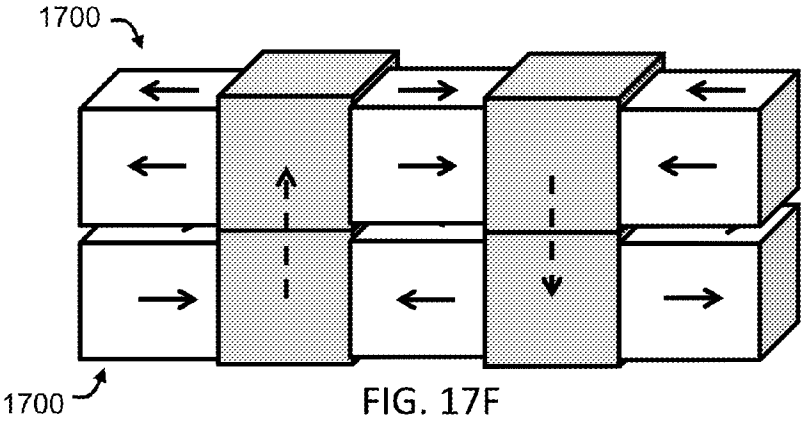

FIG. 17F depicts the complementary arrays of FIG. 17E in contact.

Figure 17H:
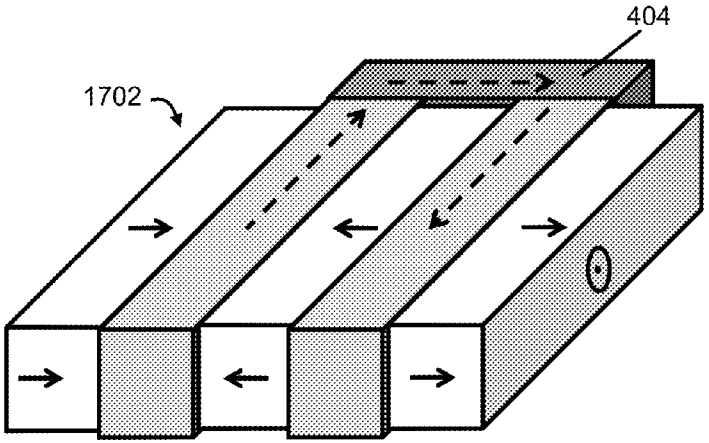
Figure 17G:
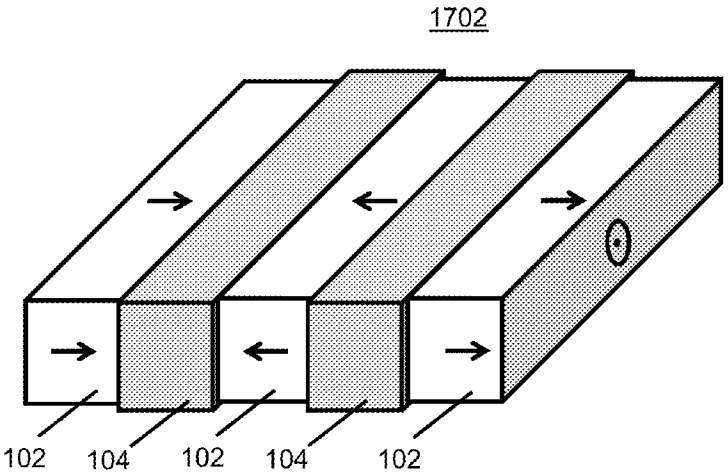

FIG. 17G depicts an exemplary lateral magnet hybrid structure.

FIG. 17H depicts the exemplary lateral magnet hybrid structure of FIG. 17G with a target attached on a first side such that flux lines move in a clockwise manner.

Figure 17I:
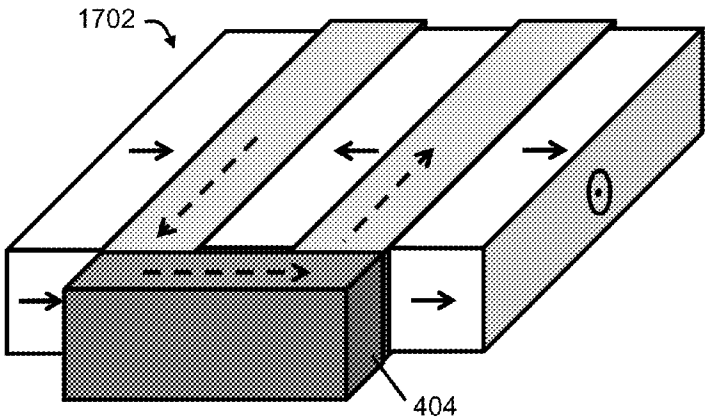

FIG. 17I depicts the exemplary lateral magnet hybrid structure of FIG. 17G with a target attached on a second side such that flux lines move in a counter-clockwise manner.

Figure 17J:
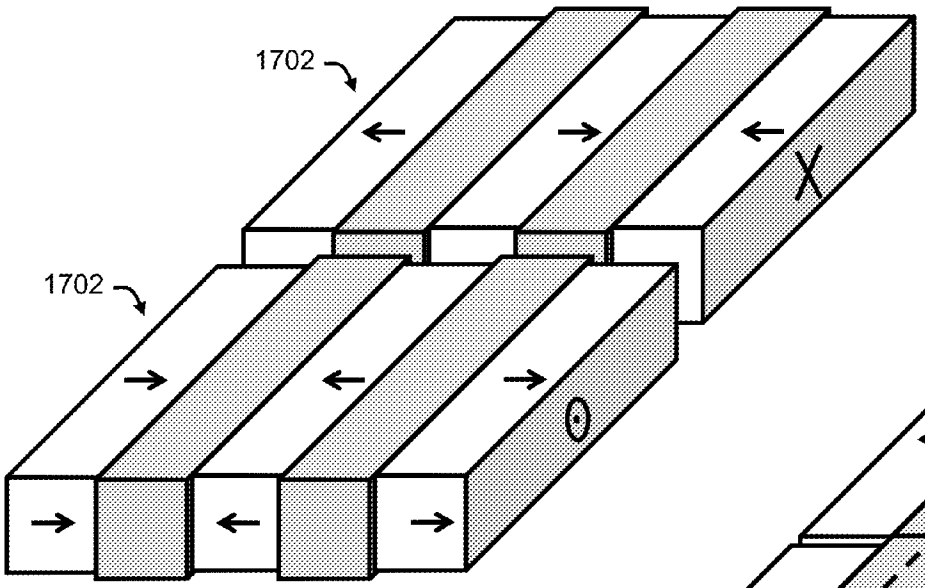

FIG. 17J depicts separated complementary lateral magnet hybrid structures like depicted in FIG. 17G.

Figure 17K:
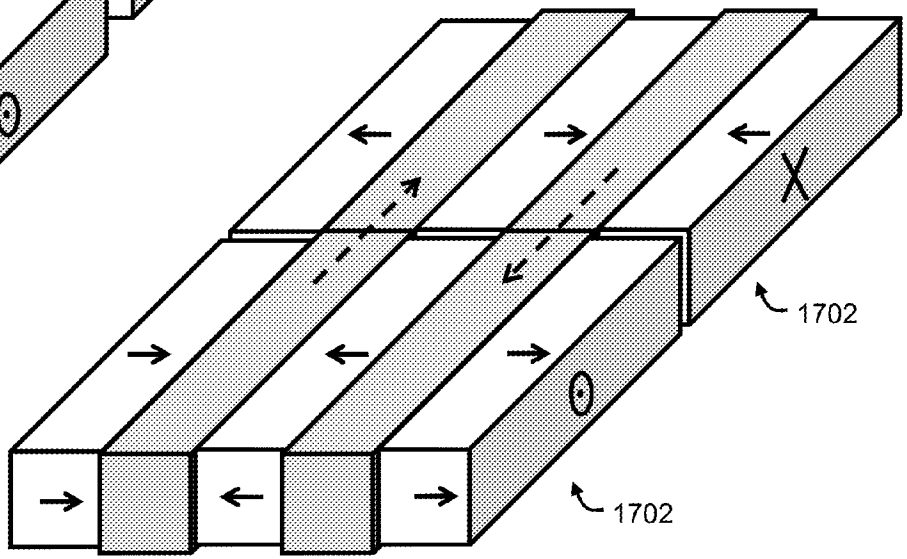

FIG. 17K depicts complementary lateral magnet hybrid structures like depicted in FIG. 17G in contact.

Figure 18A:
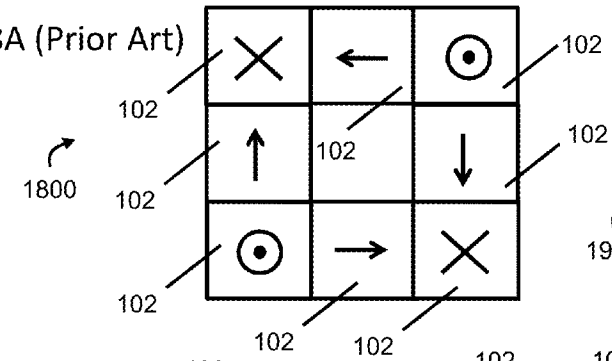
FIG. 18A (Prior Art)
Figure 18B:
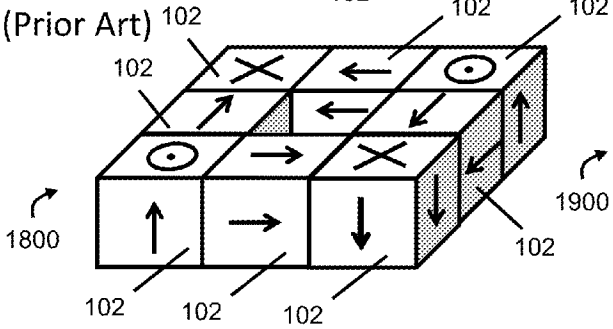
FIG. 18B (Prior Art)

FIGS. 18A and 18B depict a prior art magnet structure where the magnets in the four corners are magnetized vertically and the side magnets between the corner magnets are magnetized horizontally.

Figure 19A:
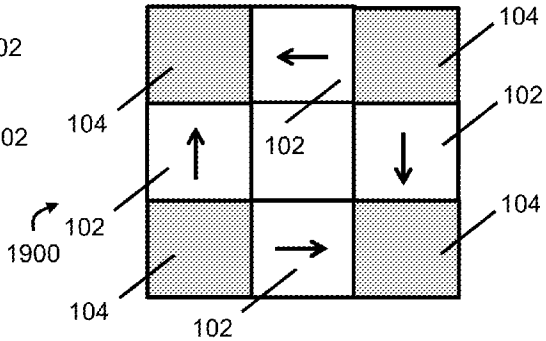
Figure 19B:
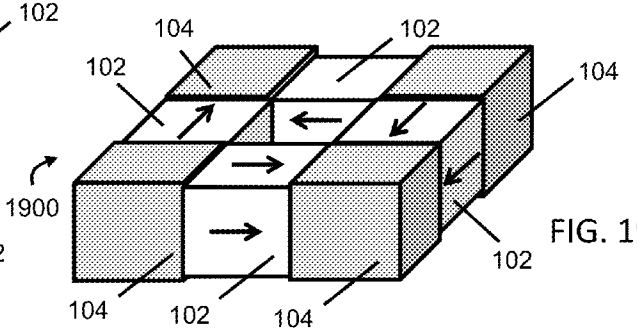

FIGS. 19A and 19B depict a four magnet-four pole piece hybrid structure similar to the magnetic structures of FIGS. 18A and 18B where the corner magnets are replaced with pole pieces.

Figure 19D:
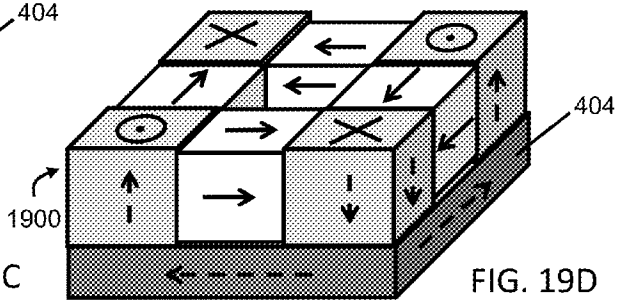
Figure 19C:
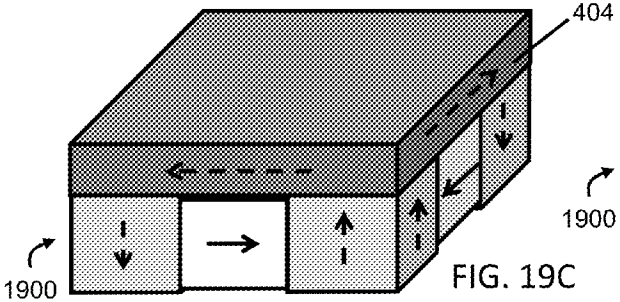

FIGS. 19C and 19D depict magnetic circuits produced by placing a target on the top and on the bottom of hybrid structures of FIGS. 19A and 19B.

Figure 19F:
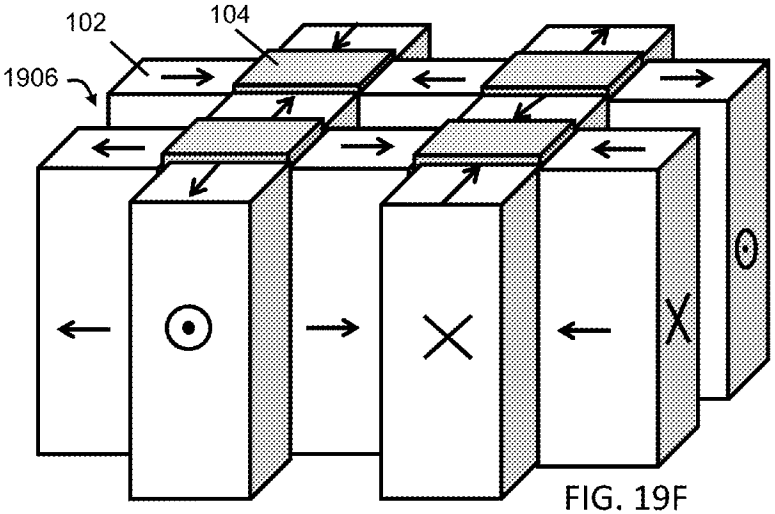
Figure 19E:
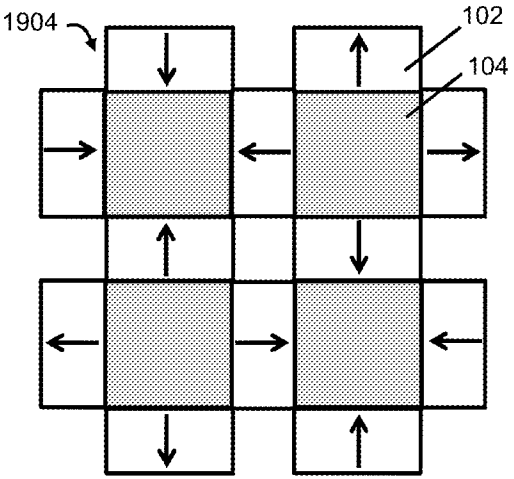
Figure 19H:
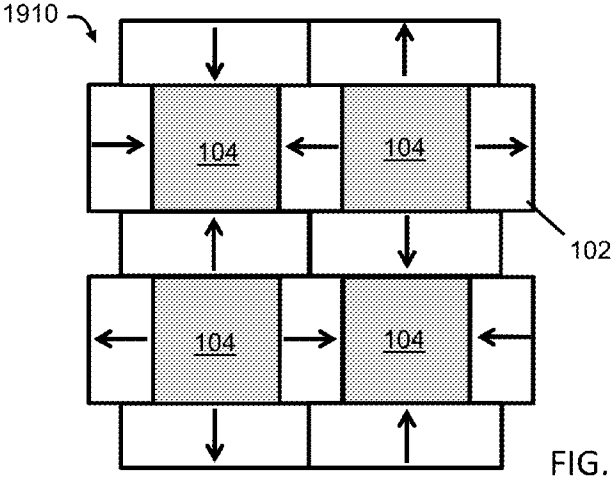
Figure 19G:
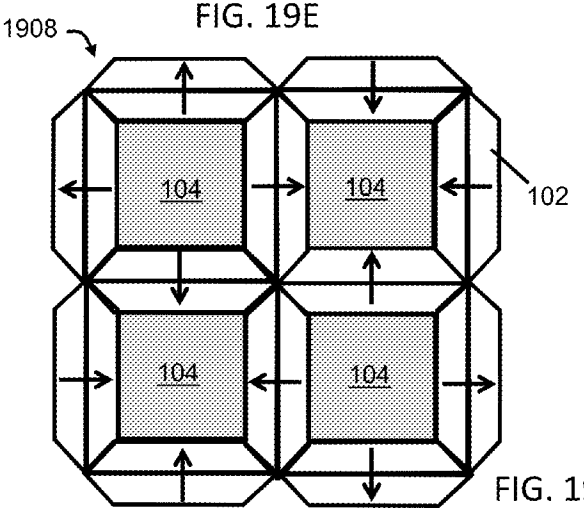
Figure 19M:
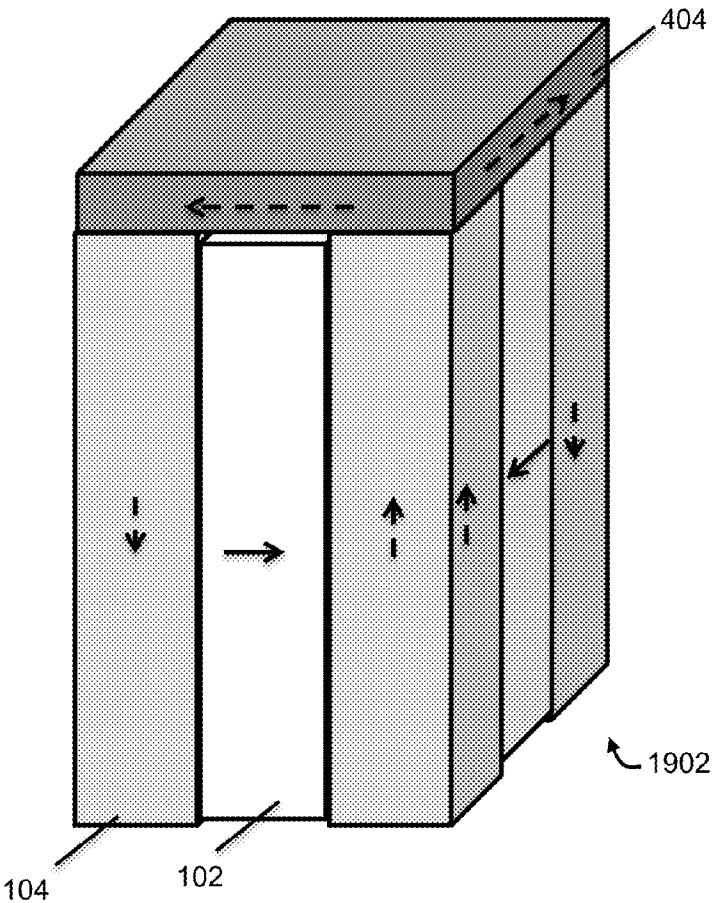
Figure 19L:
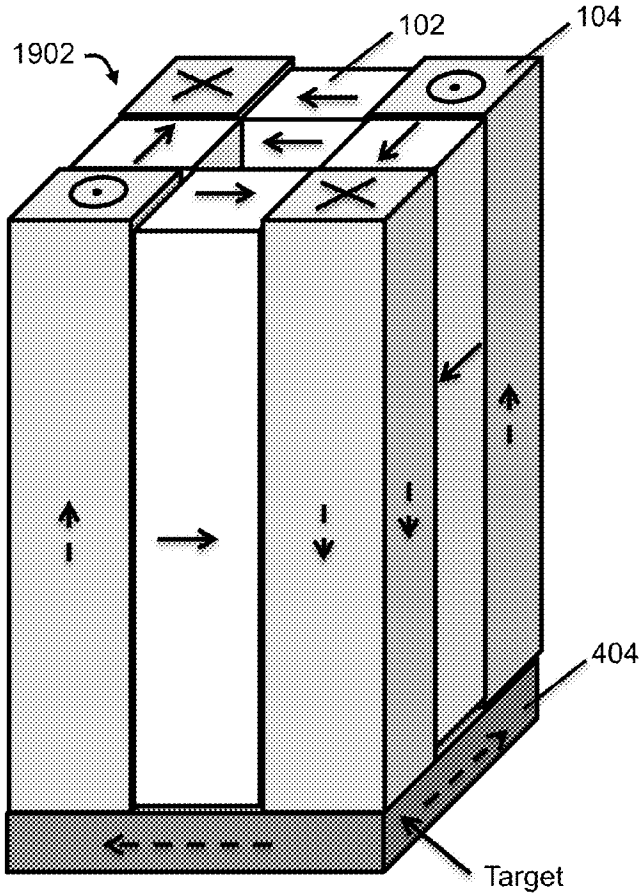

FIGS. 19L and 19M depict lateral magnet hybrid structures that are similar to the hybrid structures of FIGS. 19A and 19B.

FIG. 19E depicts a twelve magnet-four pole piece hybrid structure that corresponds to a two-dimensional version of hybrid structure of FIGS. 17A-17F.

FIG. 19F depicts a twelve lateral magnet-four pole piece hybrid structure that corresponds to a two-dimensional version of the lateral magnet hybrid structure of FIGS. 17G-17K.

FIG. 19G depicts use of beveled magnets in a hybrid structure similar to the hybrid structure of FIG. 19E.

FIG. 19H depicts use of different sized magnets in one dimension versus another dimension in a hybrid structure similar to the hybrid structures of FIGS. 19E and 19G.

FIGS. 19I-19K depict movement of the rows of magnets versus the pole pieces and vertical magnets so as to control the flux that is available at the ends of the pole pieces.

Figure 20:
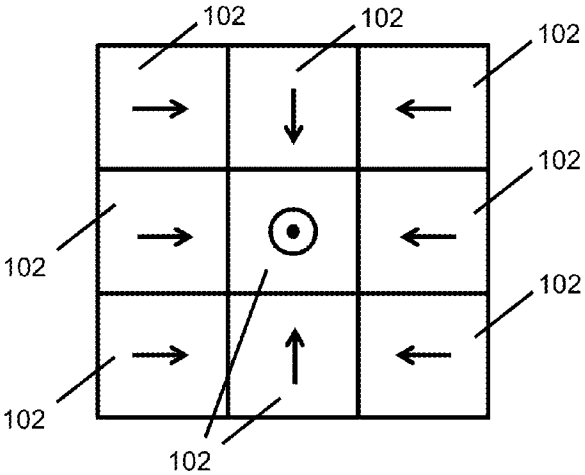
FIG. 20 (Prior Art)

FIG. 20 depicts a prior art magnetic structure that directs flux to the top of the structure.

Figure 21A:
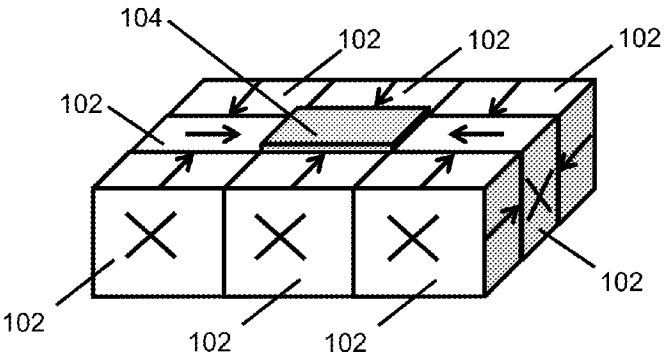
Figure 21B:
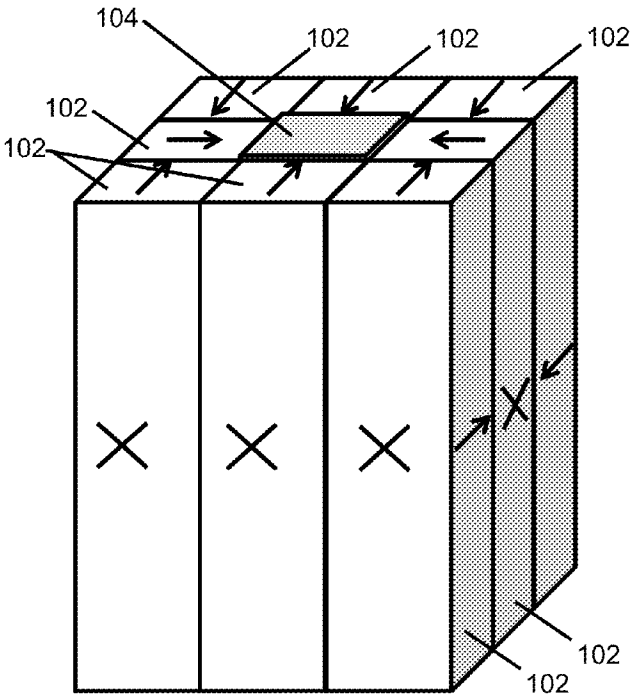

FIGS. 21A and 21B depict a hybrid structure and a lateral magnet hybrid structure each having a pole piece surrounded by eight magnets in the same magnet pattern as the magnetic structure of FIG. 20.

Figure 22B:
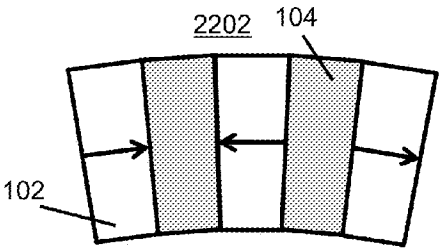
Figure 22C:
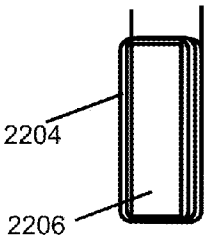
Figure 22D:
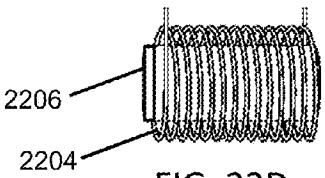
Figure 22A:
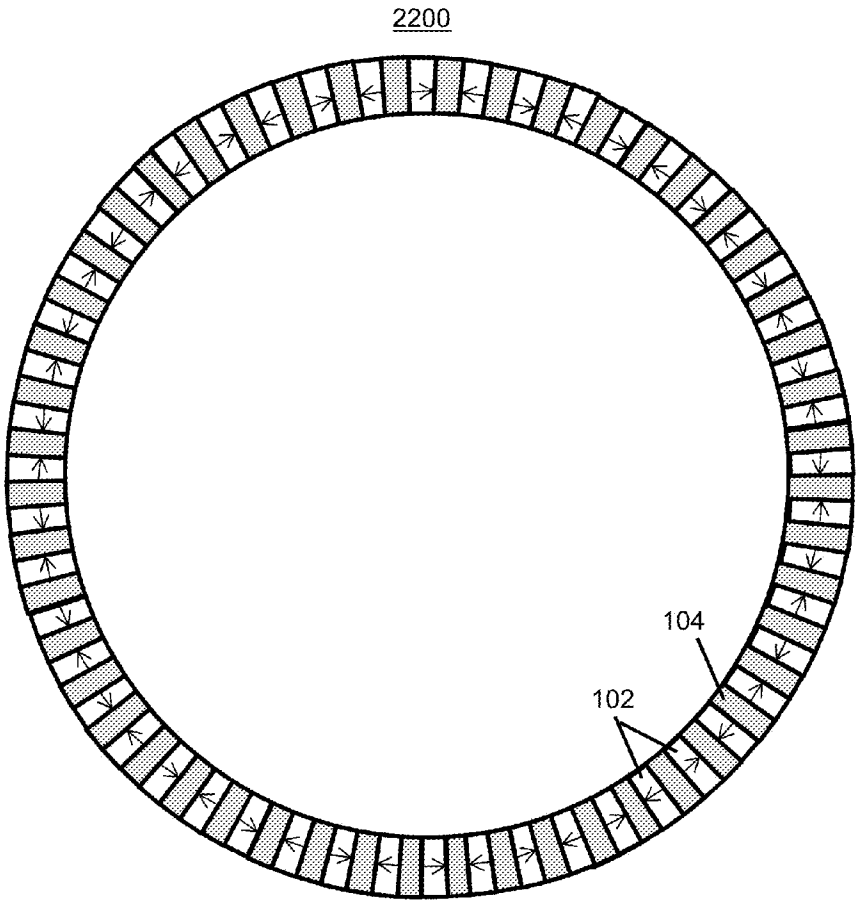

FIG. 22A depicts an exemplary hybrid rotor in accordance with the invention.

FIG. 22B provides an enlarged segment of the rotor of FIG. 22A.

FIGS. 22C and 22D depict exemplary stator coils.

Figure 22E:
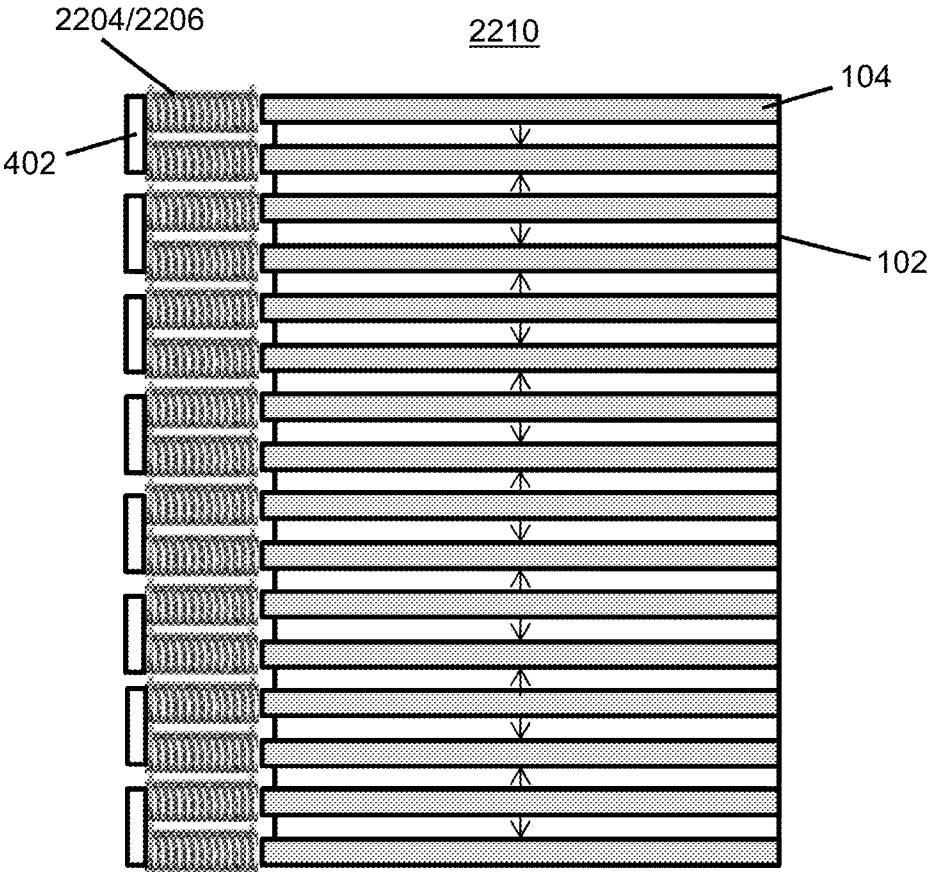

FIG. 22E depicts a first exemplary hybrid rotor and stator coil arrangement.

Figure 22F:
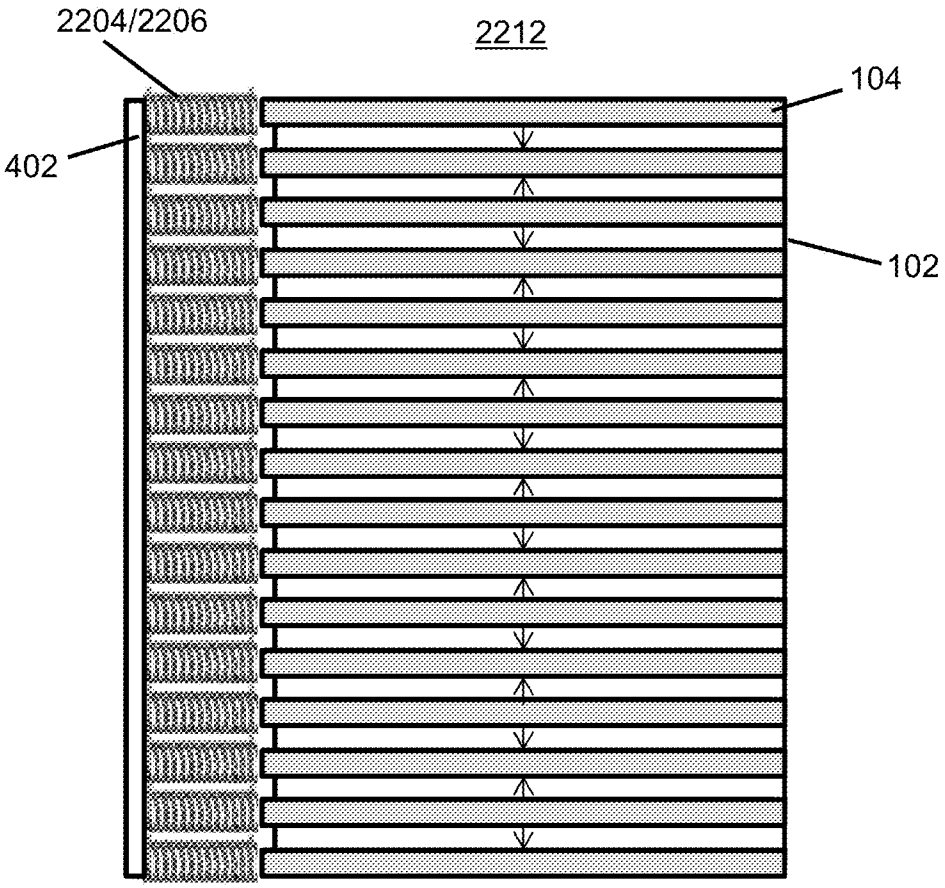
Figure 22G:
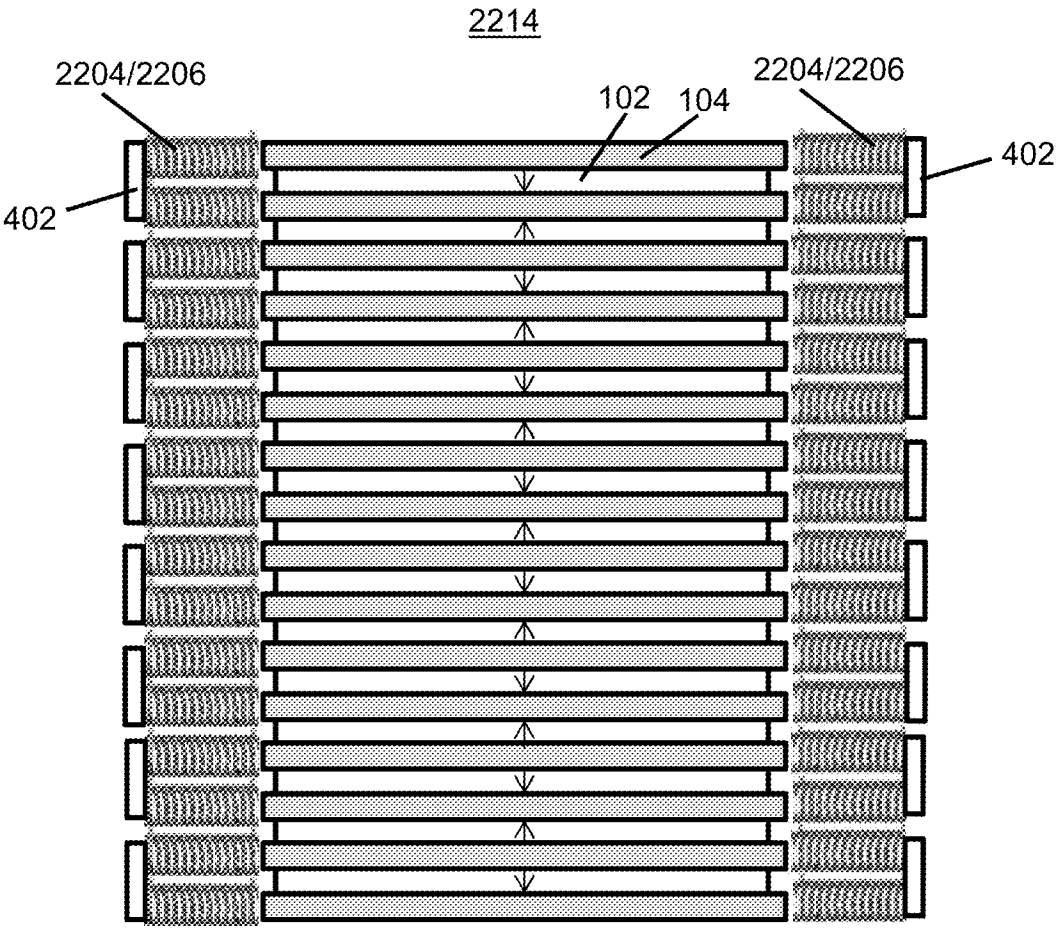

FIG. 22F depicts a second exemplary hybrid rotor and stator coil arrangement FIG. 22G depicts a third exemplary hybrid rotor and stator coil arrangement.

Figure 22H:
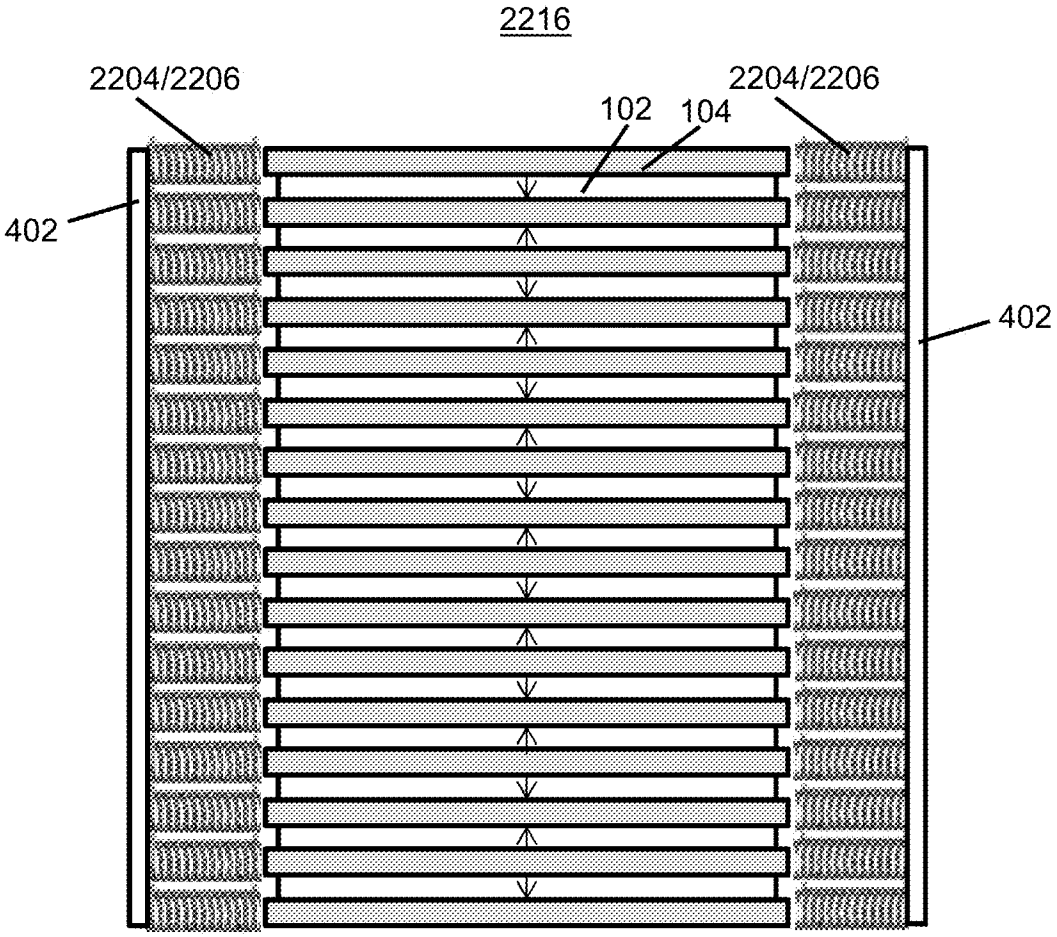

FIG. 22H depicts a fourth exemplary hybrid rotor and stator coil arrangement.

Figure 22I:
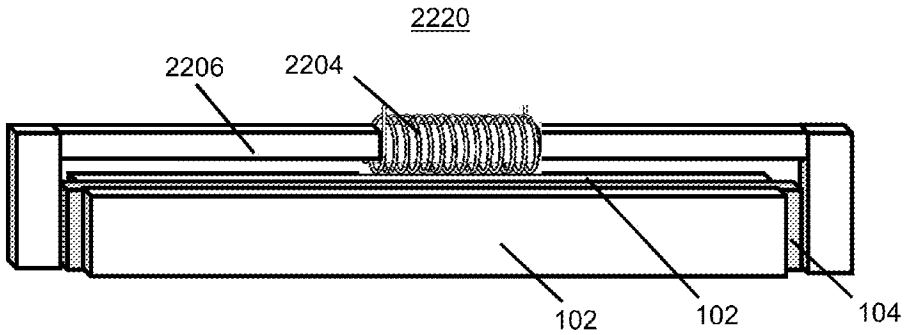

FIG. 22I depicts an exemplary saddle core type stator-rotor interface.

Figure 22J:
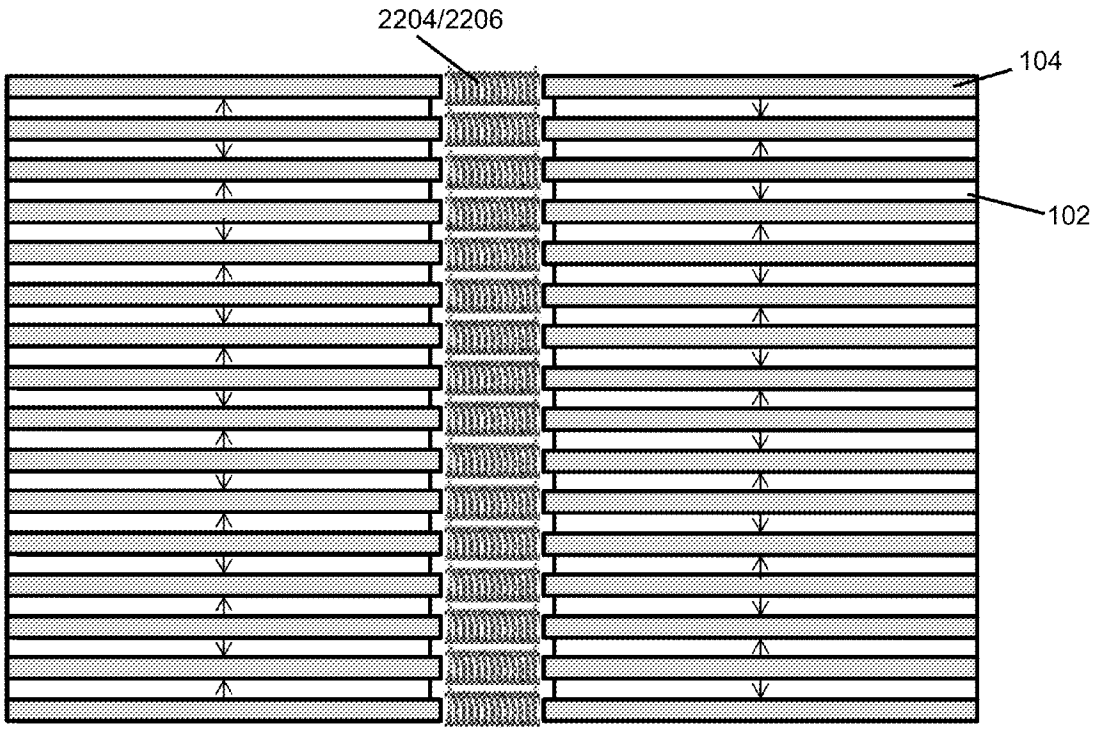

FIG. 22J depicts a fifth exemplary hybrid rotor and stator coil arrangement.

Figure 23B:
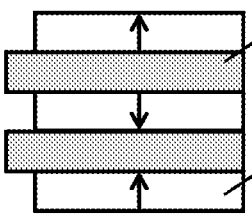
Figure 23C:
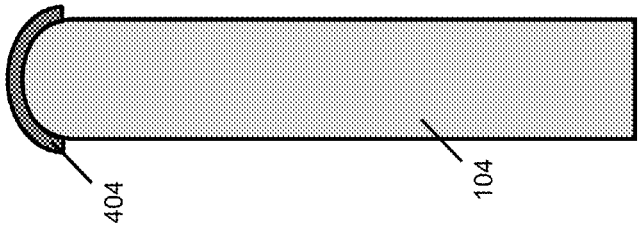
Figure 23A:
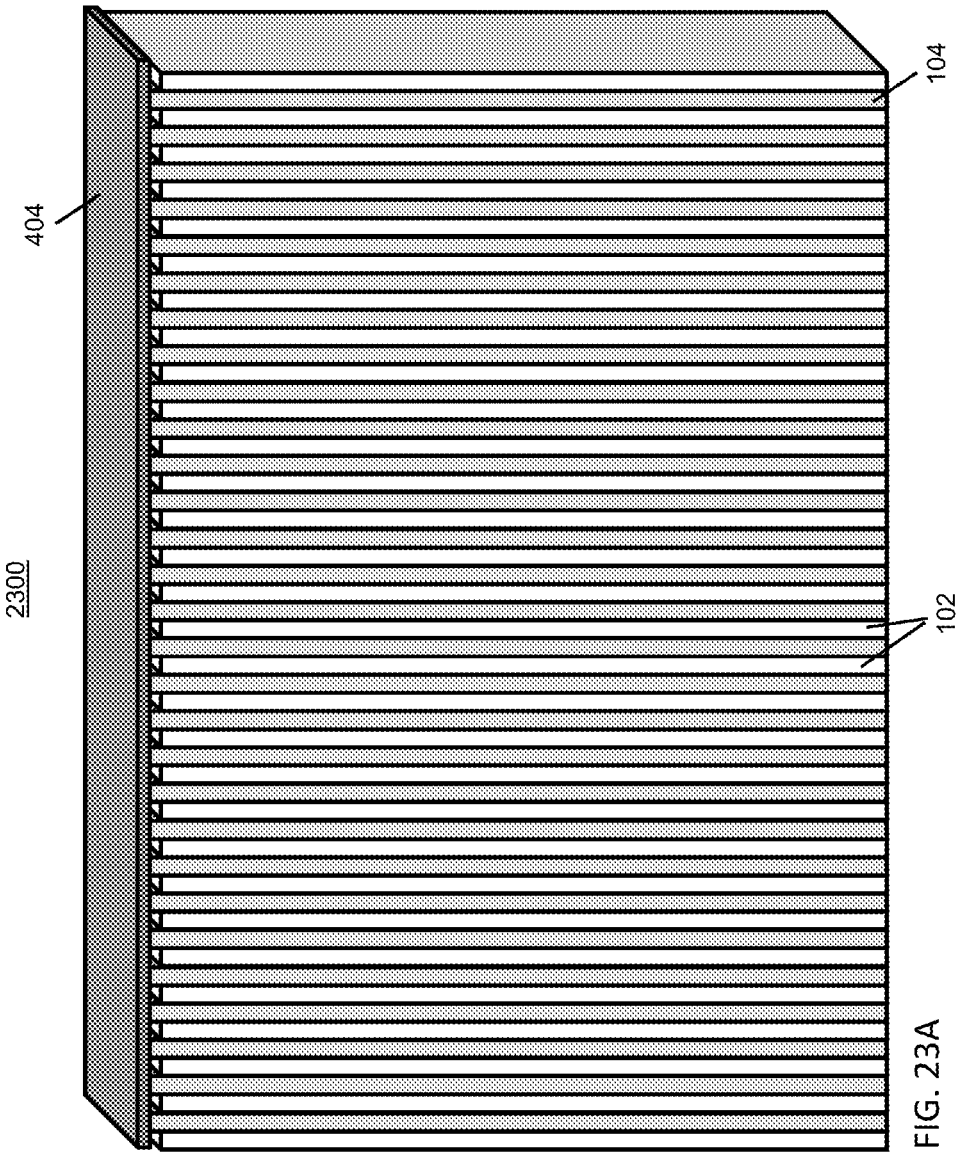

FIG. 23A depicts an exemplary metal separator lateral magnet hybrid structure.

FIG. 23B depicts the magnetization of the magnets of FIG. 23A.

FIG. 23C depicts an exemplary pole piece and exemplary target shaped to provide a rounded upper surface.

Figure 24B:
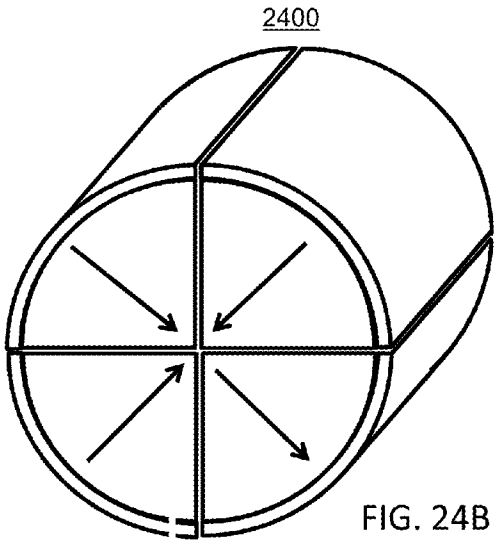
Figure 24A:
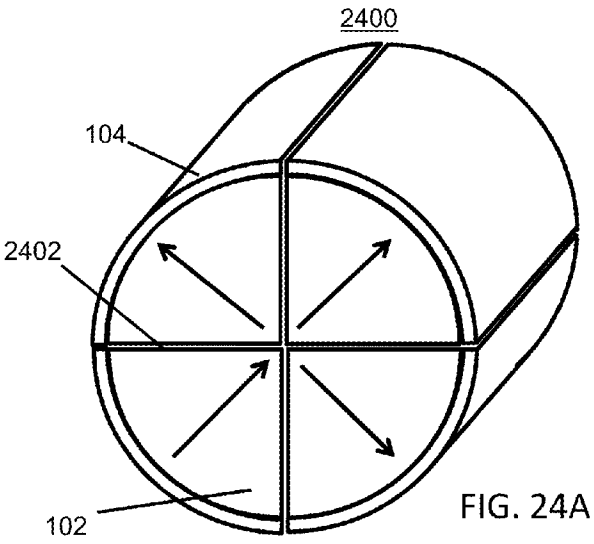

FIGS. 24A and 24B depict assemblies having magnets arranged in accordance with complementary cyclic Barker 4 codes.

Figure 24C:
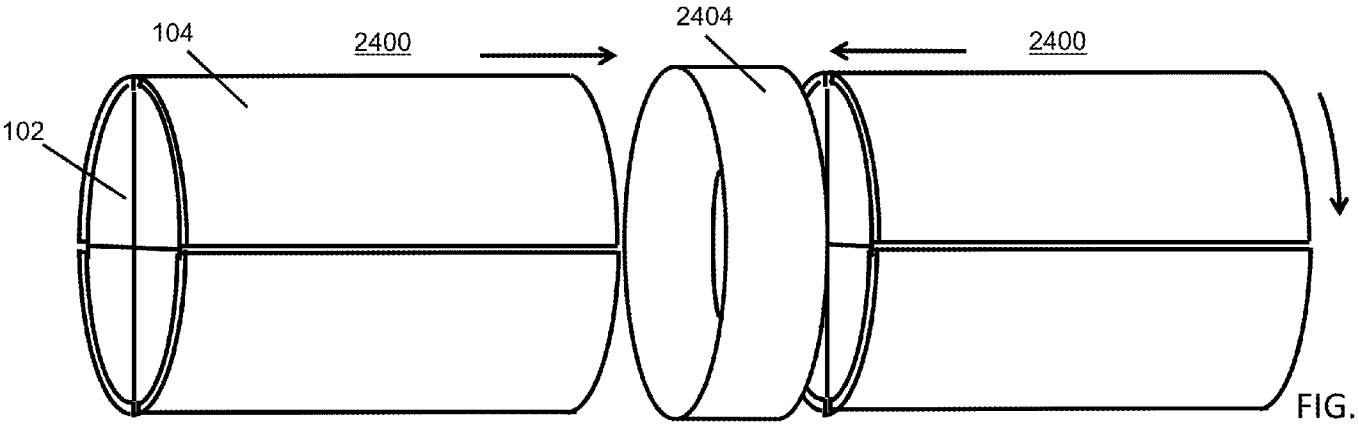

FIG. 24C depicts the two complementary cyclic lateral magnet assemblies of FIGS. 24A and 24B being brought together such that their magnetic structures correlate.

Figure 25B:
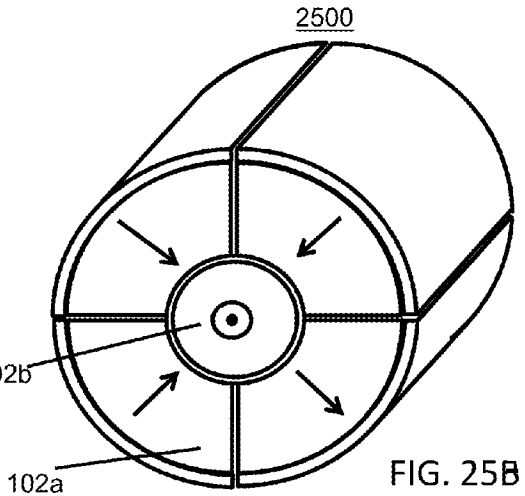
Figure 25A:
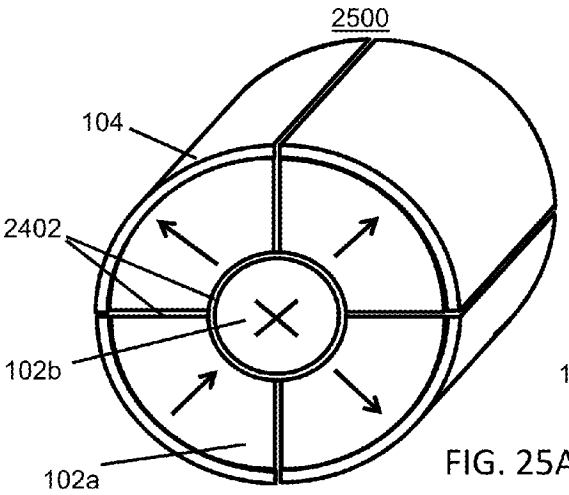

FIGS. 25A and 25B depict cyclic lateral magnet assemblies similar to those of FIGS. 24A-24C except lateral magnets are combined with conventional magnets.

Figure 26B:
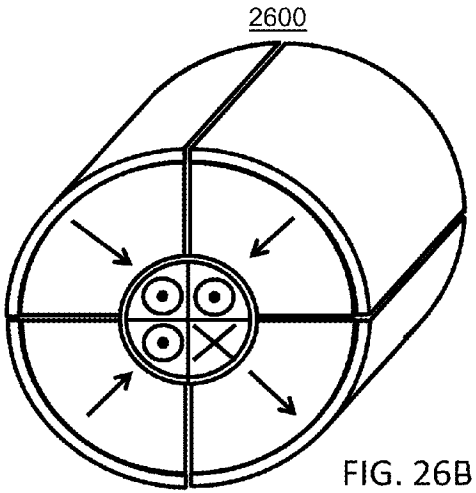
Figure 26A:
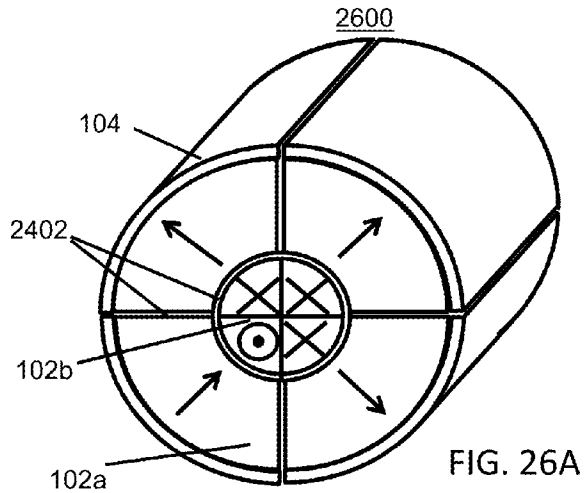

FIGS. 26A and 26B depict exemplary cyclic lateral magnet assemblies similar to those of FIGS. 25A and 25B where the individual conventional magnets are each replaced with four conventional magnets having polarities in accordance with a cyclic Barker 4 code.

Figure 27B:
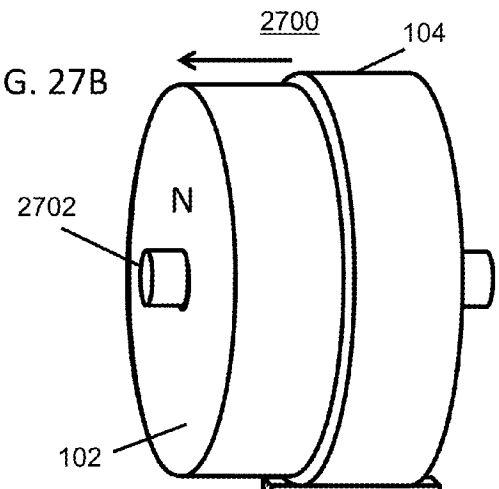
Figure 27A:
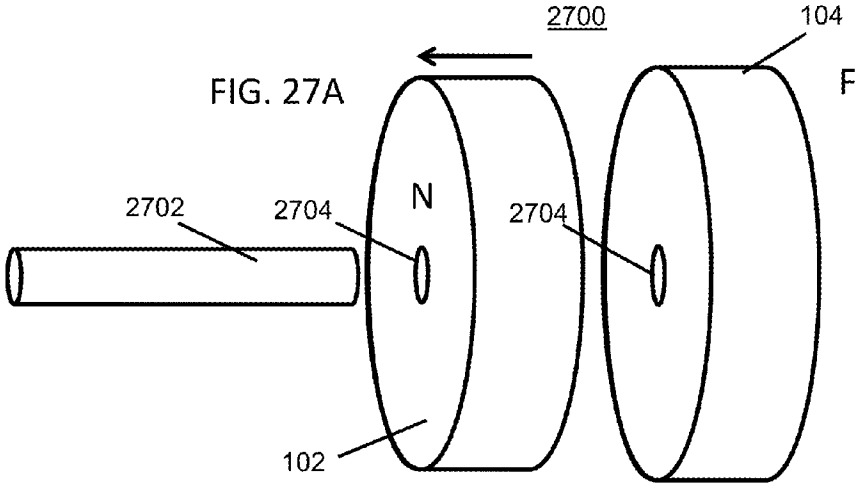

FIGS. 27A and 27B depict an exemplary lateral magnet wheel assembly.

Figure 28C:
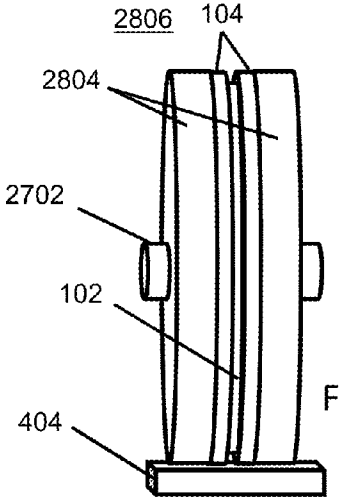
Figure 28B:
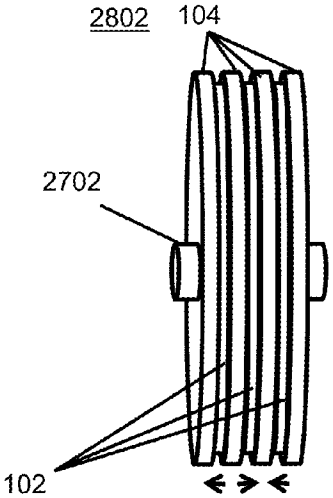
Figure 28A:
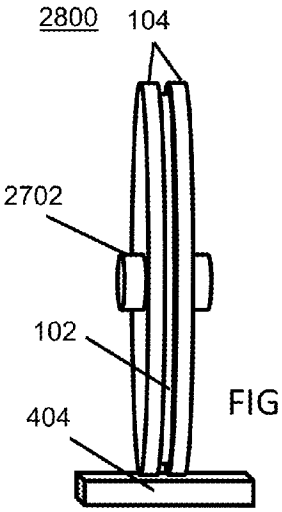
Figure 29A:
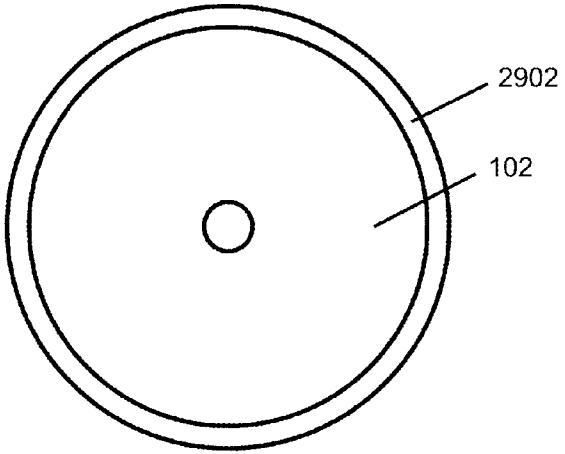
Figure 29B:
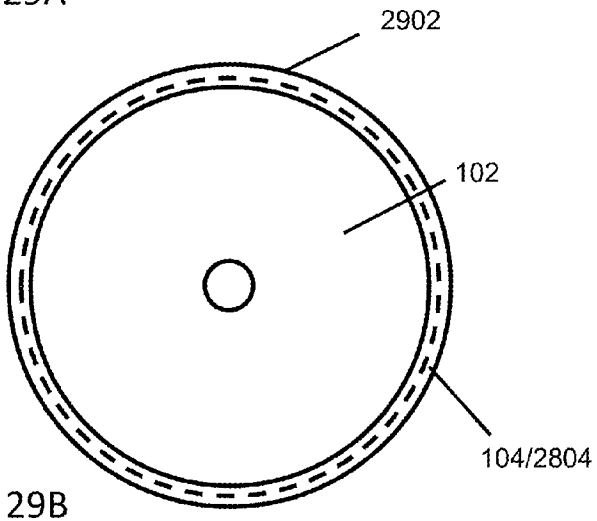
Figure 29C:
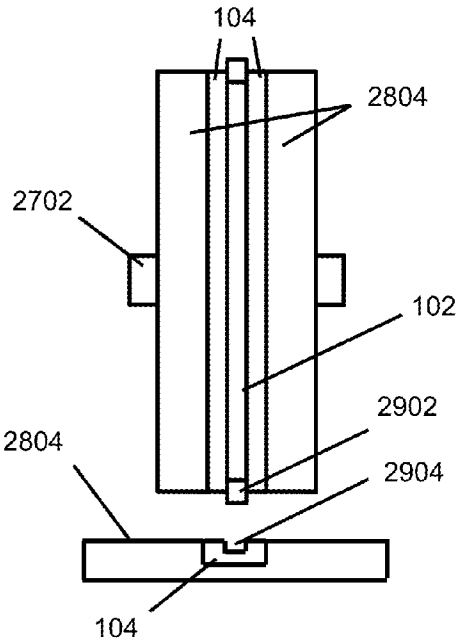
Figure 29D:
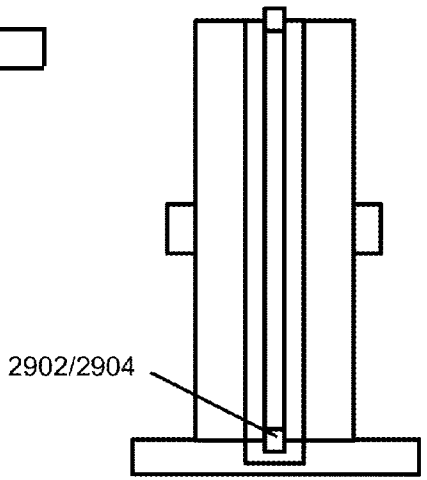

FIG. 28A depicts a second exemplary lateral magnet wheel assembly.

FIG. 28B depicts a third exemplary lateral magnet wheel assembly.

FIG. 28C depicts a fourth exemplary lateral magnet wheel assembly having exemplary friction surfaces.

FIGS. 29A-29D depict exemplary use of a guide ring and a slot within a target and optional friction surfaces.

Figure 30B:
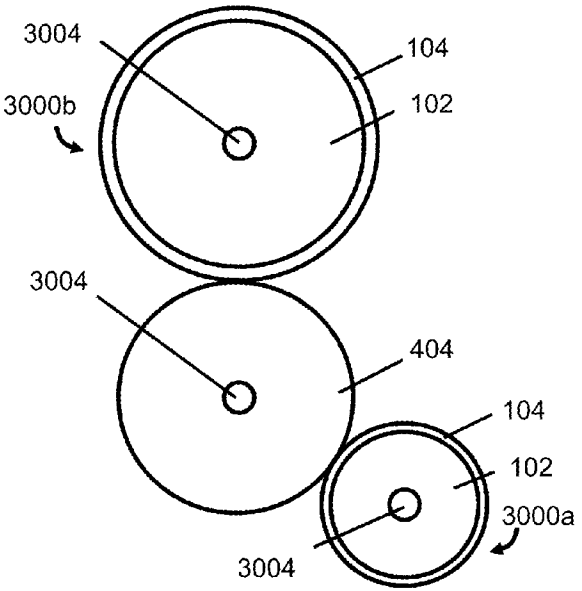
Figure 30A:
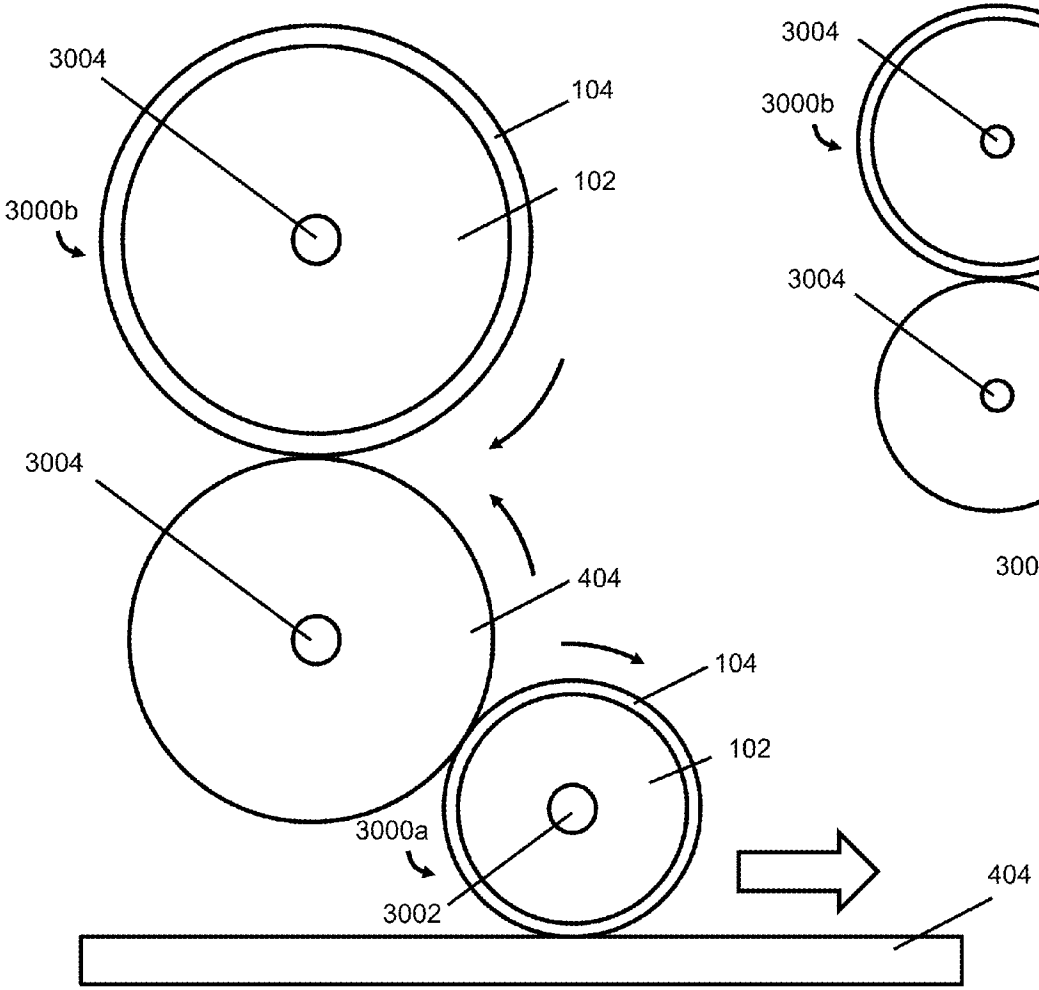

FIGS. 30A and 30B depict exemplary combinations of lateral magnetic wheel assemblies and round targets having different diameters that function as gears.

FIGS. 31A-31C depict top, side, and oblique projection views of an exemplary lateral magnet connector assembly.

FIGS. 31D-31F depict top, side, and oblique projection views of the lateral magnet connector assembly of FIGS. 31A-31C attached to a target also having a connection region.

FIG. 31G depicts the lateral magnetic connector assembly of FIGS. 31A-31C in an attached state with a complementary lateral magnetic connector assembly.

FIGS. 32A and 32B depict top views of two exemplary lateral magnetic connector assemblies having non-magnetic spacers where the magnets are oriented in accordance with a Barker 4 code.

FIGS. 33A-33C depict three exemplary approaches for providing connectors that connect across a connection boundary.

FIGS. 34A and 34B depict exemplary electrical contacts 34 that can be used in an electrical connector.

FIG. 35A depicts a top view of an exemplary lateral magnet connector.

FIG. 35B depicts an exemplary striped magnet.

FIG. 35C depicts an oblique view of the exemplary lateral magnet connector assembly of FIG. 35A and a corresponding target.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

Certain described embodiments may relate, by way of example but not limitation, to systems and/or apparatuses comprising magnetic structures, magnetic and non-magnetic materials, methods for using magnetic structures, magnetic structures having magnetic elements produced via magnetic printing, magnetic structures comprising arrays of discrete magnetic elements, combinations thereof, and so forth. Example realizations for such embodiments may be facilitated, at least in part, by the use of an emerging, revolutionary technology that may be termed correlated magnetics. This revolutionary technology referred to herein as correlated magnetics was first fully described and enabled in the co-assigned U.S. Pat. No. 7,800,471 issued on Sep. 21, 2010, and entitled "A Field Emission System and Method". The contents of this document are hereby incorporated herein by reference. A second generation of a correlated magnetic technology is described and enabled in the co-assigned U.S. Pat. No. 7,868,721 issued on Jan. 11, 2011, and entitled "A Field Emission System and Method". The contents of this document are hereby incorporated herein by reference. A third generation of a correlated magnetic technology is described and enabled in the co-assigned U.S. Pat. No. 8,179,219 issued on May 15, 2012, and entitled "A Field Emission System and Method". The contents of this document are hereby incorporated herein by reference. Another technology known as correlated inductance, which is related to correlated magnetics, has been described and enabled in the co-assigned U.S. Pat. No. 8,115,581 issued on Feb. 14, 2012, and entitled "A System and Method for Producing an Electric Pulse". The contents of this document are hereby incorporated by reference.

Material presented herein may relate to and/or be implemented in conjunction with multilevel correlated magnetic systems and methods for producing a multilevel correlated magnetic system such as described in U.S. Pat. No. 7,982,568 issued Jul. 19, 2011 which is all incorporated herein by reference in its entirety. Material presented herein may relate to and/or be implemented in conjunction with energy generation systems and methods such as described in U.S. Pat. No. 8,222,986 issued on Jul. 17, 2012, which is all incorporated herein by reference in its entirety. Such systems and methods described in U.S. Pat. No. 7,681,256 issued Mar. 23, 2010, U.S. Pat. No. 7,750,781 issued Jul. 6, 2010, U.S. Pat. No. 7,755,462 issued Jul. 13, 2010, U.S. Pat. No. 7,812,698 issued Oct. 12, 2010, U.S. Pat. Nos. 7,817,002, 7,817,003, 7,817,004, 7,817,005, and 7,817,006 issued Oct. 19, 2010, U.S. Pat. No. 7,821,367 issued Oct. 26, 2010, U.S. Pat. Nos.

7,823,300 and 7,824,083 issued Nov. 2, 2011, U.S. Pat. No. 7,834,729 issued Nov. 16, 2011, U.S. Pat. No. 7,839,247 issued Nov. 23, 2010, U.S. Pat. Nos. 7,843,295, 7,843,296, and 7,843,297 issued Nov. 30, 2010, U.S. Pat. No. 7,893,803 issued Feb. 22, 2011, U.S. Pat. Nos. 7,956,711 and 7,956,712 issued Jun. 7, 2011, U.S. Pat. Nos. 7,958,575, 7,961,068 and 7,961,069 issued Jun. 14, 2011, U.S. Pat. No. 7,963,818 issued Jun. 21, 2011, and U.S. Pat. Nos. 8,015,752 and 8,016,330 issued Sep. 13, 2011, and U.S. Pat. No. 8,035,260 issued Oct. 11, 2011 are all incorporated by reference herein in their entirety.

Material presented herein may relate to and/or be implemented in conjunction with systems and methods described in U.S. Provisional Patent Application 61/640,979, filed May 1, 2012 titled "System for Detaching a Magnetic Structure from a Ferromagnetic Material", which is incorporated herein by reference. Material may also relate to systems and methods described in U.S. Provisional Patent Application 61/796,253, filed Nov. 5, 2012 titled "System for Controlling Magnetic Flux of a Multi-pole Magnetic Structure", which is incorporated herein by reference. Material may also relate to systems and methods described in U.S. Provisional Patent Application 61/735,460 filed Dec. 10, 2012 titled "An Intelligent Magnetic System", which is incorporated herein by reference.

The present invention relates to a system for concentrating magnetic flux of a multi-pole magnetic structure having rectangular or striped polarity regions having either a positive or negative polarity that are separated by non-magnetic regions, where the polarity regions may have an alternating polarity pattern or have a polarity pattern in accordance with a code, where herein an alternating polarity pattern corresponds to polarity regions having substantially the same size such that produced magnetic fields alternate in polarity substantially uniformly. In contrast, a coded polarity pattern may comprise adjacent regions having the same polarity (e.g., two North polarity stripes separated by a non-magnetized region) and adjacent regions having opposite polarity or may comprise alternating polarity regions that have different sizes (e.g., a North polarity region of width 2X next to a South polarity region of width X). As described in patents referenced above, coded magnetic structures have at least three code elements and produce peak forces when aligned with a complementary coded magnetic structure but have forces that substantially cancel when such structures are misaligned, whereas complementary (uniformly) alternating polarity magnetic structures produce either all attract forces or all repel forces when their respective magnetic regions are in various alignments. Several examples of coded magnetic structures based on Barker 4 codes are provided herein but one skilled in the art will understand that other Barker codes and other types of codes can be employed such as those described in the patents referenced above.

In accordance with the invention, polarity regions can be separated magnets or can be printed magnetic regions on a single piece of magnetizable material. Such printed regions can be stripes made up of groups of printed maxels such as described in patents referenced above. Pole pieces are magnetically attached to the magnets or (maxel stripes) using a magnet-to-pole piece interface with a first area. The pole pieces can then be attached to a target such as a piece of ferromagnetic material or to complementary pole pieces using a pole piece-to-target interface that has a second area substantially smaller than the first area. As such, flux provided by the magnetic structure is routed into the pole piece via the magnet-to-pole interface and out of the pole piece using the pole piece-to-target interface, where the amount of flux concentration corresponds to the ratio of the first area divided by the second area.

Although the subject of this invention is the concentration of flux, the goal and methods are quite different than prior art. Prior art methods produce regions of flux concentration somewhere on a surface of magnetic material, where most of the area required to concentrate the flux has low flux density such that when it is taken into account the average flux density across the whole surface is only modestly higher, or may be even lower, than the density that can be achieved with the surface of an ordinary magnet. Thus the force density across the surface of the structure, or the achieved pounds per square inch (psi), is not improved. The primary object of this invention is to produce a surface that when taken as a whole achieves a substantial increase in total flux and therefore force density when in proximity to a ferromagnetic material or another magnet. This is achieved by integrating the flux across a magnetic surface at right angles to the working surface, and then conducting it to the working surface. In this regard, a maximum force density or maximum force produced over an area (e.g., psi) is achieved when the cross section of the pole pieces where they interface with the working surface of a target are just in saturation when in a closed magnetic circuit, where the maximum force density is not achieved when the cross section of the pole pieces where they interface with the working surface of a target is over or under saturated. Furthermore, it is preferable that the magnetic material that sources the flux be as thin as possible but still provide magnetic flux at the flux saturation density of the magnetic material since a larger cross sectional area would act to dilute the force density since no flux emerges from its area. This 'lateral magnet' technique relies on the fact that the saturation flux density of known magnetic materials is substantially lower than the saturation flux density of materials such as low carbon steel or iron, where a saturation flux density corresponds to the maximum amount of flux that can be achieved for a given unit of area. Using this technique, force densities of four or more times the density of the strongest magnetic materials are possible. When inexpensive magnetic materials are used to supply the flux, the multiplication factor can be twenty or more permitting very strong magnetic structures to be constructed very inexpensively.

Figure 1B:
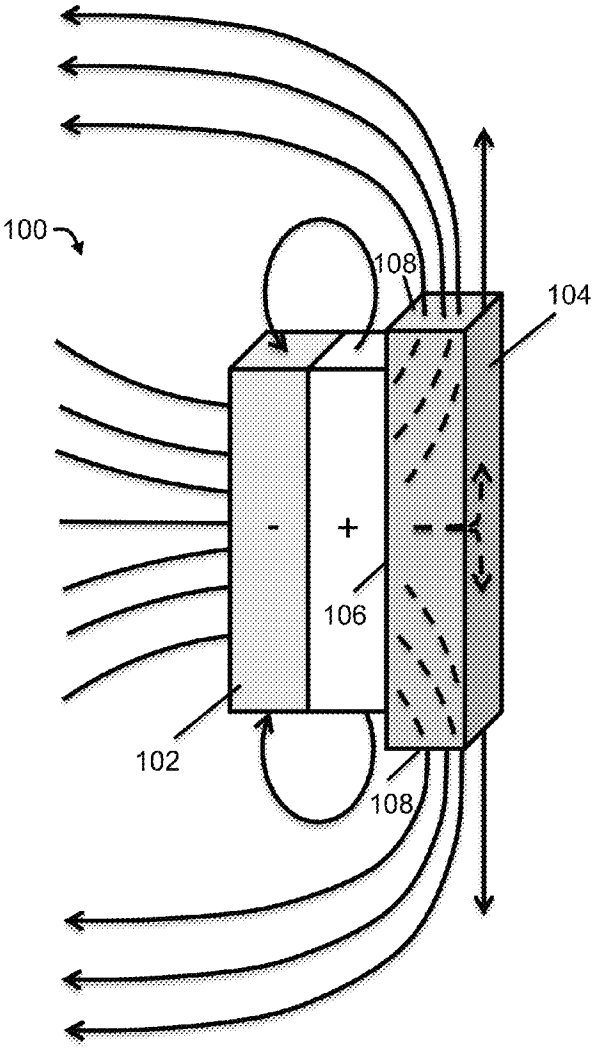
FIG. 1B depicts the magnet of FIG. 1A with a pole piece on one side.
Figure 1A:
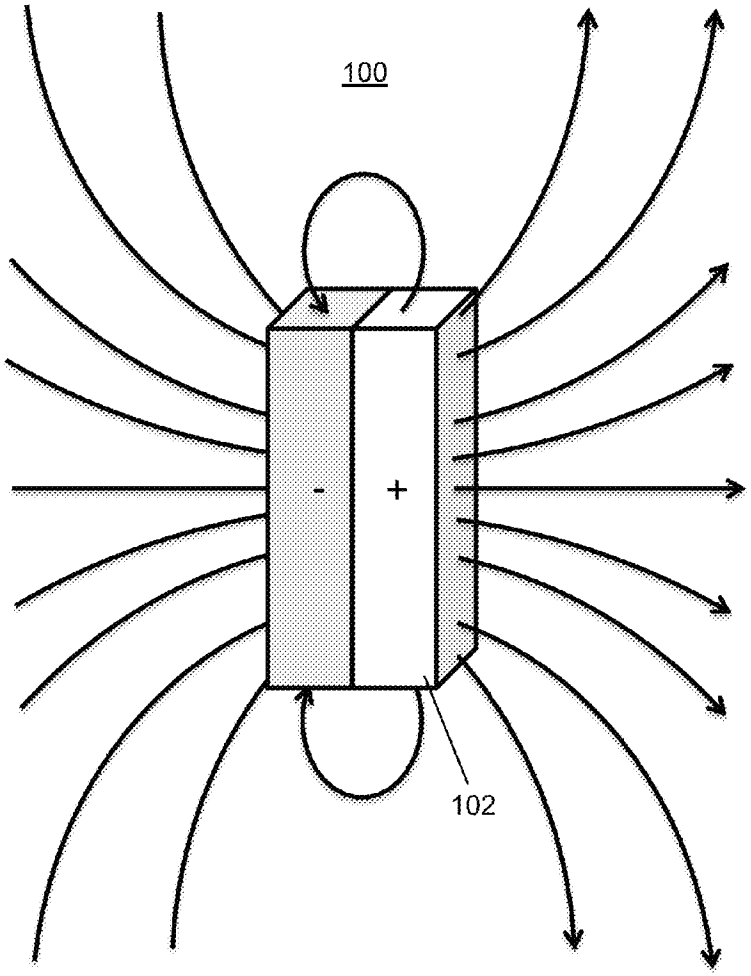
FIG. 1A depicts an exemplary magnetic field of a magnet.

FIG. 1A depicts an exemplary magnet field 100 of a magnet 102, where the magnetic flux lines pass from the South (−) pole to the North (+) pole and then wrap around the magnet to the South pole in a symmetrical manner. When a rectangular pole piece 104 having sufficient ferromagnetic material to achieve saturation is placed onto one side of the magnet 102 as shown in FIG. 1B, the magnetic flux passing from the South pole to the North pole is redirected substantially perpendicular to the magnet 102 by the pole piece 104 such that it exits the top and bottom of the pole piece 104 and again wraps around to the South pole of the magnet 102. As shown the pole piece 104 contacts the magnet 102 using a magnet-to-pole piece interface 106 that is substantially larger than the area of the ends 108 of the pole piece 104 from which the magnetic flux is shown exiting the pole piece 104.

Figure 1C:
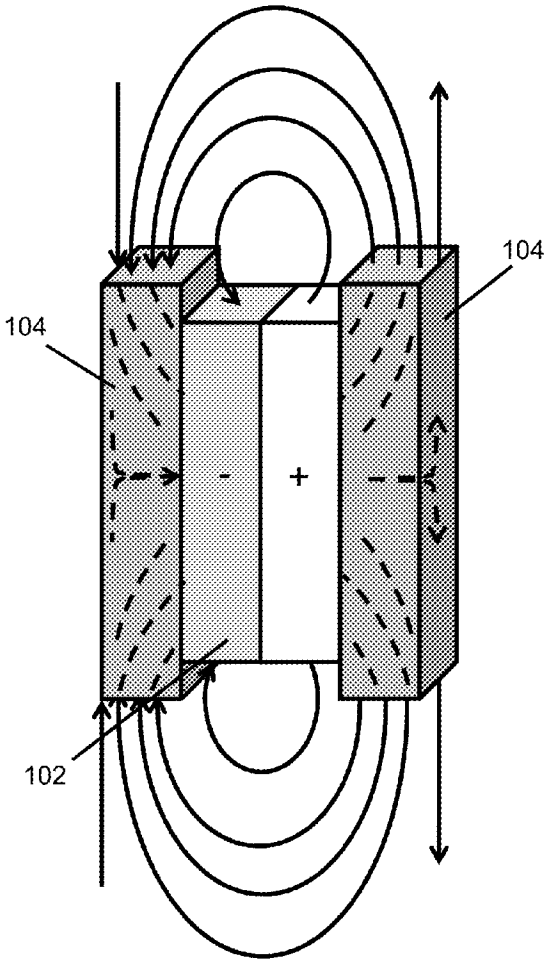
FIG. 1C depicts the magnet of FIG. 1A having pole pieces on opposite sides of the magnet.

FIG. 1C depicts a magnet 102 having two such rectangularpole pieces 104, where there is a pole piece 104 on each side of the magnet 102. As shown the flux is shown being primarily above and below the magnet 102 such that it's attachment interface has been fully rotated 90°.

Figure 2B:
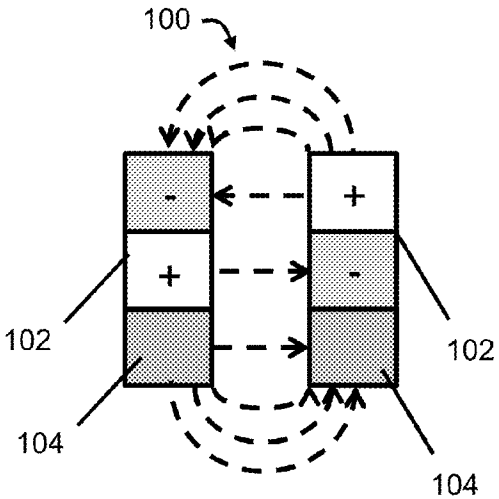
FIGS. 2A and 2B depict portions of exemplary magnetic fields between two adjacent magnets having an opposite polarity relationship and pole pieces on one side of each magnet.
Figure 2A:
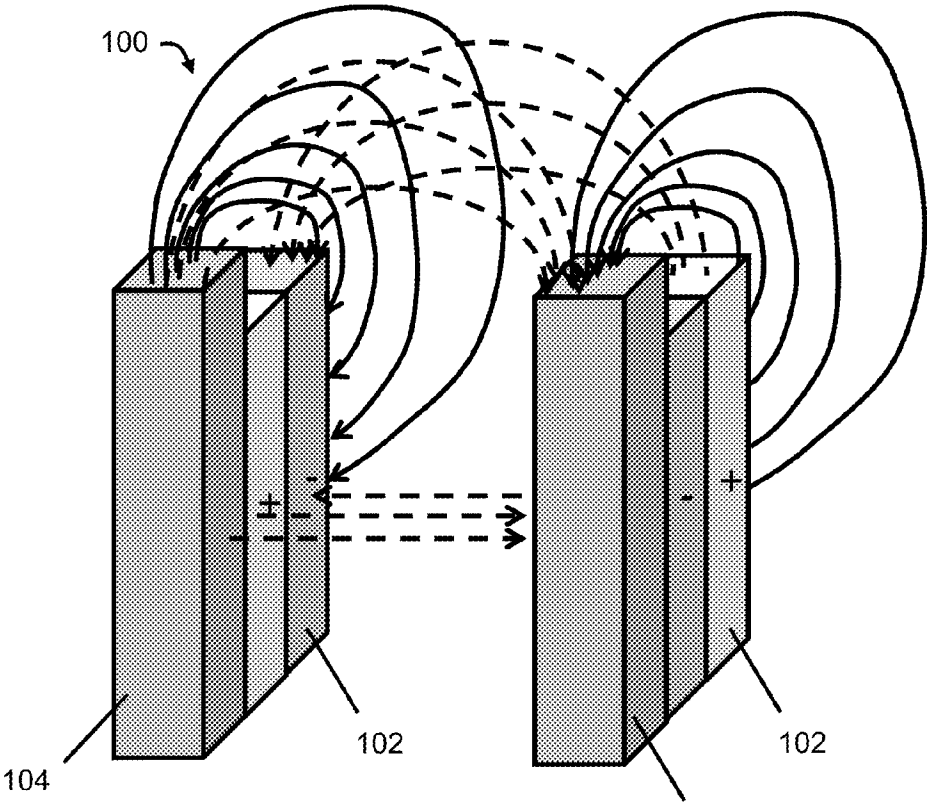

FIGS. 2A and 2B depict portions of exemplary magnetic fields 100 between two adjacent magnets 102 having an opposite polarity relationship, where each magnet 102 has a pole piece 104 on one side.

Figure 3B:
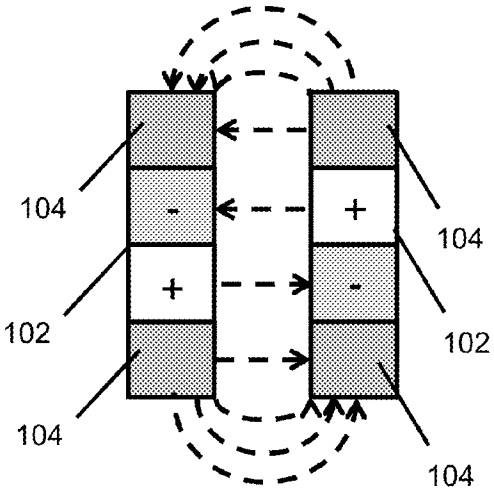
FIGS. 3A and 3B depict portions of exemplary magnetic fields between two adjacent magnets having an opposite polarity relationship and pole pieces on opposite sides of each magnet.
Figure 3A:
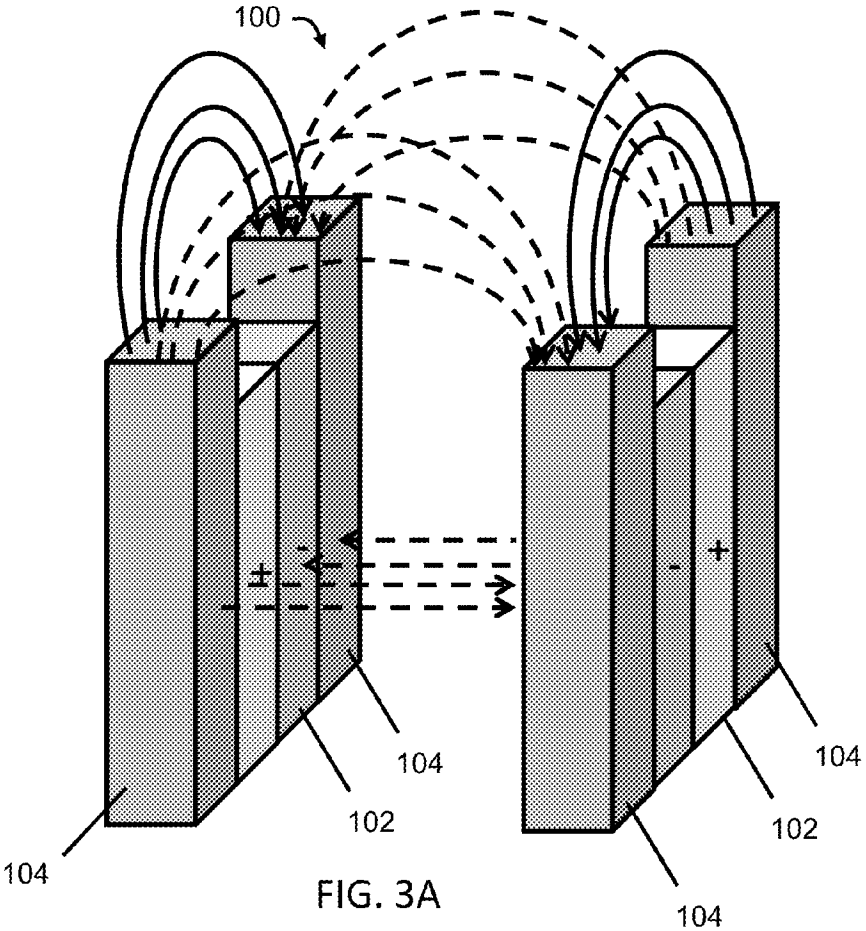

FIGS. 3A and 3B depict portions of exemplary magnetic fields 100 between two adjacent magnets 102 having an opposite polarity relationship, where each magnet 102 has pole pieces 104 on both sides of the magnet 102. Exemplary magnetic fields between the bottom of the pole pieces 104 and the magnets 102, and between the bottoms of the pole pieces 104 are not shown in FIG. 3A.

FIG. 4A depicts an exemplary magnetic structure 400 comprising two spaced magnets 102 having an opposite (or alternating) polarity relationship attached by a shunt plate 402 and attached to a target 404 such as a piece of iron.

FIG. 4B depicts an exemplary magnetic flux circuit created by the shunt plate 402 and the target 404 as indicated by the dotted oval shape. Note that the spacing between magnets 102 can be air or it can be any form of non-magnetic material such as plastic, Aluminum, or the like.

FIG. 4C depicts an exemplary magnetic structure 406 comprising four magnets 102 having an alternating polarity relationship having a shunt plate 402 and attached to a target 404 such that three magnetic flux circuits are created.

FIG. 4D depicts an oblique projection of the magnetic structure 406 of FIG. 4C approaching the target 404, where the target interface area 408 of each magnet 102 has an area equal to the magnet's height (h) multiplied by the magnet's width ($d_1$).

FIG. 5A depicts an exemplary flux concentrator device 500 in accordance with one embodiment of the present invention, which corresponds to the magnetic structure and shunt plate of FIG. 4C with four rectangularpole pieces 104 that each have magnet-to-pole piece interface 502 that interface fully with the target interface surfaces 408 of each of the four magnets 102 of the magnetic structure. The pole pieces 104 are each shown to have a pole piece-to-target interface 504 having an area equal to each pole piece's width (d1) to the pole piece's thickness (d2), where each pole piece width may be equal to the width of the magnet 102 to which it is attached. As such, the flux that is directed to the target 404 is concentrated from a first surface area (d1×h) of the magnet-to-pole piece interface 502 to the second surface area (d1×d2), of the pole piece-to-target interface 504 where the amount of flux concentration corresponds to the ratio of the two areas. Generally, a flux concentrator device 500 may include a magnetic structure comprising a plurality of discrete magnets separated by spacings or may include a printed magnetic structure with maxel stripes separated by spacings (i.e., non-magnetized regions or stripes) and pole pieces 104 that interface with the discrete magnets 102 or the maxel stripes. Maxel stripes are depicted in FIGS. 15A-15D. The pole pieces may extend at least the height of the magnet structure (or beyond) with the purpose of directing flux 90 degrees thereby achieving a greater (pounds force per square inch) psi at the top and/or bottom of the pole pieces 104 than can be achieved at the sides of the magnets 102 to which they are interfacing. Optional shunt plates 402 are shown on the sides of the magnets 102 opposite the pole pieces 104.

FIG. 5B depicts an exemplary magnetic flux circuit 506, where on one side of the magnets 102 the circuit is made using a shunt plate 402 and on the other side of the magnets 102 the circuit is made using two pole pieces 104 attached to a target 404 that spans the two pole pieces 102.

FIG. 5C depicts the exemplary flux concentrator device 500 of FIG. 5A that has been attached to a target 404 that spans the four pole pieces 104 of the device 500. As such, FIG. 5C depicts the three magnetic flux circuits resulting from the use of the shunt plate 402, the pole pieces 104, and the target 404 with the magnets 102.

FIG. 6A shows an exemplary flux concentrator device 500 similar to the device 500 of FIG. 5A except the pole pieces 104 extend both above and below the magnetic structure made up of magnets 102. In FIG. 6B, the pole pieces 104 are the full length of the magnets 102 making up the magnetic structure but do not otherwise extend above or below the magnetic structure. In FIG. 6C, the pole pieces 104 are shorter than the magnets 102 of the magnetic structure where it is intended that the target 404 (not shown) interface with both the magnets 102 and the pole pieces 104. Similarly, in FIG. 6D, the pole pieces 104 are configured to accept targets 404 bottom that interface with the magnets 102 and the pole pieces 104 at the top of the device pole pieces 104.

FIG. 6E depicts additional pole pieces 602 having been added to the upper portions of the magnets 102 in the device 500 of FIG. 6C in order to provide protection to the surfaces of the magnets 102.

FIGS. 7A-7E depict various exemplary flux concentrator devices 700 having pole pieces on both sides of the magnetic structures. FIG. 7A depicts a magnetic structure comprising four alternating polarity magnets 102, which could be four alternating polarity maxel stripes (i.e., a printed magnetic structure), sandwiched between pole pieces 104 that extend from the bottom of the magnets 102 and then slightly above the magnets 102. FIG. 7B depicts pole pieces 104 that extend both above and below the magnets 102. FIG. 7C depicts pole pieces 104 that are the same height and are attached flush with the magnets 102. FIG. 7D depict pole pieces 104 that are shorter than the magnets 102 for receiving a target 404 (not shown) having a corresponding shape (e.g., an elongated C or U shape) or two bar shaped targets 404. FIG. 7E depicts pole pieces 104 configured for receiving two targets 404 having a corresponding shape or four bar shaped targets 404.

FIG. 8A depicts an exemplary flux concentrating device 800 comprising three magnetic structures like those of FIG. 7A except the magnets 102 in the middle structure are each rotated 180° compared to the magnets 102 in the two outer most structures. Because the eight pole pieces 104 in the inside of the device 800 are receiving twice the flux as the eight pole pieces 104 on the outside of the device 800, those pole pieces on the outside are reduced by half such that their PSI is substantially the same as those inside the device 800. FIG. 8B depicts an exemplary flux concentrating device 800 like that of FIG. 8A except the pole pieces 104 in the inside of the device are configured to accept targets 404 (not shown) that recess into the device 800. Such recessing into the device 800 provides a male-female type connection that can provide mechanical strength in addition to magnetic forces.

The concept of male-female type interfaces is further depicted in FIGS. 9A-9G where various shapes are shown, where one skilled in the art will recognize that all sorts of interfaces are possible other than flat interfaces between pole pieces 104 of flux concentrator devices 500/700/800 and targets 404, which may be pole pieces 104 of another flux concentrator device 500/700/800.

FIG. 10A depicts an exemplary flux concentrator device 1000 like that shown previously in FIG. 5A, where the magnetic structure comprises four spaced magnets 102 (or maxel stripes) having a polarity pattern in accordance with a Barker 4 code. FIG. 10B depicts another exemplary flux concentrator device 1000 like that of FIG. 10A, where the magnets 102 of the magnetic structure have a polarity pattern that is complementary to the magnets 102 of the magnetic structure of FIG. 10A. As such, either of the flux concentrator devices 800 of FIGS. 10A and 10B can be turned upside down where the pole pieces 104 of one of the flux concentrator devices 800 is attached to the pole pieces 104 of the other flux concentrator device 800 in accordance with the Barker 4 correlation function.

FIGS. 11A and 11B depict complementary Barker-4 coded flux concentrator devices 1100 that like those of FIGS. 10A and 10B that can be turned upside down and aligned with the other device 1100 so as to produce a peak attractive force. It should be noted that if either structure is placed on top of a duplicate of itself that a peak repel force can be produced, which is effectively inverting the correlation function of the Barker 4 code.

FIG. 12 depicts four Barker-4 coded flux concentrator devices 1000 oriented in an array where they are spaced apart that produce a Barker-4 by Barker-4 coded composite flux concentrator device 1200.

FIGS. 13A and 13B depict two variations of self-complementary Barker4-2 coded flux concentrator devices 1300, where each device can be placed on top of a duplicate device 1300 and aligned to produce a peak attract force and where the devices will align in the direction perpendicular to the code because each Barker-4 code element is represented by a '+−' or '−+' symbol implemented perpendicular to the code.

FIG. 14 depicts exemplary tapered pole pieces 104. In FIG. 14 the pole pieces 104 are tapered such that they are thinner at the bottom of the magnets 102 and grow thicker and thicker towards the pole piece-to-target interface 504. By tapering the pole pieces 104, there can be less flux leakage between adjacent pole pieces 104.

FIGS. 15A and 15B depict and exemplary printed magnetic structure 1500 that comprises alternating polarity spaced maxel stripes 1502 1504, where each of the overlapping circles represents a printed positive polarity maxel 1506 or negative polarity maxel 1508. FIGS. 15C and 15D depicts an exemplary printed magnetic structure 1510 comprising spaced maxel stripes 1502 1504 having a polarity pattern in accordance with a Barker 4 pattern.

In accordance with another embodiment of the invention, a magnetic structure is moveable relative to one or more pole pieces enabling force at a pole piece-to-target interface to be turned on, turned off, or controlled between some minimum and maximum value. One skilled in the art will recognize that the magnetic structure may be tilted relative to pole pieces or may be moved such that the pole pieces span between opposite polarity magnets (or stripes) so as to substantially prevent the magnetic flux from being provided to the pole piece-to-target interface. Systems and methods for moving pole pieces relative to a magnetic structure are described in patent filings previously referenced.

FIG. 16A depicts an oblique view of an exemplary prior art Halbach array 1600 constructed of five discreet magnets 102 having magnetization directions in accordance with the directions of the arrows, where X represents the back end (or tail) of an arrow and the circle with a dot in the middle represents the front end (or tip) of an arrow. Such an array causes the magnetic flux to be concentrated beneath the structure as shown. FIG. 16B depicts a top down view of the same exemplary Halbach array 1600 of FIG. 16A.

FIGS. 17A and 17B depict side and oblique views of an exemplary hybrid magnet-pole piece structure 1700 in accordance with one aspect of the invention. The hybrid magnet-pole piece structure 1700 comprises three magnets 102 sandwiching two pole pieces 104, where the magnets 104 have a polarity arrangement like those of the first, third, and fifth magnets of the Halbach array 1600 of FIGS. 16A and 16B. The magnetic behavior however, is substantially different. With the Halbach array of magnets 102, the field is always concentrated on one side of the magnetic structure 1600. With the hybrid magnet-pole piece structure (or hybrid structure) 1700, when a target material 404 such as a ferromagnetic material is not present to complete a circuit between the two pole pieces 104, the opposite polarity fields emitted by the pole pieces are emitted on all sides of the poles substantially equally. But, when a target material 404 is placed on any of the four sides of the hybrid structure, a magnetic circuit is closed, where the direction of the fields through the pole pieces depends on which side the target 404 is placed. For example, in FIG. 17C the flux lines are shown moving in a clockwise direction, whereas in FIG. 17D the flux lines are shown moving in a clockwise direction, where the flux through the magnet 102 and target 404 is the same in both instances but the flux direction through the poles 104 is reversed. Similarly, the targets could be placed on the front or back of the hybrid structure 1700 and the flux lines going through the pole pieces 104 would rotate plus or minus ninety degrees.

Similarly, as shown in FIGS. 17J and 17K, two complementary hybrid structures 1700 can be near each other but separated and they will not substantially react magnetically until the pole pieces 104 of the hybrid structures 1700 are substantially close or they come in contact at which time a circuit is completed between them and the flux is concentrated at the ends of the contacting pole pieces 104.

FIG. 17G depicts a lateral magnet hybrid structure 1702 where without a target 404 the fields emitted at the ends of the poles pieces 104 are substantially the same and are not concentrated. Like with the hybrid structure 1700 shown in FIGS. 17A-17D, the flux direction through the pole pieces 104 depends on which ends of the pole pieces 104 that the target 404 is placed. In FIG. 17H, the flux is shown moving in a clockwise manner but in FIG. 17I, the flux is shown moving in a counter-clockwise direction.

Similarly, as shown in FIGS. 17J and 17K, two complementary lateral magnet hybrid structures 1702 can be near each other but separated and they will not substantially react magnetically until the pole pieces 104 of the hybrid structures 1702 are substantially close or they come in contact at which time a circuit is completed between them and the flux is concentrated at the ends of the contacting pole pieces 104.

FIGS. 18A and 18B depict a prior art magnet structure 1800 where the magnets in the four corners are magnetized vertically and the side magnets between the corner magnets are magnetized horizontally. The side magnets are oriented such that flux moves towards the corner magnets where the flux is moving downwards and away from the corner magnets where the flux is moving upwards. The resulting effect is that flux is always concentrated beneath the structure.

FIGS. 19A and 19B depict a four magnet-four pole piece hybrid structure 1900 similar to the magnetic structures 1800 of FIGS. 18A and 18B where the corner magnets 102 are replaced with pole pieces 104. In a manner similar to the hybrid structures 1700 of FIGS. 17A and 17B, when a target material 404 such as a ferromagnetic material is not present to complete a circuit between any two pole pieces 104 of adjacent corners, the pole pieces 104 of the hybrid structure 1900 of FIGS. 19A and 19B will emit opposite polarity fields on all sides of the poles substantially equally. However, when a target 404 is placed on top of the hybrid structure 1900, magnetic circuits are produced between poles 104 of adjacent corners where the direction of the flux passing through the poles 104 depends on where the target 404 is placed. As shown, the flux changes direction through the pole pieces 104 when the target 404 is moved from the top of the hybrid structure 1900, as depicted in FIG. 19A, to the bottom of the hybrid structure 1900, as depicted in FIG. 19D.

FIGS. 19L and 19M depict lateral magnet hybrid structures 1902 that are similar to the hybrid structures 1900 of FIGS. 19A and 19B.

FIG. 19E depicts a twelve magnet-four pole piece hybrid structure 1904 that corresponds to a two-dimensional version of the hybrid structure 1700 of FIGS. 17A-17F.

FIG. 19F depicts a twelve lateral magnet-four pole piece hybrid structure 1906 that corresponds to a two-dimensional version of the lateral magnet hybrid structure 1702 of FIGS. 17G-17K.

FIG. 19G depicts use of beveled magnets 102 in a hybrid structure 1908 similar to the hybrid structure 1904 of FIG. 19E.

FIG. 19H depicts use of different sized magnets 102 in one dimension versus another dimension in a hybrid structure 1910 similar to the hybrid structures 1904 1908 of FIGS. 19E and 19G.

FIGS. 19I-19K depict movement of the rows of magnets versus the pole pieces 104 and vertical magnets 102 so as to control the flux that is available at the ends of the pole pieces 104.

FIG. 20 depicts a prior art magnetic structure that directs flux to the top of the structure.

FIGS. 21A and 21B depict a hybrid structure and a lateral magnet hybrid structure each having a pole piece surrounded by eight magnets in the same magnet pattern as the magnetic structure of FIG. 20, where the direction of the flux through the pole piece will depend on which end a target is placed.

FIG. 22A depicts an exemplary hybrid rotor 2200 in accordance with the invention where lateral magnets 102 on either side of pole pieces 104 alternate such that their magnetization is as depicted with the arrows shown. FIG. 22B provides an enlarged segment 2202 of the rotor 2200. Stator coils 2204 having cores 2206 such as depicted in FIGS. 22C and 22D would be placed on a corresponding stator (not shown), where there could be a one-to-one relationship between the number of stator coils 2204 and pole pieces 104 on a rotor 2200 or there could be less stator coils 2204 by some desired ratio of stator coils 2204 to pole pieces 104. The pole pieces 104 and the cores 2206 of each stator coil 2204 are configured such that flux from the pole piece 104 can traverse a small gap between a given pole piece 104 and a given core 2206 of a given stator coil 2204. One skilled in the art will recognize that this arrangement corresponds to a pole piece 104 to stator coil 2204 interface that can be used to enable motors, generators, actuators, and the like based on the use of lateral magnet arrangements.

FIG. 22E depicts an exemplary hybrid rotor and stator coil arrangement 2210 where the cores 2206 of paired stator coils 2204 have shunts plates 402 that join the cores 2206.

FIG. 22F depicts an exemplary hybrid rotor and stator coil arrangement 2212 where the cores 2206 of paired stator coils 2204 are all joined by a single shunt plate 402.

FIG. 22G depicts an exemplary hybrid rotor and stator coil arrangement 2214 where two stator coils 2204 are used with one rotor where the cores 2206 of the paired stator coils 2204 have shunts plates 402 that join the cores 2206. One skilled in the art will understand that when flux from the lateral magnets 102 is being routed to both ends of the pole pieces 104, the material making up the pole pieces 104 can be made thinner.

FIG. 22H depicts an exemplary hybrid rotor and stator coil arrangement 2216 where two stator coils 2204 are used with one rotor 2200 where the cores 2206 of the paired stator coils 2204 are all joined by a single shunt plate 402.

FIG. 22I depicts an exemplary saddle core type stator-rotor interface 2220 where core material 2206 wraps around from one side of the pole piece 104 to the other side providing a complete circuit. A coil 2204 can be placed around the core material 2206 anywhere along the core material 2206 to include the entire core material 2206. This saddle core arrangement is similar to that described in U.S. Non-provisional patent application Ser. No. 13/236,413, filed Sep. 19, 2011, titled "An Electromagnetic Structure Having A Core Element That Extends Magnetic Coupling Around Opposing Surfaces Of A Circular Magnetic Structure", which is incorporated by reference herein.

FIG. 22J depicts an exemplary hybrid rotor and stator coil arrangement 2222 involving two rotors 2200 that are either side of a stator coil array where the opposing pole pieces of the two rotors have opposite polarities.

FIG. 23A depicts an exemplary metal separator lateral magnet hybrid structure 2300 comprising long pole pieces 104 sandwiched between magnets 102 having magnetizations as shown in FIG. 23B. A target 404 placed on top can be used to separate metal from material striking it. Under one arrangement the pole pieces 104 and the target would be shaped to provide a rounded upper surface as depicted in FIG. 23C.

Cyclic lateral magnet assemblies can be arranged to correspond to cyclic codes. FIGS. 24A and 24B depict assemblies 2400 having magnetic structures made up of magnets 102 and pole pieces 104 arranged in accordance with complementary cyclic Barker 4 codes, where the magnets 102 and pole pieces 104 are separated by non-magnetic spacers 2402. As shown in FIG. 24C, the two complementary cyclic lateral magnet assemblies 2400 can be brought together such that their magnetic structures correlate. Either assembly 2400 can then be turned to de-correlate the magnetic structures. A sleeve 2404 is shown that can be used to constrain the relative movement of the two assemblies 2400 relative to each other to rotational movement while allowing the two assemblies 2400 to be brought together or pulled apart.

FIGS. 25A and 25B depict cyclic lateral magnet assemblies 2500 similar to those of FIGS. 24A-24C except lateral magnets around the perimeter 102*a*/104 are combined with conventional magnets 102*b* in the center. As such, when the complementary lateral magnet assemblies 2500 begin to approach each other, the opposite polarity magnets 102*b* in the center of the assemblies 2500, which will have a farther reach than the lateral magnets 102*a*/104, begin to attract each other so to bring the two assemblies 2500 together and, once together, either lateral magnet assembly 2500 can be rotated relative to the other to achieve a correlated peak attract force position. One skilled in the art will recognize that for the cyclic Barker 4 code also requires physical constraint of the two assemblies 2500 so that they can only rotate relative to each other such that the two ends of the assemblies 2500 are always fully facing each other. Various types of mechanisms can be employed such as an outer cylinder or sleeve 2404 that would provide for a male-female connector type attachment.

FIGS. 26A and 26B depict exemplary cyclic lateral magnet assemblies 2600 similar to those of FIGS. 25A and 25B where the individual conventional magnets 102*b* are each replaced with four conventional magnets 102*b* having polarities in accordance with a cyclic Barker 4 code. Whereas the conventional magnets 102*b* of FIGS. 25A and 25B would provide an attract force regardless of rotational alignment, the conventional magnets 102*b* of FIGS. 26A and 26B have a correlation function where there is a peak attract force and substantially zero off peak forces.

FIGS. 27A and 27B depict an exemplary lateral magnet wheel assembly 2700 comprising a ring magnet 102 and a ring-shaped pole piece 104. An axle 2702 can be placed inside the holes 2704 of the lateral magnet wheel assembly 2700 such that the axle 2702 is fixed relative to the lateral magnet wheel assembly 2700 or the assembly 2700 is free to turn relative to the axle 2702. As such, when a fixed axle configuration is used, a motor or other mechanism used to rotate the axle 2702 thereby causes the wheel assembly 2700 to rotate. As depicted in FIG. 27B, flux from the magnet 102 is directed through the pole piece 104 to the target 404.

FIG. 28A depicts an exemplary lateral magnet wheel assembly 2800 comprising a ring magnet 102 and two pole pieces 104, where there is a pole piece 104 on each side of the magnet 102. As depicted in FIG. 28A, flux from the magnet 102 is directed through the two pole pieces 104 to the target 404. Moreover, given pole pieces 104 are on both sides of the magnet 102, a magnetic circuit is created from one pole piece 104 to the target 404 to the other pole piece 104 and through one pole piece 104 through the magnet 102 to the other pole piece 104.

FIG. 28B depicts an exemplary lateral magnet wheel assembly 2802 comprising three ring magnets 102 interleaved between four pole pieces 104, where the ring magnets 102 are in an alternating polarity arrangement. As such, when the wheel assembly 2802 is placed in contact with a target 404 a plurality of magnetic circuits are created with the target 404.

FIG. 28C depicts use of friction surfaces 2804 as part of a lateral magnet wheel assembly 2806 to provide a griping force between the wheel assembly 2806 and a target 404.

FIGS. 29A-29D depict use of a guide ring 2902 and a slot 2904 within a target 404 and optional friction surfaces 2804, where the guide ring 2902 and slot 2904 can enable applications such as toy race cars and tracks as well as enable tracked robotic wheels and the like.

FIGS. 30A and 30B depict combinations of lateral magnetic wheel assemblies 3000*a* 3000*b* and round targets 404 having different diameters that function as gears. In FIG. 30A, the lateral magnet wheel assembly 3000*a* having the smallest diameter is free to rotate relative to a free axle 3002 whereby the rotational force of the fixed axle 3004 driving the lateral magnet wheel assembly 3000*b* having the largest diameter is converted to turn the smaller wheel assembly 3002*a*. Alternatively, as depicted in FIG. 30B, both lateral wheel assemblies 3000*a* 3000*b* could have fixed axles 3004 such that the various diameters of the wheels determine the ratio of turning rates between the axles 3004 fixed to the two lateral magnetic wheel assemblies 3000*a* 3000*b*.

FIGS. 31A-31C depict top, side, and oblique projection views of an exemplary lateral magnet connector assembly 3100 comprising magnets 102 and pole pieces 104 and a connection region 3102 within which some form of connection such as an electrical connection, hydraulics connection, optical connection, or some other form of connection can be made when a lateral magnet connector assembly 3100 is attached to a target 404 or to another lateral magnet connector assembly 3100. As shown in FIGS. 31A and 31B, a plurality of magnets 102 having opposite polarity magnetization are interleaved between pole pieces 104 to form a connector assembly 3100 having a connection region 3102. The connection region 3102 is shown being in a central portion of the assembly 3100 and is shown passing the full height of the assembly 3100. But, the connection region 3102 can have any depth desired and can be located at any desired location other than a central location.

FIGS. 31D-31F show top, side, and oblique projection views of the lateral magnet connector assembly 3100 of FIGS. 31A-31C attached to a target 404 also having a connection region 3102. As such, when the lateral magnet connector assembly 3100 is attached to the target 404 their respective connection regions 3102 become aligned whereby connectors in such connection regions 3102 can be configured to connect.

FIG. 31G depicts the lateral magnetic connector assembly 3100 of FIGS. 31A-31C in an attached state with a complementary lateral magnetic connector assembly 3100', which corresponds to a duplicate of assembly 3100 that has been rotated 180°.

FIGS. 32A and 32B depict top views of two exemplary lateral magnetic connector assemblies 3200*a* 3200*b* having non-magnetic spacers 2402 where the magnets 102 are oriented in accordance with a Barker 4 code. One skilled in the art of coding will recognize that the complementary Barker 4 patterns are implemented with lateral magnet subassemblies 3202 3204 comprising magnets 102 having complementary orientations, whereby complementary lateral magnet subassemblies 3202 3204 are the 'symbols' used to implement the complementary Barker 4 codes. One skilled in the art of correlated magnetics coding will understand that one dimensional codes such as Barker codes can also be implemented in a cyclic manner. For example, the magnets 102*b* in the centers of the lateral magnet assemblies 2500 of FIGS. 25A and 25B could be removed providing for connection regions 3102 in which connectors could be used whereby there is one rotational alignment that would achieve attachment and a desired connection.

FIGS. 33A-33C depict three basic approaches for providing connectors 3302 that connect across a connection boundary 3304 when the two connection regions 3102 of a lateral magnetic connector assembly 3100 and a target 404 (or another lateral magnetic connector assembly 3100) are aligned and magnetically attached. Basically, connectors 3302 can be configured in a male/female type connection configuration such as shown in FIGS. 33A and 33C or in a flush type connection such as shown in FIG. 33B.

FIGS. 34A and 34B depict exemplary electrical contacts 3402, 3404 that can be used in an electrical connector. In FIG. 34A, electrical contacts 3402 such as used in the Apple® Magsafe® power cord are depicted. In FIG. 34B, a male/female type pin connector 3404 is depicted. Generally, all sorts of electrical, fluid, optical, or other types of connectors can be used with the invention.

FIG. 35A depicts a top view of another exemplary lateral magnet connector assembly 3500 comprising four striped magnets 3502, four dipole magnets 102, and ten pole pieces 104 for providing magnetic attachment about a connection region 3102, where the magnetization of the striped magnets 3502 and dipole magnets 102 is indicated by arrows.

FIG. 35B depicts an exemplary striped magnet 3502 where a left portion has a first polarity '−' and a right portion has a second polarity '+' opposite the first polarity, where there is a transition region 3504 where the two polarities transition. Generally, one skilled in the art will recognized that many different transition profiles are possible including polarity transition regions where there is zero field portion that is a line instead of a point.

FIG. 35C depicts an oblique view of the exemplary lateral magnet connector assembly 3500 of FIG. 35A and a corresponding target 404.

Lateral magnet assemblies as described herein can be used for attachment of any two objects such as electronics devices to walls or vehicle dashes. In particular, anywhere that there is room for a magnet to recess into an object the present invention enables a small external attachment point to be provided. One such application could involve a screw-like lateral magnet device that would screw into a sheet rock wall and provide a very strong attachment point for metal or for a complementary lateral magnet device associated with another object (e.g., a picture frame).

Lateral magnet assemblies can generally be used to provide strong magnetic attachment to a ferromagnetic material and can be used for such applications as lifting metal, metal separators, metal chucks, and the like. One skilled in the art will understand that mechanical advantage can be used to detach a lateral magnet from a ferromagnetic material. The use of mechanical advantage is described in U.S. patent application Ser. No. 13/779,611, filed Feb. 27, 2013, and titled "System for detaching a magnetic structure from a ferromagnetic material", which is incorporated by reference herein in its entirety.

Moreover, a coded magnetic structure comprising conventional magnets or which is a piece of magnet material having had maxels printed onto it can also interact with lateral magnet structures to included complementary coded magnetic and lateral magnet structures.

While particular embodiments of the invention have been described, it will be understood, however, that the invention is not limited thereto, since modifications may be made by those skilled in the art, particularly in light of the foregoing teachings.

The invention claimed is:

1. A lateral magnet assembly, comprising:

a multi-pole magnetic structure comprising one or more pieces of a magnetizable material having a plurality of polarity regions for providing a magnetic flux, said magnetizable material having a first saturation flux density, said plurality of polarity regions being magnetized in a plurality of magnetization directions; and a plurality of pole pieces of a ferromagnetic material for integrating said magnetic flux across said plurality of polarity regions and directing said magnetic flux at right angles to one of a target or a complementary lateral magnet assembly, said ferromagnetic material having a second saturation flux density, each pole piece of said plurality of pole pieces having a magnet-to-pole piece interface with a corresponding polarity region and a pole piece-to-target interface with said one of said target or said complementary lateral magnet assembly, and having an amount of said ferromagnetic material sufficient to achieve said second saturation flux density at the pole piece-to-target interface when in a closed magnetic circuit, said magnet-to-pole piece interface having a first area, said pole piece-to-target interface having a second area, said magnetic flux being routed into said pole piece via said magnet-to-pole interface and out of said pole piece via said pole piece-to-target interface, said routing of said magnetic flux through said pole piece resulting in an amount of concentration of said magnetic flux at said pole piece-to-target interface corresponding to the ratio of the first area divided by the second area, said amount of concentration of said magnetic flux corresponding to a maximum force density.

2. The lateral magnet assembly of claim 1, wherein said polarity regions are separate magnets.

3. The lateral magnet assembly of claim 1, wherein said polarity regions have a substantially uniformly alternating polarity pattern.

4. The lateral magnet assembly of claim 1, wherein said polarity regions have a polarity pattern in accordance with a code having a code length greater than 2.

5. The lateral magnet assembly of claim 4, wherein said code is a Barker code.

6. The lateral magnet assembly of claim 1, wherein said polarity regions are printed magnetic regions on a single piece of magnetizable material.

7. The lateral magnet assembly of claim 6, wherein said printed magnetic regions are separated by non-magnetized regions.

8. The lateral magnet assembly of claim 6, wherein said printed magnetic regions are stripes.

9. The lateral magnet assembly of claim 8, wherein said stripes are groups of printed maxels.

10. The lateral magnet assembly of claim 1, further comprising:

a shunt plate for producing a magnetic flux circuit between at least two polarity regions of said plurality of polarity regions.

11. The lateral magnet assembly of claim 1, wherein each of said plurality of polarity regions has one of a first magnetization direction or a second magnetization direction that is opposite to said first magnetization direction.

12. The lateral magnet assembly of claim 1, wherein each of said plurality of polarity regions has one of a first magnetization direction, a second magnetization direction that is opposite to said first magnetization direction, a third magnetization direction that is perpendicular to said first magnetization direction, or a fourth magnetization direction that is opposite to said third magnetization direction.

13. The lateral magnet assembly of claim 1, wherein a thickness of said one or more pieces of magnetizable material is sufficient to just provide said magnetic flux having said first flux density at said magnet-to-pole interface as required to achieve said maximum force density at said pole piece-to-target interface.

14. The lateral magnet assembly of claim 1, wherein a length of at least one pole piece of said plurality of pole pieces is substantially equal to a length of at least one polarity region of said plurality of polarity regions.

15. The lateral magnet assembly of claim 1, wherein a length of at least one pole piece of said plurality of pole pieces is a different length of at least one polarity region of said plurality of polarity regions.

16. The lateral magnet assembly of claim 1, wherein at least one pole piece of said plurality of pole pieces and said target have a male-female type interface.

17. The lateral magnet assembly of claim 1, wherein said lateral magnet assembly and said one of said target or said complementary lateral magnet assembly form a connector.

18. The lateral magnet assembly of claim 17, wherein said connector is one of an electrical connector, an optical connector, or a hydraulics connector.

19. The lateral magnet assembly of claim 1, wherein said lateral magnet assembly is a cyclic lateral magnet assembly.

20. The lateral magnet assembly of claim 1, further comprising:

an axle.

* * * * *